US009881463B2

(12) United States Patent
Fujisawa et al.

(10) Patent No.: US 9,881,463 B2
(45) Date of Patent: Jan. 30, 2018

(54) GAMING MACHINE ARRANGING SYMBOLS

(71) Applicants: Universal Entertainment Corporation, Koto-ku, Tokyo (JP); Aruze Gaming America, Inc., Las Vegas, NV (US)

(72) Inventors: Masumi Fujisawa, Tokyo (JP); Kenta Kitamura, Tokyo (JP); Susumu Mio, Tokyo (JP); Hidekazu Suzuki, Tokyo (JP); Kazuo Okada, Tokyo (JP)

(73) Assignees: Universal Entertainment Corporation, Tokyo (JP); Aruze Gaming America, Inc., Las Vegas, NV (US)

( * ) Notice: Subject to any disclaimer, the term of this patent is extended or adjusted under 35 U.S.C. 154(b) by 471 days.

(21) Appl. No.: 14/029,910

(22) Filed: Sep. 18, 2013

(65) Prior Publication Data

US 2014/0094254 A1 Apr. 3, 2014

(30) Foreign Application Priority Data

Sep. 28, 2012 (JP) ..... 2012-217328

(51) Int. Cl.

*A63F 9/00* (2006.01)
*G07F 17/34* (2006.01)
*G07F 17/32* (2006.01)

(52) U.S. Cl.

CPC ..... *G07F 17/34* (2013.01); *G07F 17/3202* (2013.01); *G07F 17/3265* (2013.01); *G07F 17/3267* (2013.01)

(58) Field of Classification Search

USPC ..... 463/16–18, 20
See application file for complete search history.

(56) References Cited

U.S. PATENT DOCUMENTS 4,097,048 A 6/1978 Poulsen et al.
4,508,345 A 4/1985 Okada
6,126,165 A * 10/2000 Sakamoto ..... G07F 17/32 273/143 R
6,485,367 B1 * 11/2002 Joshi ..... G07F 17/3244 463/13
7,942,733 B2 5/2011 Sakuma
2004/0048650 A1 * 3/2004 Mierau ..... G07F 17/3265 463/20
2004/0127280 A1 * 7/2004 Moody ..... G07F 17/32 463/20
2006/0160595 A1 * 7/2006 Gerson ..... G07F 17/32 463/16
2006/0183535 A1 * 8/2006 Marks ..... G07F 17/3244 463/20
2006/0252495 A1 * 11/2006 Gerson ..... G07F 17/32 463/20

(Continued)

*Primary Examiner* — Omkar Deodhar
*Assistant Examiner* — Ross Williams
(74) *Attorney, Agent, or Firm* — Potomac Law Group, PLLC; Kenneth Fagin

(57) ABSTRACT

Provided is a gaming machine which does not bore the player through reel actions until completion of rearrangement of symbols. Under the condition where predetermined symbols are aligned on a payline when the symbols of a first scroll line of at least one of a plurality of scroll lines are being scrolled and symbols on the remaining second scroll lines are stopped, the gaming machine changes scrolling motion of symbols of the first scroll line.

4 Claims, 47 Drawing Sheets

(56) References Cited

U.S. PATENT DOCUMENTS

| | | | | |
|---|---|---|---|---|
| 2006/0264254 | A1* | 11/2006 | Aoki | G07F 17/3267 463/20 |
| 2007/0060295 | A1* | 3/2007 | DeMar | G07F 17/32 463/20 |
| 2008/0020836 | A1* | 1/2008 | Lucchesi | G07F 17/32 463/30 |
| 2008/0119282 | A1* | 5/2008 | Bennett | G07F 17/3244 463/42 |
| 2008/0318660 | A1* | 12/2008 | Nores | G07F 17/32 463/20 |
| 2009/0191936 | A1* | 7/2009 | Hawkins | G07F 17/32 463/16 |
| 2009/0227353 | A1* | 9/2009 | Yoshizawa | G07F 17/3267 463/20 |
| 2010/0062827 | A1* | 3/2010 | Hoffman | G07F 17/34 463/20 |
| 2010/0190543 | A1* | 7/2010 | Englman | G07F 17/34 463/20 |
| 2011/0065492 | A1* | 3/2011 | Acres | G07F 17/3227 463/20 |
| 2015/0332545 | A1* | 11/2015 | Kitamura | G07F 17/34 463/20 |

* cited by examiner

FIG. 8

| SYMBOL CODE | Reel 1 (52A) | Reel 2 (52B) | Reel 3 (52C) |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK2 | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

FIG. 22

| No. | PERFORMANCE COMBINATION | PERFORMANCE DISTRIBUTION | | | | | | | | |
|---|---|---|---|---|---|---|---|---|---|---|
| | PERFORMANCE FROM SPINNING TO STOP | Table A | Table B | Table C | Table D | ··· | Table K | ··· | Table U | Table V |
| | EXPECTATION LEVEL | 90% | | | | | | | | |
| 0 | Normal Spin | 299 | 449 | 450 | 710 | ··· | 430 | ··· | 2900 | 2050 |
| 1 | 3REEL_Slow Li-zhi_Level1 | 5 | 10 | 100 | 10 | ··· | 5 | ··· | 0 | 0 |
| ··· | ··· | ··· | ··· | ··· | ··· | ··· | ··· | ··· | ··· | ··· |
| 4 | 3REEL_Slow-Fast_Level1_step1 | 5 | 10 | 100 | 10 | ··· | 5 | ··· | 0 | 0 |
| ··· | ··· | ··· | ··· | ··· | ··· | ··· | ··· | ··· | ··· | ··· |
| 10 | 3REEL_Forward-Reverse_Level1_step1 | 10 | 10 | 100 | 10 | ··· | 5 | ··· | 0 | 0 |
| ··· | ··· | ··· | ··· | ··· | ··· | ··· | ··· | ··· | ··· | ··· |
| 16 | 2REEL_Slow Li-zhi_Level1 | 7 | 7 | 50 | 10 | ··· | 5 | ··· | 0 | 150 |
| ··· | ··· | ··· | ··· | ··· | ··· | ··· | ··· | ··· | ··· | ··· |
| 19 | 2REEL_Slow-Fast_Level1_step1 | 30 | 30 | 50 | 10 | ··· | 5 | ··· | 0 | 0 |
| ··· | ··· | ··· | ··· | ··· | ··· | ··· | ··· | ··· | ··· | ··· |
| 25 | 2REEL_Forward-Reverse_Level1_step1 | 10 | 10 | 50 | 10 | ··· | 5 | ··· | 0 | 0 |
| ··· | ··· | ··· | ··· | ··· | ··· | ··· | ··· | ··· | ··· | ··· |
| 31 | 2REEL_Slow Li-zhi Nudge_1 | 150 | 150 | 50 | 0 | ··· | 0 | ··· | 0 | 0 |
| ··· | ··· | ··· | ··· | ··· | ··· | ··· | ··· | ··· | ··· | ··· |
| 35 | 2REEL_Slow-Fast_Nudge_1 | 150 | 150 | 50 | 0 | ··· | 0 | ··· | 0 | 0 |
| ··· | ··· | ··· | ··· | ··· | ··· | ··· | ··· | ··· | ··· | ··· |
| 39 | 2REEL_Forward-Reverse_Nudge_1 | 150 | 150 | 50 | 0 | ··· | 0 | ··· | 0 | 0 |
| ··· | ··· | ··· | ··· | ··· | ··· | ··· | ··· | ··· | ··· | ··· |
| 43 | 1_3REEL_premium_1 | 100 | 100 | 50 | 1000 | ··· | 200 | ··· | 0 | 0 |
| 44 | 1_3REEL_premium_2 | 100 | 100 | 50 | 1000 | ··· | 200 | ··· | 0 | 0 |
| 45 | All Slow Spin | 0 | 0 | 0 | 0 | ··· | 2000 | ··· | 0 | 0 |
| 46 | Fast Stop Together | 0 | 0 | 0 | 0 | ··· | 0 | ··· | 50 | 0 |
| 47 | Premium 1 | 0 | 0 | 0 | 0 | ··· | 0 | ··· | 50 | 500 |
| 48 | Premium 2 | 100 | 100 | 50 | 50 | ··· | 50 | ··· | 0 | 0 |

FIG. 23

A ⓪ RED SEVEN AND BLUE SEVEN COMPLETED TOGETHER AT SPECIFIC POSITIONS

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(A－1)

DRAWING RESULT SATISFYING REQUIREMENTS

| | Reel 1 | Reel 2 | Reel 3 |
|---|---|---|---|
| POSITION | 3 | 3 | 3 |
| DRAWING RESULT | RED7 | RED7 | RED7 |
| | BLANK | BLANK | BLANK |
| | BLUE7 | BLUE7 | BLUE7 |

(A－2)

THIS DRAWING RESULT ONLY REQUIREMENTS: RED SEVEN AND BLUE SEVEN COMPLETED

B ① ANY7 OR HIGHER COMBINATIONS AT SPECIFIC POSITIONS

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(B－1)

DRAWING RESULT SATISFYING REQUIREMENTS

| | Reel 1 | Reel 2 | Reel 3 |
|---|---|---|---|
| POSITION | 3 | | 3 |
| DRAWING RESULT | RED7 | | RED7 |
| | BLANK | | BLANK |
| | BLUE7 | | BLUE7 |

(B－2)

C ② ANY7 OR HIGHER COMBINATIONS AT SPECIFIC POSITIONS

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(C－1)

DRAWING RESULT SATISFYING REQUIREMENTS

| | Reel 1 | Reel 2 | Reel 3 |
|---|---|---|---|
| POSITION | 3 | 3 | |
| DRAWING RESULT | RED7 | RED7 | |
| | BLANK | BLANK | |
| | BLUE7 | BLUE7 | |

(C－2)

FIG. 24

D ③ ANY7 OR HIGHER COMBINATION AT SPECIFIC POSITION

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(A－1)

DRAWING RESULT SATISFYING REQUIREMENTS

| | Reel 1 | Reel 2 | Reel 3 |
|---|---|---|---|
| POSITION | | 3 | |
| DRAWING RESULT | | RED7 | |
| | | BLANK | |
| | | BLUE7 | |

(A－2)

E ④ ANY7 OR HIGHER COMBINATIONS AT SPECIFIC POSITIONS

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(B－1)

DRAWING RESULT SATISFYING REQUIREMENTS

| | Reel 1 | Reel 2 | Reel 3 |
|---|---|---|---|
| POSITION | 3 | | 1 |
| DRAWING RESULT | RED7 | | 2BAR |
| | BLANK | | BLANK |
| | BLUE7 | | RED7 |

(B－2)

F ⑤ ANY7 OR HIGHER COMBINATIONS AT SPECIFIC POSITIONS

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(C－1)

DRAWING RESULT SATISFYING REQUIREMENTS

| | Reel 1 | Reel 2 | Reel 3 |
|---|---|---|---|
| POSITION | 3 | | 5 |
| DRAWING RESULT | RED7 | | BLUE7 |
| | BLANK | | BLANK |
| | BLUE7 | | 2BAR |

(C－2)

FIG. 25

G ⑥ ANY7 OR HIGHER COMBINATIONS AT SPECIFIC POSITIONS

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(A－1)

DRAWING RESULT SATISFYING REQUIREMENTS

| | Reel 1 | Reel 2 | Reel 3 |
|---|---|---|---|
| POSITION | 1 | | 3 |
| DRAWING RESULT | 2BAR | | RED7 |
| | BLANK | | BLANK |
| | RED7 | | BLUE7 |

(A－2)

H ⑦ ANY7 OR HIGHER COMBINATIONS AT SPECIFIC POSITIONS

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(B－1)

DRAWING RESULT SATISFYING REQUIREMENTS

| | Reel 1 | Reel 2 | Reel 3 |
|---|---|---|---|
| POSITION | 5 | | 3 |
| DRAWING RESULT | BLUE7 | | RED7 |
| | BLANK | | BLANK |
| | 2BAR | | BLUE7 |

(B－2)

I ⑧ ANY7 OR HIGHER COMBINATION AT SPECIFIC POSITION

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(C－1)

DRAWING RESULT SATISFYING REQUIREMENTS

| | Reel 1 | Reel 2 | Reel 3 |
|---|---|---|---|
| POSITION | 3 | | |
| DRAWING RESULT | RED7 | | |
| | BLANK | | |
| | BLUE7 | | |

(C－2)

FIG. 26

J ⑨ ANY7 OR HIGHER COMBINATION AT SPECIFIC POSITION

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(A－1)

DRAWING RESULT SATISFYING REQUIREMENTS

| | Reel 1 | Reel 2 | Reel 3 |
|---|---|---|---|
| POSITION | | | 3 |
| DRAWING RESULT | | | RED7 |
| | | | BLANK |
| | | | BLUE7 |

(A－2)

K ⑩ ANY7 OR HIGHER COMBINATIONS AT SPECIFIC POSITIONS

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(B－1)

DRAWING RESULT SATISFYING REQUIREMENTS

| | Reel 1 | Reel 2 | Reel 3 |
|---|---|---|---|
| POSITION | 1 | 2 | 3 |
| DRAWING RESULT | 2BAR | BLANK | RED7 |
| | BLANK | RED7 | BLANK |
| | RED7 | BLANK | BLUE7 |

(B－2)

REQUIREMENT: RED7, BLUE7, AND ANY7 ALIGNED ON PAYLINE WITHIN 2 SYMBOL FRAME DIFFERENCE IN EACH REEL

L ⑪ ANY7 OR HIGHER COMBINATION

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(C－1)

DRAWING RESULT SATISFYING REQUIREMENTS

| | Reel 1 | Reel 2 | Reel 3 |
|---|---|---|---|
| POSITION | 10 | 2 | 4 |
| DRAWING RESULT | BLANK | BLANK | BLANK |
| | RED7 | RED7 | BLUE7 |
| | BLANK | BLANK | BLANK |

(C－2)

REQUIREMENT: RED7, BLUE7 AND ANY7 ALIGNED ON PAYLINE

FIG. 27

M ⑫ LI-ZHI STATE AT SPECIFIC POSITIONS

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(A－1)

DRAWING RESULT SATISFYING REQUIREMENTS

| | Reel 1 | Reel 2 | Reel 3 |
|---|---|---|---|
| POSITION | 3 | | 3 |
| DRAWING RESULT | RED7 | | RED7 |
| | BLANK | | BLANK |
| | BLUE7 | | BLUE7 |

(A－2)

REQUIREMENT: IN LI-ZHI STATE, REELS 1 AND 3 INCLUDE POSITION 3 AND REEL 2 DOES NOT INCLUDE POSITIONS 9, 10, AND 11

N ⑬ LI-ZHI STATE AT SPECIFIC POSITIONS

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(B－1)

DRAWING RESULT SATISFYING REQUIREMENTS

| | Reel 1 | Reel 2 | Reel 3 |
|---|---|---|---|
| POSITION | 3 | 3 | |
| DRAWING RESULT | RED7 | RED7 | |
| | BLANK | BLANK | |
| | BLUE7 | BLUE7 | |

(B－2)

REQUIREMENT: IN LI-ZHI STATE, REELS 1 AND 2 INCLUDE POSITION 3

O ⑭ LI-ZHI STATE AT SPECIFIC POSITIONS

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(C－1)

DRAWING RESULT SATISFYING REQUIREMENTS

| | Reel 1 | Reel 2 | Reel 3 |
|---|---|---|---|
| POSITION | 3 | | 1 |
| DRAWING RESULT | RED7 | | 2BAR |
| | BLANK | | BLANK |
| | BLUE7 | | RED7 |

(C－2)

REQUIREMENT: IN LI-ZHI STATE, REEL 1 INCLUDES POSITION 3, REEL 3 INCLUDES POSITION 1, REEL 2 DOES NOT INCLUDE POSITIONS 9, 10, AND 11

FIG. 28

P ⑮ LI-ZHI STATE AT SPECIFIC POSITIONS

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(A－1)

DRAWING RESULT SATISFYING REQUIREMENTS

| | Reel 1 | Reel 2 | Reel 3 |
|---|---|---|---|
| POSITION | 3 | | 3 |
| DRAWING RESULT | RED7 | | BLUE7 |
| | BLANK | | BLANK |
| | BLUE7 | | 2BAR |

(A－2)

REQUIREMENT: IN LI-ZHI STATE, REEL 1 INCLUDES POSITION 3, REEL 3 INCLUDES POSITION 5, AND REEL 2 DOES NOT INCLUDE POSITIONS 9, 10, AND 11

Q ⑯ LI-ZHI STATE AT SPECIFIC POSITIONS

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(B－1)

DRAWING RESULT SATISFYING REQUIREMENTS

| | Reel 1 | Reel 2 | Reel 3 |
|---|---|---|---|
| POSITION | 1 | | 3 |
| DRAWING RESULT | 2BAR | | RED7 |
| | BLANK | | BLANK |
| | RED7 | | BLUE7 |

(B－2)

REQUIREMENT: IN LI-ZHI STATE, REEL 1 INCLUDES POSITION 1, REEL 3 INCLUDES POSITION 3, REEL 2 DOES NOT INCLUDE POSITIONS 9, 10, AND 11

R ⑰ LI-ZHI STATE AT SPECIFIC POSITIONS

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(C－1)

DRAWING RESULT SATISFYING REQUIREMENTS

| | Reel 1 | Reel 2 | Reel 3 |
|---|---|---|---|
| POSITION | 5 | | 3 |
| DRAWING RESULT | BLUE7 | | RED7 |
| | BLANK | | BLANK |
| | 2BAR | | BLUE7 |

(C－2)

REQUIREMENT: IN LI-ZHI STATE, REEL 1 INCLUDES POSITION 5, REEL 3 INCLUDES POSITION 3, REEL 2 DOES NOT INCLUDE POSITIONS 9, 10, AND 11

FIG. 29

S ⑱ LI-ZHI STATE AT SPECIFIC POSITIONS

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(A－1)

DRAWING RESULT SATISFYING REQUIREMENTS

| | Reel 1 | Reel 2 | Reel 3 |
|---|---|---|---|
| POSITION | 11 | | 3 |
| DRAWING RESULT | RED7 | | RED7 |
| | BLANK | | BLANK |
| | 3BAR | | BLUE7 |

(A－2)

REQUIREMENT: REELS 1 AND 3 MAKE LI-ZHI STATE, AND REEL 2 DOES NOT INCLUDE POSITIONS 9, 10, AND 11

T ⑲ LI-ZHI STATE AT SPECIFIC POSITIONS

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(B－1)

DRAWING RESULT SATISFYING REQUIREMENTS

| | Reel 1 | Reel 2 | Reel 3 |
|---|---|---|---|
| POSITION | 11 | 1 | |
| DRAWING RESULT | RED7 | BLANK | |
| | BLANK | RED7 | |
| | 3BAR | BLANK | |

(B－2)

REQUIREMENT: REELS 1 AND 2 MAKE LI-ZHI STATE, AND REEL 2 DOES NOT INCLUDE POSITIONS 9, 10, AND 11

U ⑳ ROSE CHANCE STOP

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(C－1)

DRAWING RESULT SATISFYING REQUIREMENTS

| | Reel 1 | Reel 2 | Reel 3 |
|---|---|---|---|
| POSITION | | 10 | |
| DRAWING RESULT | | BLANK | |
| | | F_ROSE | |
| | | BLANK | |

(C－2)

REQUIREMENT: REELS 1 AND 3 DO NOT MAKE LI-ZHI STATE

FIG. 30

V 21 ROSE CHANCE STOP

| | Reel 1 | Reel 2 | Reel 3 |
|---|---|---|---|
| 0 | 2BAR | 1BAR | 2BAR |
| 1 | BLANK | BLANK | BLANK |
| 2 | RED7 | RED7 | RED7 |
| 3 | BLANK | BLANK | BLANK |
| 4 | BLUE7 | BLUE7 | BLUE7 |
| 5 | BLANK | BLANK | BLANK |
| 6 | 2BAR | 1BAR | 2BAR |
| 7 | BLANK | BLANK | BLANK |
| 8 | 1BAR | 2BAR | 1BAR |
| 9 | BLANK | BLANK | BLANK |
| 10 | RED7 | F_ROSE | RED7 |
| 11 | BLANK | BLANK | BLANK |
| 12 | 3BAR | 2BAR | 1BAR |
| 13 | BLANK | BLANK | BLANK |
| 14 | 1BAR | 3BAR | 3BAR |
| 15 | BLANK | BLANK | BLANK |
| 16 | ROSE | ROSE | ROSE |
| 17 | BLANK | BLANK | BLANK |
| 18 | 3BAR | 3BAR | 3BAR |
| 19 | BLANK | BLANK | BLANK |
| 20 | BLUE7 | BLUE7 | BLUE7 |
| 21 | BLANK | BLANK | BLANK |

(A－1)

DRAWING RESULT SATISFYING REQUIREMENTS

| | Reel 1 | Reel 2 | Reel 3 |
|---|---|---|---|
| POSITION | | 10 | |
| DRAWING RESULT | | BLANK | |
| | | F_ROSE | |
| | | BLANK | |

(A－2)

FIG. 31A
STEP 1 START SPINNING
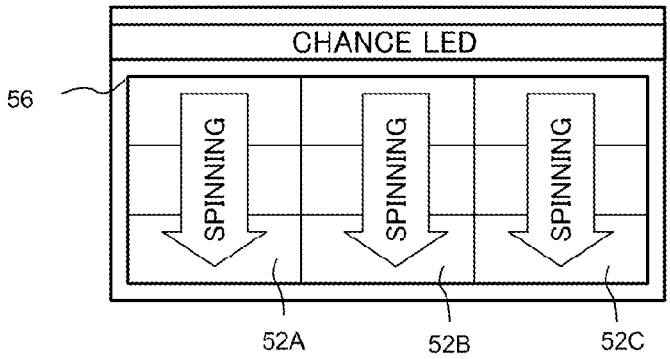
FIG. 31B
STEP 2 STOP REELS 1 AND 3
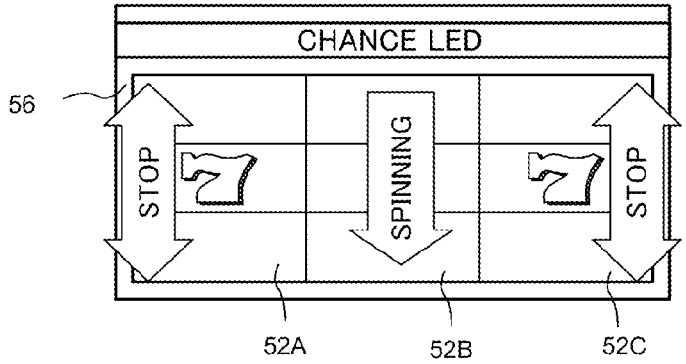
FIG. 31C
STEP 3 NUDGE REELS 1 AND 3 TO INCREASE LI-ZHI LINE
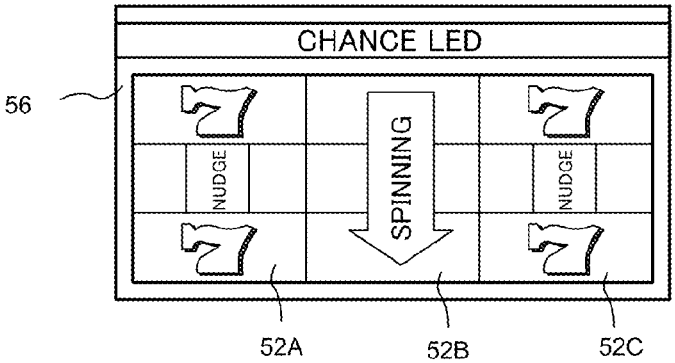
FIG. 31D
COMBINATIONS OF REEL NUDGE
| | 1REEL | 3REEL |
|---|---|---|
| No. 1 | UPWARD | DOWNWARD |
| No. 2 | DOWNWARD | UPWARD |
| No. 3 | UPWARD | UPWARD |
| No. 4 | DOWNWARD | DOWNWARD |

STEP 1 START SPINNING

STEP 2 STOP REEL 1

STEP 3 STOP REEL 3

STEP 4 ILLUMINATE LI-ZHI LINES WITH COLORED LIGHT

STEP 1 START SPINNING

STEP 2 STOP REEL 2

STEP 3 SPECIAL REEL ACTIONS BY REELS 1 AND 3

STEP 1 START SPINNING

STEP 2 STOP REEL 1

STEP 3 STOP REEL 2

STEP 4 ILLUMINATE LI-ZHI LINES WITH COLORED LIGHT

GAMING MACHINE ARRANGING SYMBOLS

CROSS-REFERENCE TO RELATED APPLICATIONS

This application claims priority of Japanese Patent Application No. 2012-217328 filed on Sep. 28, 2012. The contents of this application are incorporated herein by reference in their entirety.

BACKGROUND OF THE INVENTION

Technical Field

The present invention relates to a gaming machine and, in particular, relates to a gaming machine that rearranges symbols in each unit game, in the process of which the manner of scrolling the symbols is changed.

Background Art

Each time a unit game starts in a gaming machine in response to the game player's operation of an operating part such as a set of buttons disposed on a control panel, the gaming machine scrolls symbols to rearrange a part of the symbols in a display area. If a winning pattern is made in the display area after the rearrangement, the player gains a benefit (for example, refer to U.S. Pat. No. 4,097,048).

Considering diverse tastes of players, various gaming machines have been developed. For example, gaming machines different in symbol pattern, game scenario, presentation performances (by sound, image, or reel action) have been developed. Gaming machines that offer a bonus game or a free game under predetermined conditions have also been developed (for example, refer to U.S. Pat. Nos. 4,508,345 and 7,942,733).

In typical, presentation performances by image are provided by a liquid crystal display device. Scrolling symbols may be performed by so-called video reels or by mechanical reels which are made of annular reel strips with symbols thereon.

The mechanical reels are reels with symbols thereon to be rotated mechanically; the manner to rearrange the symbols tends to be monotonous compared with video reels that display symbols on a liquid crystal display device.

SUMMARY OF THE INVENTION

The present invention has been accomplished in view of the foregoing issues and an object of the present invention is, in a gaming machine having mechanical reels, not to bore the player until the symbols have been rearranged by reel action.

An aspect of the present invention is a gaming machine for determining an award to be given based on rearranged symbols, the gaming machine including:

a display device including a display area for showing a part of symbols associated with a plurality of scroll lines; and a controller for controlling unit games in which the symbols associated with the plurality of scroll lines are scrolled and a part of the symbols are rearranged in the display area, the controller being programmed to execute the following processing of (1-1-1) to (1-1-3):

(1-1-1) determining symbols to be rearranged in the display area at random;

(1-1-2) changing scrolling motion of symbols of a first scroll line which is at least one of the plurality of scroll lines, under a condition where predetermined symbols are aligned on a payline when the symbols of the first scroll line are being scrolled and symbols on remaining second scroll lines are stopped; and (1-1-3) rearranging the symbols to be rearranged in the display area after executing the processing of (1-1-2).

Since the scrolling motion of symbols of the first scroll line is changed under the condition where predetermined symbols are aligned on a payline when the symbols of the first scroll line are being scrolled and symbols on remaining second scroll lines are stopped, the player visually recognizes the scrolling motion different from normal motion and can feel expectation from the predetermined symbols aligned on the payline.

Another aspect of the present invention is a gaming machine for determining an award to be given based on rearranged symbols, the gaming machine including:

a display device including a display area for showing a part of symbols associated with a plurality of scroll lines and providing a payline for determining whether to give the award; and a controller for controlling unit games in which the symbols associated with the plurality of scroll lines are scrolled and a part of the symbols are rearranged in the display area, the controller being programmed to execute the following processing of (2-1-1) to (2-1-4):

(2-1-1) determining symbols to be rearranged in the display area at random;

(2-1-2) changing at least one of direction of scrolling, speed of scrolling, time of scrolling, and time to stop scrolling of symbols of a first scroll line, which is at least one of the plurality of scroll lines, under a condition where a winning symbol combination for winning the award is partially completed on a payline when the symbols of the first scroll line are being scrolled and symbols of remaining second scroll lines are stopped;

(2-1-3) rearranging the symbols to be rearranged in the display area after executing the processing of (2-1-2); and (2-1-4) giving the award in a case where the winning symbol combination is completed on the payline with the rearranged symbols.

Since at least one of the direction of scrolling, the speed of scrolling, the time of scrolling, and the time to stop scrolling of symbols of the first scroll line is changed under the condition where a winning combination is partially completed on a payline when the symbols of the first scroll line are being scrolled and symbols of remaining second scroll lines are stopped, the player visually recognizes the scrolling motion different from normal motion and can feel expectation from the predetermined symbols aligned on the payline.

Still another aspect of the present invention is a gaming machine for determining an award to be given based on rearranged symbols, the gaming machine including:

a display device including a display area for showing a part of symbols associated with a plurality of scroll lines and providing paylines for determining whether to give the award; and a controller for controlling unit games in which the symbols associated with the plurality of scroll lines are scrolled and a part of the symbols are rearranged in the display area, the controller being programmed to execute the following processing of (3-1-1) to (3-1-4):

(3-1-1) determining symbols to be rearranged in the display area at random;

(3-1-2) scrolling symbols of a first scroll line, which is a part of the plurality of scroll lines, and stopping symbols of remaining second scroll lines in such a manner that a winning symbol combination for winning the award is partially completed on a first payline on a temporary basis;

(3-1-3) scrolling the symbols of the second scroll lines again and then stopping the symbols of the second scroll lines in such a manner that winning symbol combinations are partially completed on a plurality of second paylines differing from the first payline; and (3-1-4) stopping the symbols of the first scroll line to rearrange the symbols to be rearranged in the display area.

Since a winning combination is partially completed on the first payline on a temporary basis and then a plurality of winning combinations are partially completed on the second paylines different from the first payline, the possibility of winning is raised so that the player can feel higher expectation.

It is preferable that, in the gaming machine, the processing of (3-1-4) include the following processing of (4-1-4):

(4-1-4) changing at least one of direction of scrolling, speed of scrolling, time of scrolling, and time to stop scrolling of the symbols of the first scroll line after performing the processing of (3-1-3).

The player visually recognizes the scrolling motion different from normal motion and can feel expectation for winning.

It is preferable that the gaming machine further include a light source for illuminating the plurality of scroll lines, and that the controller be programmed to further execute the following processing of (5-1-1) and (5-1-2):

(5-1-1) determining color of light emitted from the light source based on an expectation level; and (5-1-2) illuminating the first scroll line with light determined by the processing of (5-1-1) after performing the processing of (3-1-3).

Since the scroll lines are illuminated with light of a color based on the expectation level, the player can feel higher expectation.

It is preferable that, in the gaming machine, the plurality of scroll lines be made of three mechanical reels with symbols attached and the three mechanical reels be disposed side by side, that the controller be programmed to rotate the mechanical reels to scroll the symbols attached to the mechanical reels, that the processing of (3-1-2) be the following processing of (6-1-2):

(6-1-2) rotating one mechanical reel disposed at the middle of the three mechanical reels and stopping the remaining two mechanical reels disposed at both sides in such a manner that a winning symbol combination is partially completed on a first payline on a temporary basis, that the processing of (3-1-3) be the following processing of (6-1-3):

(6-1-3) rotating the remaining two mechanical reels again and then stopping the two mechanical reels in such a manner that winning symbol combinations are partially completed on a plurality of second paylines differing from the first payline in the display area, and that the processing of (3-1-4) be the following processing of (6-1-4):

(6-1-4) stopping all the three mechanical reels by stopping the one mechanical reel disposed at the middle to rearrange the symbols to be rearranged in the display area.

Since a winning combination is partially completed on the first payline and then a plurality of winning combinations are partially completed on the second paylines different from the first payline, the possibility of winning is raised so that the player can feel higher expectation.

It is preferable that, in gaming machine, the controller be programmed to further execute the following processing of (7-1-1):

(7-1-1) giving both of a progressive award for a first winning symbol combination and a progressive award for a second winning symbol combination to the player under a condition where the first winning symbol combination is completed on one of the plurality of second paylines and the second winning symbol combination different from the first winning symbol combination is completed on another payline of the plurality of second paylines when the symbols to be rearranged are rearranged in the display area.

Because of the possibility to receive double progressive awards, the player can feel higher expectation.

The various reel actions prevent the player from getting bored until the symbols have been rearranged in the display window.

BRIEF DESCRIPTION OF THE DRAWINGS

FIG. 8 is a diagram illustrating an example of a symbol code table associating symbols on reels 52A to 52C with symbol codes.

FIG. 22 is a table illustrating a reel action table.

FIG. 23 is a diagram illustrating requirements for selecting one of Table A to Table V in a reel action table.

FIG. 24 is a diagram illustrating requirements for selecting one of Table A to Table V in a reel action table.

FIG. 25 is a diagram illustrating requirements for selecting one of Table A to Table V in a reel action table.

FIG. 26 is a diagram illustrating requirements for selecting one of Table A to Table V in a reel action table.

FIG. 27 is a diagram illustrating requirements for selecting one of Table A to Table V in a reel action table.

FIG. 28 is a diagram illustrating requirements for selecting one of Table A to Table V in a reel action table.

FIG. 29 is a diagram illustrating requirements for selecting one of Table A to Table V in a reel action table.

FIG. 30 is a diagram illustrating requirements for selecting one of Table A to Table V in a reel action table.

FIGS. 31A to 31D are diagrams illustrating a process to make a double li-zhi state after making a li-zhi state.

DESCRIPTION OF THE PREFERRED EMBODIMENTS

Hereinafter, embodiments of the present invention are described with reference to the drawings.

<<<Overview of Gaming Machines in Embodiments>>>

Figure 1:
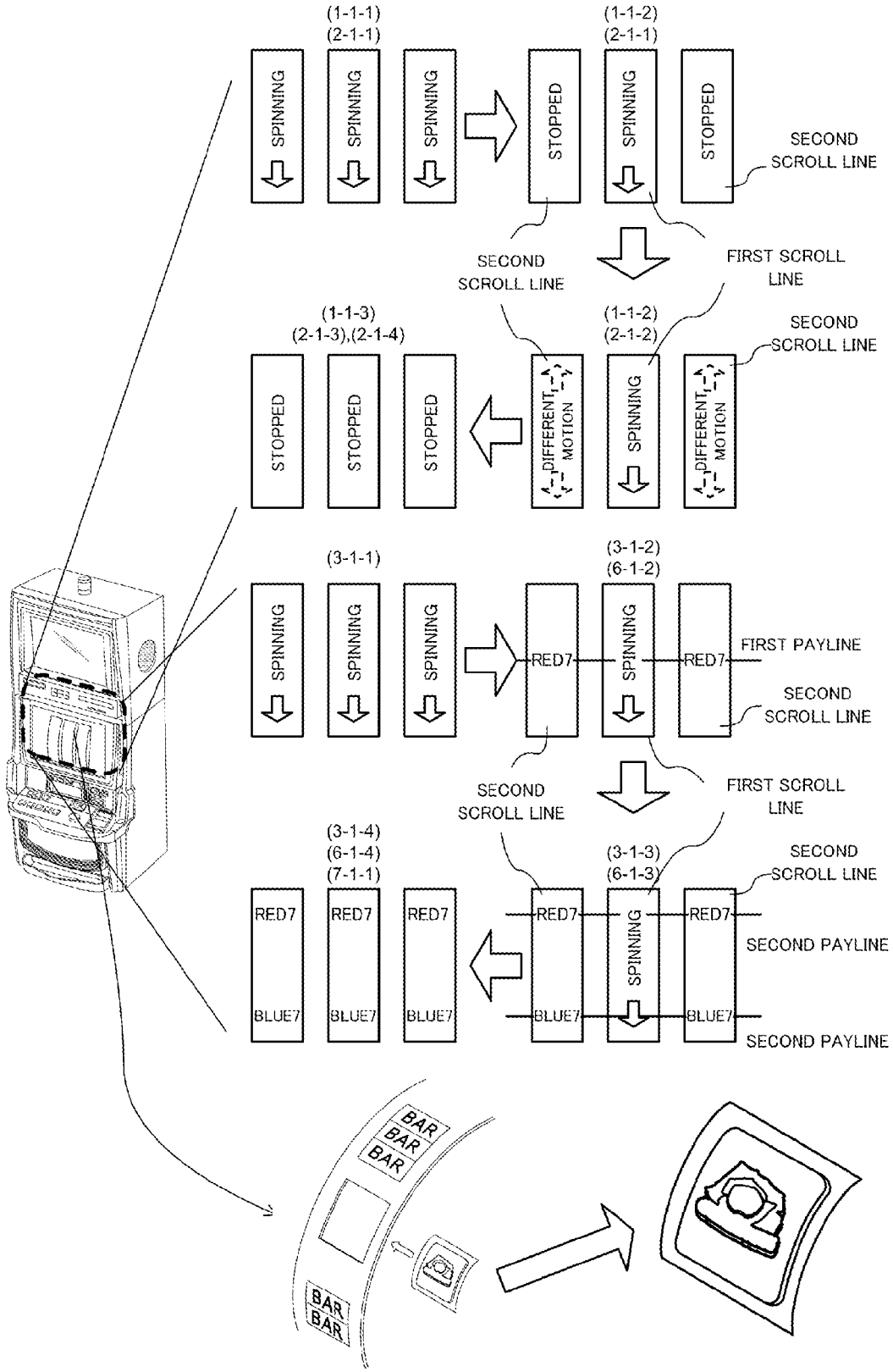
FIG. 1 is a diagram illustrating an outline of a gaming machine according to an embodiment of the present invention.

FIG. 1 is a diagram illustrating an overview of a gaming machine according to an embodiment of the present invention.

A gaming machine according to an embodiment of the present invention is a gaming machine for determining an award to be given based on rearranged symbols, the gaming machine includes:

a display device having a display area for showing a part of symbols associated with a plurality of scroll lines; and a controller for controlling unit games in which the symbols associated with the plurality of scroll lines are scrolled and a part of the symbols are rearranged in the display area, and the controller is programmed to execute the following processing of (1-1-1) to (1-1-3):

(1-1-1) determining symbols to be rearranged in the display area at random;

(1-1-2) changing scrolling motion of symbols of a first scroll line which is at least one of the plurality of scroll lines, under a condition where predetermined symbols are aligned on a payline when the symbols of the first scroll line are being scrolled and symbols of remaining second scroll lines are stopped; and (1-1-3) rearranging the symbols to be rearranged in the display area after executing the processing of (1-1-2).

The gaming machine 10 according to this embodiment determines the award to be given to the player based on the rearranged symbols. The gaming machine 10 includes a display device and a controller.

The display device includes a display area to show symbols. The symbols are individually associated with a plurality of scroll lines.

The controller controls unit games. A unit game is a game that scrolls the symbols associated with the plurality of scroll lines and then rearranges a part of the symbols in the display area to show a result of the game. The controller is programmed to execute the following processing of (1-1-1) to (1-1-3).

The processing of (1-1-1) is to determine symbols to be rearranged in the display area at random. The symbols to be rearranged are symbols to be finally rearranged in the display area and represent the game result. In this embodiment, the symbols representing a game result correspond to the symbols to be stopped. The symbols temporarily rearranged in the display area correspond to symbols to be stopped temporarily.

The processing of (1-1-2) is to change scrolling motion of symbols of a first scroll line which is at least one of the plurality of scroll lines, under a condition where predetermined symbols are aligned on a payline when the symbols of the first scroll line are being scrolled and symbols on remaining second scroll lines are stopped. That is to say, if, in a state where scroll lines being scrolled and stopped scroll lines are mixed together, predetermined symbols of the stopped scroll lines are aligned along a payline, the controller changes the scrolling motion of the symbols of the first scroll line. It is sufficient if the scrolling motion after the change is different from normal motion. For example, the direction of scrolling, the speed of scrolling, the time of scrolling, or the time to stop scrolling can be changed. The changed scrolling motion visually informs the player that the state has been changed from the normal state, giving the player expectation for the game result.

The first scroll line is at least one scroll line of the plurality of scroll lines. The second scroll lines are the remaining scroll lines different from the first scroll line in the plurality of scroll lines.

It is preferable that the processing of (1-1-2) include processing of determining the motion after the change based on the symbols to be rearranged determined by the processing of (1-1-1). The player can predict symbols to be rearranged to some extent and feel expectation by seeing the different motion. The motion after the change does not need to be determined exactly based on the symbols to be rearranged but can be roughly oriented, for example, through a weighted lottery.

The processing of (1-1-3) is to rearrange the symbols to be rearranged in the display area after executing the processing of (1-1-2). This processing can inform the player of the symbols representing the game result.

A gaming machine according to an embodiment of the present invention is a gaming machine for determining an award to be given based on rearranged symbols, the gaming machine includes:

a display device including a display area for showing a part of symbols associated with a plurality of scroll lines and providing a payline for determining whether to give the award; and a controller for controlling unit games in which the symbols associated with the plurality of scroll lines are scrolled and a part of the symbols are rearranged in the display area, and the controller is programmed to execute the following processing of (2-1-1) to (2-1-4):

(2-1-1) determining symbols to be rearranged in the display area at random;

(2-1-2) changing at least one of direction of scrolling, speed of scrolling, time of scrolling, and time to stop scrolling of symbols of a first scroll line, which is at least one of the plurality of scroll lines, under a condition where a winning symbol combination for winning the award is partially completed on a payline when the symbols of the first scroll line are being scrolled and symbols of remaining second scroll lines are stopped;

(2-1-3) rearranging the symbols to be rearranged in the display area after executing the processing of (2-1-2); and (2-1-4) giving the award in a case where the winning symbol combination is completed on a payline with the rearranged symbols.

The gaming machine 10 according to this embodiment determines the award to be given to the player based on the rearranged symbols. The gaming machine 10 includes a display device and a controller.

The display device includes a display area to show symbols. The symbols are individually associated with a plurality of scroll lines. The display device provides a payline for determining whether to give an award. If predetermined symbols are aligned along a payline, a predetermined award is given to the player since the requirement to win is satisfied.

The controller controls unit games. A unit game is a game that scrolls the symbols associated with the plurality of scroll lines and then rearranges a part of the symbols in the display area to show a result of the game. The controller is programmed to execute the following processing of (2-1-1) to (2-1-4).

The processing of (2-1-1) is to determine symbols to be rearranged in the display area at random. The symbols to be rearranged are symbols to be finally rearranged in the display area and represent the game result. In this embodiment, the symbols representing a game result correspond to the symbols to be stopped. The symbols temporarily rearranged in the display area correspond to symbols to be stopped temporarily.

The processing of (2-1-2) is to change the scrolling motion of symbols of a first scroll line under a condition where a winning symbol combination for winning an award is partially completed along a payline when the symbols of the first scroll line are being scrolled and symbols of remaining second scroll lines are stopped.

That is to say, if, in a state where scroll lines being scrolled and stopped scroll lines are mixed together, a winning symbol combination for winning an award is partially completed along a payline with the symbols of the stopped scroll lines, the controller changes the scrolling motion of the symbols of the first scroll line. It is sufficient if the scrolling motion after the change is different from normal motion. For example, the direction of scrolling, the speed of scrolling, the time of scrolling, or the time to stop scrolling can be changed.

It is preferable that the state where scroll lines being scrolled and stopped scroll lines are mixed together be a state where only one scroll line is being scrolled. That is to say, the controller changes the scrolling motion of symbols of a first scroll line under a condition where a winning symbol combination for winning an award is partially completed along a payline when the symbols of only one scroll line are being scrolled and the symbols of the remaining scroll lines are stopped. This state that a winning symbol combination for winning an award is partially completed along a payline when the symbols of only one scroll line are being scrolled and the symbols of the remaining scroll lines are stopped is referred to as so-called "li-zhi" state.

In this description, the "li-zhi" state is a state just before fixing a win in which a winning combination is partially completed by rearranging the symbols in a unit game and is waiting for the final settlement. If the entire winning combination is completed after the "li-zhi" state, a win is fixed. If the entire winning combination is not completed (only a part of the winning combination is ready), the win is not fixed.

In this description, "li-zhi" has the same meaning as "tenpai".

Furthermore, it is preferable that the processing of (2-1-2) include the processing of determining the motion after the change based on the symbols to be rearranged determined by the processing of (2-1-1). The player can predict symbols to be rearranged to some extent and feel expectation by seeing the different motion. The motion after the change do not need to be determined exactly based on the symbols to be rearranged but can be roughly oriented, for example, through a weighted lottery.

In this way, the changed scrolling motion visually informs the player that the state has been changed from the normal state, giving the player expectation for the game result.

The processing of (2-1-3) is to rearrange the symbols to be rearranged in the display area after executing the processing of (2-1-2). This processing can inform the player of the symbols representing a game result.

The processing of (2-1-4) is to give an award in a case where a winning combination is completed on a payline with the rearranged symbols. As described above, if the entire winning combination is finally completed, a win is fixed and the player gets an award for the win. If the entire winning combination is not finally completed (if only a part of the winning combination is ready), the win is not fixed and the player does not receive the award.

A gaming machine according to an embodiment of the present invention is a gaming machine for determining an award to be given based on rearranged symbols, the gaming machine includes:

a display device including a display area for showing symbols associated with a plurality of scroll lines and providing paylines for determining whether to give the award; and a controller for controlling unit games in which the symbols associated with the plurality of scroll lines are scrolled and a part of the symbols are rearranged in the display area, and the controller is programmed to execute the following processing of (3-1-1) to (3-1-4):

(3-1-1) determining symbols to be rearranged in the display area at random;

(3-1-2) scrolling symbols of a first scroll line, which is a part of the plurality of scroll lines, and stopping symbols of remaining second scroll lines in such a manner that a winning symbol combination for winning the award is partially completed on a first payline on a temporary basis;

(3-1-3) scrolling the symbols of the second scroll lines again and then stopping the symbols of the second scroll lines in such a manner that winning symbol combinations are partially completed on a plurality of second paylines differing from the first payline; and (3-1-4) stopping the symbols of the first scroll line to rearrange the symbols to be rearranged in the display area.

The gaming machine 10 according to this embodiment determines the award to be given to the player based on the rearranged symbols. The gaming machine 10 includes a display device and a controller.

The display device includes a display area to show symbols. The symbols are individually associated with a plurality of scroll lines. The display device provides paylines for determining whether to give an award. If predetermined symbols are aligned along a payline, a predetermined award is given to the player since the requirement to win is satisfied.

The controller controls unit games. A unit game is a game that scrolls the symbols associated with the plurality of scroll lines and then rearranges a part of the symbols in the display area to show a result of the game. The controller is programmed to execute the following processing of (3-1-1) to (3-1-4).

The processing of (3-1-1) is to determine symbols to be rearranged in the display area at random. The symbols to be rearranged are symbols to be finally rearranged in the display area and represent the game result. In this embodiment, the symbols representing a game result correspond to the symbols to be stopped. The symbols temporarily rearranged in the display area correspond to symbols to be stopped temporarily.

The processing of (3-1-2) is scrolling symbols of a first scroll line and stopping symbols of remaining second scroll lines in such a manner that a winning symbol combination for winning the award is partially completed on a first payline. That is to say, the processing of (3-1-2) is that, in a state where scroll lines being scrolled and stopped scroll lines are mixed together, the controller aligns a part of the symbols of a winning combination along a payline with the symbols of the stopped scroll lines.

It is preferable that the state where scroll lines being scrolled and stopped scroll lines are mixed together is a state where only one scroll line is being scrolled. Furthermore, the controller preferably changes the scrolling motion of symbols of a first scroll line under a condition where a winning combination of symbols for winning an award is partially completed along a payline when the symbols of only one scroll line are being scrolled and the symbols of the remaining scroll lines are stopped. As mentioned above, this state that a winning symbol combination for winning an award is partially completed along a payline when the symbols of only one scroll line are being scrolled and the symbols of the remaining scroll lines are stopped is referred to as so-called "li-zhi" state.

As described above, the "li-zhi" state in this description is a state just before fixing a win in which a winning combination is partially completed by rearranging the symbols in a unit game and is waiting for the final settlement. If the entire winning combination is finally completed after the "li-zhi" state, a win is fixed. If the entire winning combination is not completed (only a part of the winning combination is ready), the win is not fixed. The "li-zhi" has the same meaning as "tenpai".

The processing of (3-1-3) is to scroll the symbols of the second scroll lines again and then stop the scrolling of the symbols in such a manner that winning symbol combinations are partially completed on a plurality of second paylines differing from the first payline.

As described above, the processing of (3-1-2) is preferably to make a li-zhi state. This li-zhi state achieved by this processing of (3-1-2) is preferably made by one of the paylines. Specifically, two RED7 symbols are aligned on a first payline to make the first payline a li-zhi line. In this description, the li-zhi line means a payline satisfying the requirement for a li-zhi state.

In addition, the processing of (3-1-3) is preferably to make a li-zhi state with two of the paylines. Specifically, two RED7 symbols are aligned on a second payline different from the first payline and two BLUE7 symbols are aligned on a third payline different from the first and the second paylines to make the second and the third paylines li-zhi lines.

In this way, the processing of (3-1-2) and (3-1-3) increases the li-zhi line to raise the possibility of winning, enhancing the player's expectation.

The processing of (3-1-4) is to rearrange the symbols to be rearranged in the display area after the processing of (3-1-3). This processing can inform the player of the symbols representing the game result.

In the gaming machine according to this embodiment, the processing of (3-1-4) includes the following processing of (4-1-4):

(4-1-4) changing at least one of direction of scrolling, speed of scrolling, time of scrolling, and time to stop scrolling of the symbols of the first scroll line after performing the processing of (3-1-3).

The processing of (4-1-4) is to determine the motion after the change based on the symbols to be rearranged determined by the processing of (3-1-1). The player can predict symbols to be rearranged to some extent and feel expectation by seeing the different motion. The motion after the change do not need to be determined exactly based on the symbols to be rearranged but can be roughly oriented, for example, through a weighted lottery.

The gaming machine according to this embodiment further includes a light source for illuminating the plurality of scroll lines and the controller is programmed to further execute the following processing of (5-1-1) and (5-1-2):

(5-1-1) determining color of light emitted from the light source based on an expectation level; and (5-1-2) illuminating the first scroll line with light determined by the processing of (5-1-1) after performing the processing of (3-1-3).

It is preferable that expectation levels be predetermined and stored based on the symbols to be rearranged. Then, the processing of (5-1-1) can determine the expectation level based on the symbols to be rearranged determined by the processing of (3-1-1).

It is preferable that the light source can separately illuminate the scroll lines. Then, the light source can accurately illuminate the first scroll line.

The above-described processing provides an example of informing the player of the expectation level by the color of light illuminating the first scroll line, but a different way may be employed to inform the player of the expectation level.

For example, the processing of (4-1-4) changes at least one of the direction of scrolling, the speed of scrolling, the time of scrolling, and the time to stop the scrolling of the symbols of the first scroll line. These motions of scrolling can inform the player of the expectation level. For example, the action of scrolling symbols at a high speed for a predetermined time, slowing down the scrolling, and then stopping the scrolling can be an action of a higher expectation level than the action of scrolling symbols at a low speed for a predetermined time and then stopping the scrolling. In addition, the action of scrolling symbols in a reverse direction by a predetermined number of symbols frames, scrolling the symbols at a predetermined speed for a predetermined time, and then stopping the scrolling can be an action of a still higher expectation level than the action of scrolling symbols at a high speed for a predetermined time, slowing down the scrolling, and then stopping the scrolling.

Furthermore, the player may be informed of the expectation level by the order of stopping the symbols associated with the individual scroll lines or the number of symbols to be stopped. For example, the action of stopping the symbols associated with the second scroll line among the plurality of scroll lines can be an action of a higher expectation level than the action of stopping the symbols associated with the first scroll line among of the plurality of scroll lines. In addition, the action of stopping the symbols associated with the third scroll line among the plurality of scroll lines can be an action of a still higher expectation level than the action of stopping the symbols associated with the second scroll line among the plurality of scroll lines. Still further, the action of simultaneously stopping the symbols associated with the first and the third scroll lines among the plurality of scroll lines can be an action of a higher expectation level than the action of stopping the symbols associated with the third scroll line among the plurality of scroll lines.

In the gaming machine according to this embodiment of the present invention, the plurality of scroll lines are made of three mechanical reels with symbols attached and the three mechanical reels are disposed side by side, the controller is programmed to rotate the mechanical reels to scroll the symbols attached to the mechanical reels, the processing of (3-1-2) is the following processing of (6-1-2):

(6-1-2) rotating one mechanical reel disposed at the middle of the three mechanical reels and stopping the remaining two mechanical reels disposed at both sides in such a manner that a winning symbol combination is partially completed on a first payline on a temporary basis, and the processing of (3-1-3) is the following processing of (6-1-3):

(6-1-3) rotating the remaining two mechanical reels again and then stopping the two mechanical reels in such a manner that winning symbol combinations are partially completed on a plurality of second paylines differing from the first payline in the display area, and the processing of (3-1-4) is the following processing of (6-1-4):

(6-1-4) stopping all the three mechanical reels by stopping the one mechanical reel disposed at the middle to rearrange the symbols to be rearranged in the display area.

It is preferable that the three mechanical reels disposed side by side be composed of a left reel, a center reel, and a right reel. It is preferable that the processing of (6-1-2) be to rotate the center reel and stop the left reel and the right reel for a moment to make one li-zhi line. The processing of (6-1-3) is to rotate the left reel and the right reel stopped for a moment again before stopping them to make two li-zhi lines. It is preferable that the processing of (6-1-4) be to stop all of the three left, center, and right reels to rearrange the symbols to be rearranged in the display area.

In the gaming machine according to this embodiment, the controller is programmed to further execute the processing of the following (7-1-1):

(7-1-1) giving both of a progressive award for a first winning symbol combination and a progressive award for a second winning symbol combination to the player under a condition where the first winning symbol combination is completed on one of the plurality of second paylines and the second winning symbol combination different from the first winning symbol combination is completed on another payline of the plurality of second paylines when the symbols to be rearranged are rearranged in the display area.

The processing of (7-1-1) is, if a first winning combination is completed on a payline and a second winning combination is completed on another payline, to give both of a progressive award for the first winning combination and a progressive award for the second winning combination in total to the player. The possibility of receiving double progressive awards raises the player's expectation.

It is preferable that the progressive mode can be switched ON and OFF with an external control device connected to the gaming machine.

When the progressive mode is switched ON with the external control device, both of the progressive awards for the first and second winning combinations are enabled. Hence, if the first winning combination is completed on a payline and the second winning combination is completed on another payline, the player can receive both of the progressive awards for the first winning combination and the second winning combination in total.

When the progressive mode is switched OFF, both of the progressive awards for the first winning combination and the second winning combination are disabled.

It is preferable that the award for the first winning combination be different from the award for the second winning combination. This approach differentiates the game results of individual single wins, increasing the amusement of the game.

A gaming machine according to an embodiment of the present invention includes:

reels each including a reel strip including at least one symbol part each representing a symbol;

the symbol part includes a 3D part formed along an outline for characterizing the symbol; and the 3D part has a thickness thinner than the reel strip.

The gaming machine includes reels with reel strips attached thereto. A reel strip includes at least one symbol part. The symbol part represents the symbol to be visually recognized by the player.

This symbol part includes a 3D part formed along the outline for characterizing the symbol. The outline is a line defining the symbol geometrically or artistically and includes at least one line. The symbol part can be formed three-dimensionally by creating bulges along the outline.

The 3D part is formed thinner than the reel strip. The 3D part thinner than the reel strip can save the quantity of the material of the symbol part to form it three-dimensionally at lower weight. In other words, the 3D part thinner than the reel strip enables the symbol part to be formed three-dimensionally without increasing the quantity of the material. Accordingly, if the symbol part is formed to be attached to the reel strip, the mass distribution of the reel can be almost uniform all over the reel, which enables smooth rotation of the reel with less fluctuation.

For example, the shape of the 3D part can be determined so that the 3D part has substantially the same volume. Specifically, the shape of the 3D part can be determined so that the product of the surface area of the 3D part by the thickness thereof will be substantially uniform. If some part of the 3D part is bulged higher, the part should be formed thinner depending on the height. Such shaping keeps the volume of the 3D part uniform, preventing increase in the mass of the 3D part and achieving lower weight even if the 3D part is bulged higher.

In the gaming machine according to this embodiment, the at least one symbol part includes a plurality of symbol parts and the plurality of symbol parts are disposed on the reel strip asymmetrically with respect to the rotational axis of the reel.

If a 3D part is formed by stacking a plurality of sheets or combining various members, the mass of the 3D part is larger. If such 3D parts are attached to a reel strip asymmetrically about the rotational axis of the reel, the mass distribution in the circumferential direction of the reel will be non-uniform because of the mass of the 3D parts. When such a reel is rotated, the reel is easily decentered to cause a runout, so that the whole reel wobbles. The player might not be able to recognize the symbols well and feel uncomfortable with playing game.

However, in the gaming machine according to this embodiment of the present invention, the 3D part is formed thinner than the reel strip and the mass distribution over the reel can be made almost uniform. Accordingly, even though 3D parts are provided on the reel strip asymmetrically about the rotational axis, the rotated reel is hardly decentered and hardly causes a runout; the reel spins smoothly so that the player can easily recognize the symbols.

In the gaming machine according to this embodiment of the present invention, the 3D part is formed by pressing a sheet member against a mold formed to have a shape corresponding to the 3D part.

The 3D part can be formed by pressing a sheet member against a mold and tightly contacting the sheet member with the mold to transfer the shape of the mold to the sheet member. Such a way of forming can form the 3D part to have an almost uniform thickness. In other words, the bulged part on the front face of the 3D part and the recessed on the back face corresponding to the bulged part can be formed by pressing the sheet member against the mold. The bulged part on the front face and corresponding recessed part on the back face can be formed simultaneously by using the mold, the 3D part can be formed to have an almost uniform thickness and a lower weight.

As a result, the 3D part can have a lower weight than in the case of forming the 3D part by stacking a plurality of sheets or combining components. Accordingly, even though 3D parts are provided on a reel strip asymmetrically about the rotational axis, the rotated reel is hardly decentered and hardly causes a runout, so that the reel can spin smoothly.

In the gaming machine according to this embodiment of the present invention, the symbol part is formed separately from the reel strip, the reel strip has a symbol placing part formed around an opening, and the 3D part is fitted through the opening in the direction from the back face of the reel strip to the front face to attach the symbol part to the reel strip via the opening.

Since the symbol part can be formed separately from the reel strip and fitted in the opening to be attached to the reel strip, easy and simple assembling can be achieved.

In the gaming machine according to this embodiment of the present invention, the 3D part has a bulged shape bent along the outline and projecting from the reel strip and has a substantially the same thickness.

Since the 3D part is bent along the outline and projecting from the reel strip, the symbol can stand out to be recognized easily.

<<<Embodiment of Gaming Machine>>>

Hereinafter, the present embodiment describes a slot machine 10 taken as an example of a gaming machine according to an embodiment of the present invention.

<<Game System>>

Figure 2:
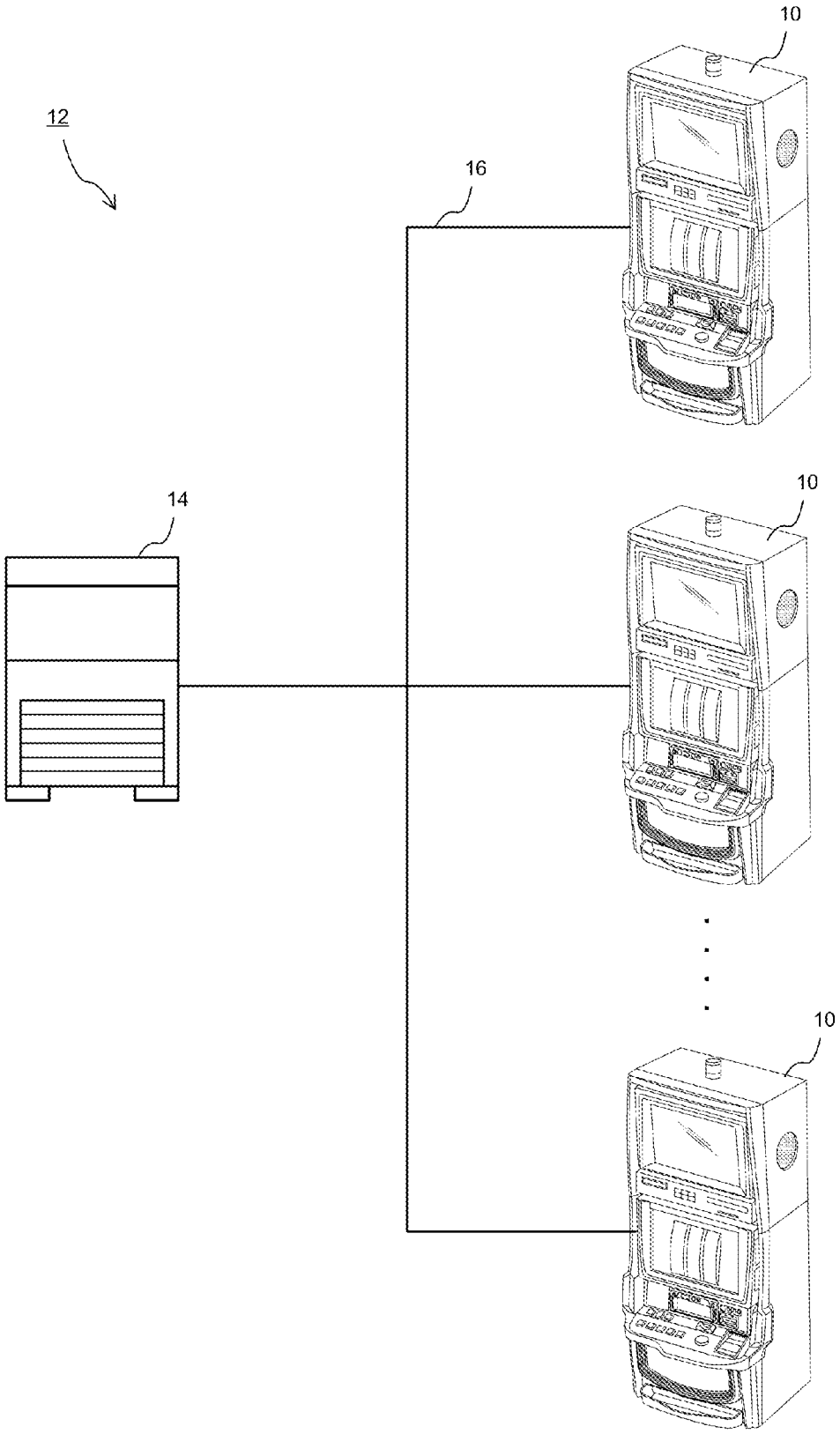
FIG. 2 is a diagram illustrating a game system including a slot machine 10 according to an embodiment of the present invention.

FIG. 2 is a diagram illustrating a game system including a slot machine 10.

The game system 12 includes a plurality of slot machines 10 and an external control apparatus 14 connected with the slot machines 10 via a communication line 16.

The external control apparatus 14 controls the slot machines 10. In this embodiment, the external control apparatus 14 is a so-called hall server installed in an amusement facility having the slot machines 10. Each slot machine 10 has a unique identification number; the external control apparatus 14 identifies the source of data sent from a slot machine 10 by the identification number. In sending data to a slot machine 10, the external control apparatus 14 specifies the destination with the identification number.

The game system 12 may be constructed in a single amusement facility providing various games, such as a casino, or may be constructed among a plurality of amusement facilities. In the case of a single amusement facility, the game system 12 may be constructed on each floor or in each section. The communication line 16 may be either wired or wireless, and either a private line or a switched line.

<Link Progressive>

The game system 12 offers a common game called Link Progressive participated by a plurality of slot machines 10. Link progressive is a function in the common game to pay out a jackpot, which is an accumulation of parts of coins used by players in the slot machines 10. The game system 12 may pay out a jackpot to the player of the slot machine 10 that have satisfied a requirement to offer a Link Progressive. For example, the Link Progressive is offered as follows.

The game system 12 offers a Link Progressive when a combination of symbols for a jackpot trigger appears in one of the slot machines 10.

The game system 12 also offers a Link Progressive as a mystery bonus when a player wins in a special lottery. Specifically, in response to a start switch operation, the game system 12 selects a random number for mystery bonus to determine whether to offer the mystery bonus through the lottery.

Each slot machine 10 calculates an amount to be pooled to the jackpot (accumulation) in each unit game and sends it to the external control apparatus 14. The external control apparatus 14 pools the amounts to be accumulated sent from the slot machines 10 in the jackpot. The game system 12 offers a Link Progressive when RED7 symbols or BLUE7 symbols are aligned on a payline. The game system 12 may also offer a Link Progressive when an average of the accumulations of the slot machines 10 reaches a predetermined amount. The game system 12 may also offer a Link Progressive when the total amount of the accumulations of all the slot machines 10 reaches a predetermined amount.

In a Link Progressive, the game system 12 allows each slot machine 10 to select a symbol or to play roulette after placing a bet on the roulette common to the slot machines 10 so as to determine the points to be given to slot machines 10 depending on the result. Then, the game system 12 determines awards corresponding to the points acquired by the slot machines 10 and distributes the jackpot to the slot machines 10.

The ON or OFF of the progressive mode can be selected by the external control apparatus 14. The selection may be made by an operation of a staff of an amusement facility such as a casino.

This embodiment provides two kinds of progressive awards: one is for three RED7 symbols and the other is for three BLUE7 symbols. When the progressive mode is ON, the progressive awarding for both of the three RED7 symbols and the three BLUE7 symbols are enabled. This configuration allows collective payout of the progressive awards for both of three RED7 symbols and three BLUE7 symbols if three RED7 symbols are aligned on a payline and three BLUE7 symbols are aligned on another payline.

When the progressive mode is OFF, both of the progressive awarding for three RED7 symbols and the progressive awarding for three BLUE7 symbols are disabled together.

<<Configuration of Slot Machine 10>>

Figure 3:
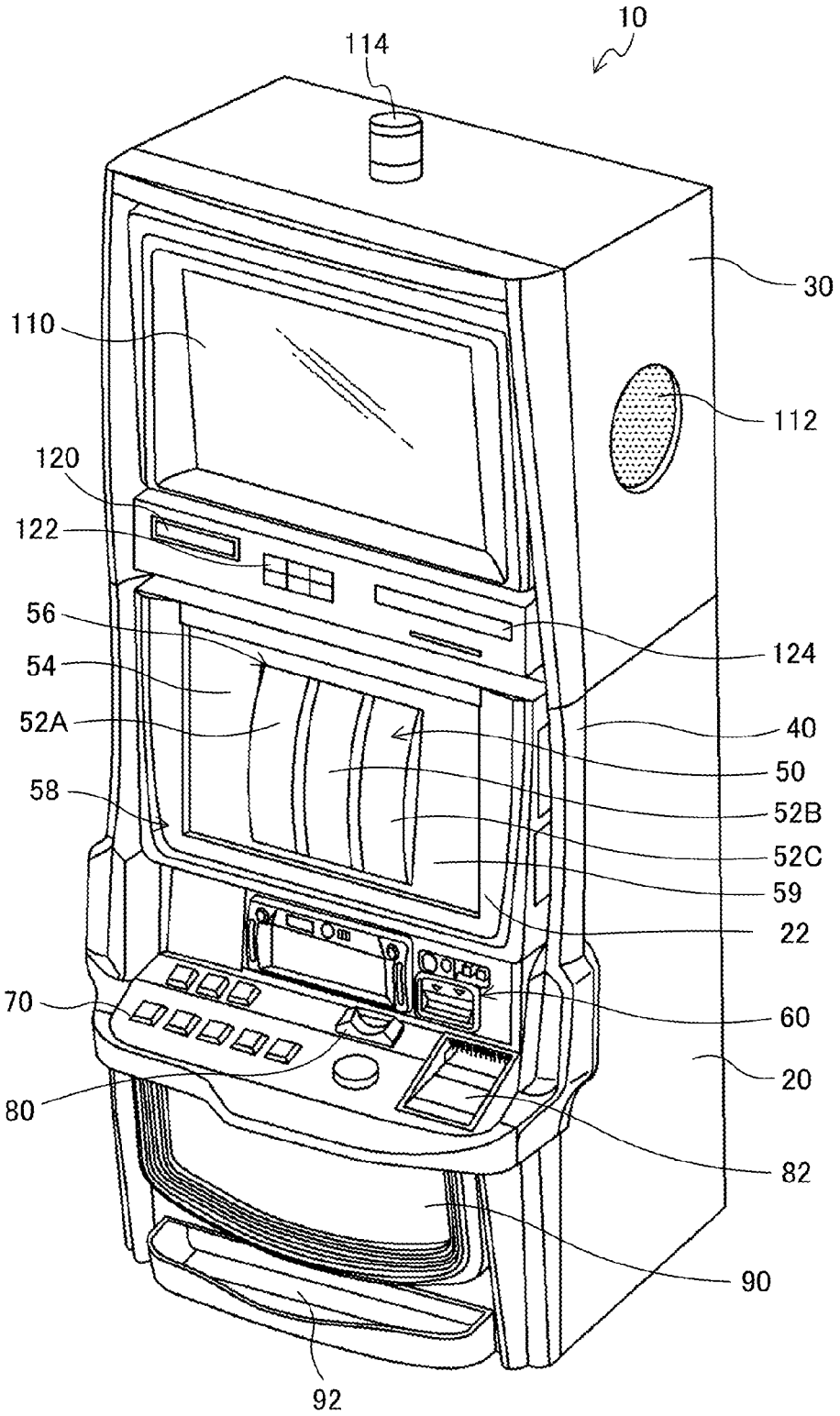
FIG. 3 is a diagram illustrating an overall configuration of a slot machine 10 according to an embodiment of the present invention.

FIG. 3 illustrates an overall configuration of a slot machine 10 according to the present embodiment.

The slot machine 10 accepts coins, bills, and electronic information equivalent to these as means of gaming. The slot machine 10 also accepts credits stored in barcode tickets or IC cards as means of gaming. The slot machine 10 is not limited to the foregoing means of gaming, but accepts other kinds of means.

The slot machine 10 shown in FIG. 3 includes a cabinet 20, a top box 30 placed on the cabinet 20, and a main door 22 mounted on the front of the cabinet 20.

A symbol display unit 40 including a reel assembly 50 is provided on the main door 22. In this embodiment, the reel assembly 50 includes three reels 52A to 52C. Each of the reels 52A to 52C has a drum with a plurality kinds of symbols disposed on its outer circumferential surface. The symbol display unit 40 is attached to the front of the reel assembly 50 and includes a reel cover 54 having a display window 56. The reel cover 54 is provided outside so that the player can see a part of the reels 52A to 52C. The reel cover 54 is provided on a display panel 58. The reel cover 54 is preferably made of a transparent liquid crystal panel. The symbol display unit 40 includes a touch panel 59 to detect the player's touch input.

When the reels 52A to 52C are still, three of the symbols on each of the reels 52A to 52C can be seen in the display window 56. This way, a symbol matrix of three rows and three columns is formed in the display window. One or more lines are prepared as paylines for determining whether to win. Each time a unit game is performed, the reels 52A to 52C with symbols spin at a predetermined speed and then stop to rearrange the symbols, showing a part of the symbols in the display window 56. The rearranged symbols in the display window 56 determine the result of the unit game. A benefit corresponding to the result of the unit game is given to the player. For example, if the rearranged symbols provide some winning combination along one of the paylines, a predetermined amount of payout is given to the player. The rearranged symbols may determine the game mode of the subsequent unit game. As to the game mode, there are a normal mode and a chance mode, which will be described later in detail.

In this description, a unit game is defined as a game in a period from starting crediting to start the game until closing the game, such as paying out depending on the game result after the symbol sequences are stopped to rearrange the symbols in the display window 56. In the case of a free game, the time when a credit operation is performed inside the slot machine 10 can be defined as the start of the game since the player does not need to perform a bet operation. In the case other than a free game, the time the player performs a bet operation can be defined as the start of the game. The processing in accordance with a game result determined by the rearranged symbols can be defined as closing the game. For example, in the case of a win, the time of execution of paying out may be defined as the end of the game.

The display panel 58 shows an amount of bet and an amount of credit in a specific area. The amount of credit indicates the number of the player's coins deposited in the slot machine 10. The amount of payout indicates the number of coins to be given to the player when a winning combination is complete.

In this embodiment, the slot machine 10 employs mechanical reels 52A to 52C. Instead of the mechanical reels, video reels or a combination of mechanical reels and video reels can be used.

Below the symbol display unit 40, an IC card reader 60 is provided. The IC card reader 60 accepts an IC card. The IC card stores identification information on the player or specific data such as game log data of the games previously played by the player. The IC card is able to store data equivalent to coins, bills, or credit owned by the player. The IC card reader 60 reads and writes an IC card inserted therein. Preferably, the IC card reader 60 has a liquid crystal display for showing the data read from the IC card.

Figure 4:
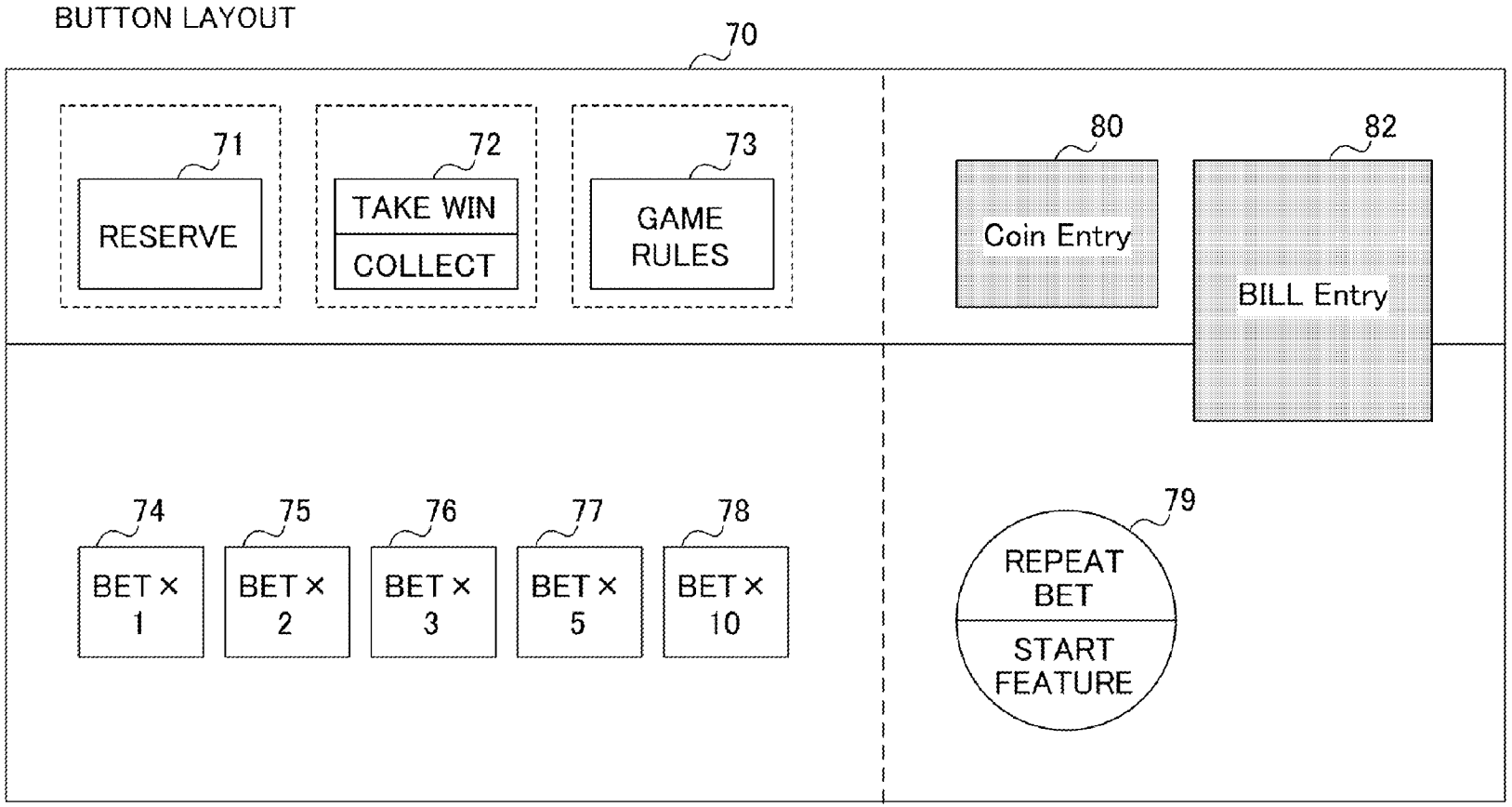
FIG. 4 is a schematic diagram illustrating a button layout of a control panel of the slot machine 10 shown in FIG. 3.

In front of the lower end of the IC card reader 60, a control panel 70 is provided. On the control panel 70, a set of buttons, a coin entry 80, and a bill entry 82 are provided. As shown in FIG. 4, a RESERVE button 71, a COLLECT button 72, and a GAME RULES button 73 are provided on the upper left of the control panel 70. FIG. 4 is a schematic diagram illustrating a button layout of the control panel 70 of the slot machine 10 shown in FIG. 3.

On the lower left of the control panel 70, a 1-BET button 74, a 2-BET button 75, a 3-BET button 76, a 5-BET button 77, and a 10-BET button 78 are provided. Further, a START button 79 is provided on the lower middle of the control panel 70. The coin entry 80 is provided on the upper middle of the control panel; the bill entry 82 is provided on the right of the control panel 70.

The RESERVE button 71 is used when the player leaves the machine for a minute or wants to ask a staff of the amusement facility for exchange. The RESERVE button 71 is also used to store the remaining credit to the IC card inserted in the IC card reader 60. The COLLECT button 72 is used to instruct the slot machine 10 to pay out the credited coins to a coin tray 92. If the player is unfamiliar with the rules of the game or the operation of the machine, the GAME RULES button 73 is used. In response to a press of the GAME RULES button 73, a variety of help information comes up on the video display unit 110.

The BET buttons 74 to 78 are used to set the amount of bet. Each time the player presses the 1-BET button 74, one credit is bet on each active payline from the player's current credit. If the player presses the 2-BET button 75, two credits are bet on each active payline to start a unit game. If the player presses the 3-BET button 76, three credits are bet on each active payline to start a unit game. If the player presses the 5-BET button 77, five credits are bet on each active payline to start a unit game. If the player presses the 10-BET button 78, ten credits are bet on each active payline to start a unit game. The START button 79 is used to instruct the reels 52A to 52C to start spinning under the bet condition determined before.

When the coin entry 80 receives coins, the coins are guided to a hopper in the cabinet 20. When the bill entry 80 receives a bill, it determines whether the inserted bill is genuine and accepts only genuine bills into the cabinet 20.

On the lower front of the main door 22 and below the control panel 70, a bottom glass 90 and a coin tray 92 are provided. On the bottom glass 90, an illustration of a character of the slot machine may be printed. The coin tray 92 receives paid-out coins from the cabinet 20.

As shown in FIG. 3, the video display unit 110 including a liquid crystal panel is provided on the front of the top box 30. The video display unit 110 produces video performances to increase the fun of the game. The video display unit 110 also shows information such as rules of the game and operation instructions. Speakers 112 and a lamp 114 are respectively provided on the sides and the top of the top box 30. The slot machine 10 increases the fun of the game by sound performances and lighting performances by the speakers 112 and the lamp 114.

On the lower part of the video display unit 110, a ticket printer 120, a keypad 122, and a data display 124 are provided.

The ticket printer 120 prints a barcode including credit data, a date, a time, and an ID number of the slot machine 10 on a ticket and eject the ticket as a barcode ticket. The player can exchange the barcode ticket to money or other thing at a predetermined place in the amusement facility (for example, a cashier in a casino).

The keypad 122 has a plurality of keys. The player manipulates the keys to enter instructions about issuance of a barcode ticket. The data display 124 having a vacuum fluorescent display or an LED shows data entered by the player through the keypad 122.

<<<Electric Configuration of Slot Machine>>>

Figure 5:
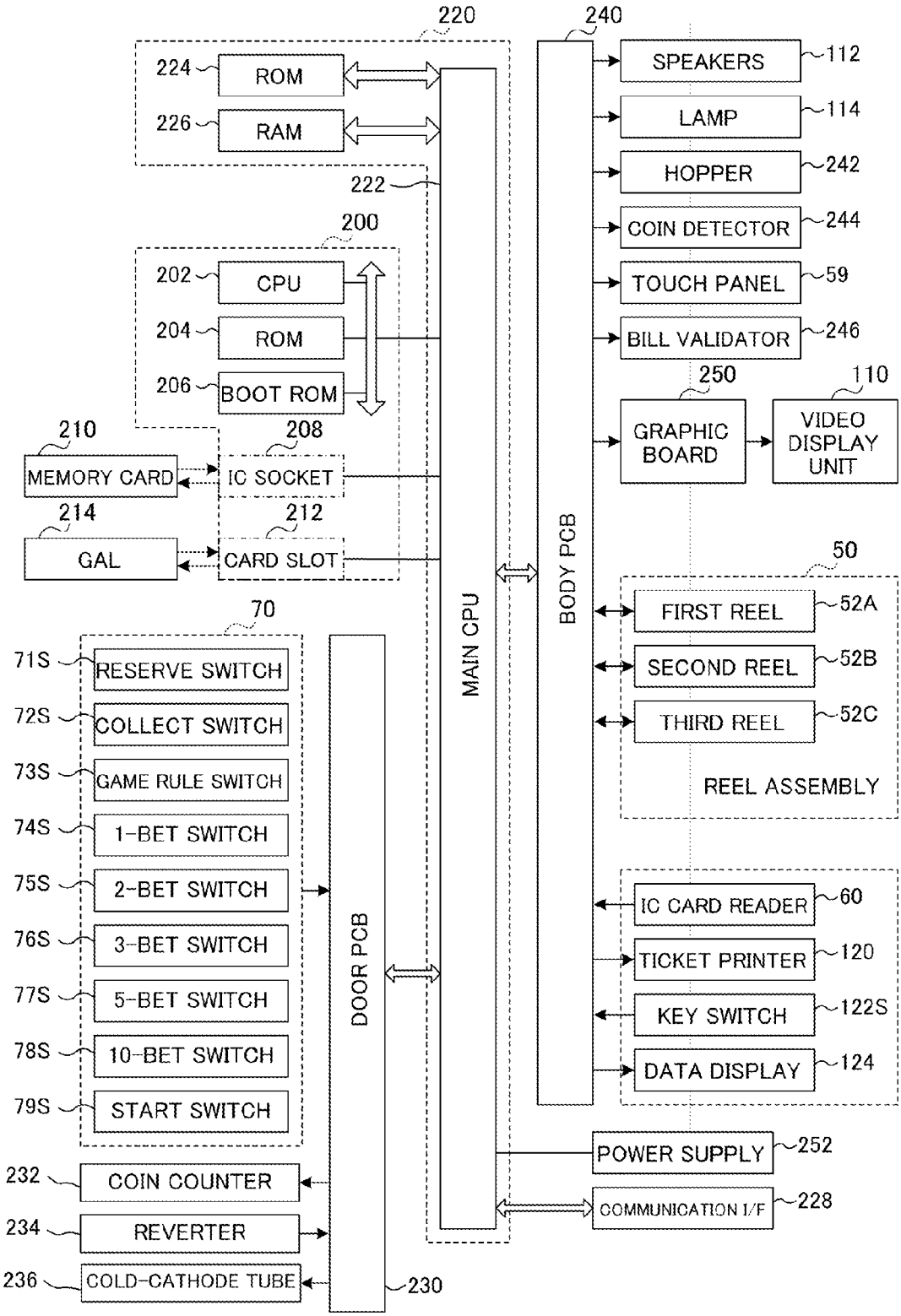
FIG. 5 is an electric block diagram of the slot machine 10 shown in FIG. 3.

FIG. 5 is an electric block diagram of the slot machine 10 shown in FIG. 3. The slot machine 10 includes a game board 200, a mother board 220, a door PCB 230, and a body PCB 240.

The game board 200 includes a CPU 202, a ROM 204 accessible from the CPU 202 via an internal bus, and a boot ROM 206 accessible from the CPU 202 via an internal bus. The game board 200 further includes an IC socket 208 to accommodate and communicate with a memory card 210, and a card slot 212 provided for generic array logic (GAL) 214.

The memory card 210 includes a non-volatile memory and holds a game program and a game system program.

The IC socket 208 is structured so that a memory card 210 is removable. The IC socket 208 is connected to the mother board 220 via an IDE bus. The game executed in the slot machine 10 can be changed by replacing the memory card 210 with another card. The game executed in the slot machine 10 can also be changed by removing the memory card 210 from the IC socket 208, rewriting a different program to the memory card 210, and inserting the memory card 210 again to the IC socket 208.

The GAL 214 is a kind of programmable logic device (PLD) having a fixed OR array structure and has multiple input ports and output ports. When the GAL 214 receives specific data via an input port, it outputs data corresponding to the input data via an output port.

The card slot 212 is structured so that the GAL 214 can be inserted in or removed from the card slot 212, and is connected to the mother board 220 via a PCI bus.

The CPU 202, the ROM 204, and the boot ROM 206 interconnected via an internal bus are connected to the mother board 220 via the PCI bus. The PCI bus enables signal transmission between the mother board 220 and the game board 200 and supply of power from the mother board 220 to the game board 200.

The ROM 204 stores programs. The boot ROM 206 stores a preliminary authentication program and a boot code to be used by the CPU 202 to start the preliminary authentication program. The authentication program is a tamper check program for verifying whether the game program and the game system program are authentic. The preliminary authentication program is a program for verifying whether the authentication program is authentic. The authentication program and the preliminary authentication program are written so as to perform verification that the target program is not tampered.

The mother board 220 is a commonly available main board to execute a game program and a game system program. The mother board 220 includes a main CPU 222, a ROM 224, a RAM 226, and a communication interface 228.

The ROM 224 is a memory device to store programs to be executed by the main CPU 222. The ROM 224, for example BIOS, non-transitorily stores programs with other data. The ROM 224 can be a flash memory. When the BIOS program is executed by the main CPU 222, it initializes the peripheral devices. The BIOS program loads a game program and a game system program held in the memory card 210 via the game board 200. The ROM 224 may be rewritable. Alternatively, the ROM 224 may be write-protected.

The RAM 226 stores data and programs to be used during the operation of the main CPU 222. For example, to load a game program, a game system program, or an authentication program, the RAM 226 can store the program. The RAM 226 has working space to execute such a program. Specifically, the working space stores the number of bets, the amount of payout, and the amount of credit and holds them during execution of the game. The RAM 226 also holds tables for defining symbols, symbol codes, winning combinations, and their probabilities during the game. Furthermore, the RAM 226 stores a symbol code determination table. The symbol code determination table holds mapping information between symbols codes and random numbers to be used to determine a symbol based on a random number. In particular, the RAM 226 holds a mode flag together with a game counter. The mode flag indicates the game mode. The game counter indicates a count value representing the number of unit games executed in a chance mode or the number of unit games remaining in the chance mode.

The RAM 226 stores count values of a plurality of counters. The plurality of counters are a bet counter, a payout amount counter, a credit amount counter, and a chance mode game counter for counting the unit games in a chance mode. Some of the count values may be held in the internal register of the main CPU 222.

The main CPU 222 communicates with an external controller via the communication interface 228. For example, the external controller may be a server (not-shown) connected via a communication channel.

The mother board 220 is connected with the door PCB 230 and the body PCB 240. The mother board 220 can communicate with the door PCB 230 and the body PCB 240 using USB. The mother board 220 is also connected to a power supply 252. The main CPU 222 of the mother board 220 activates and operates using the power supplied from the power supply 252. The mother board 220 supplies a part of the power to the game board 200 via the PCI bus to activate the CPU 202. The door PCB 230 and the body PCB 240 are connected with input devices. Examples of the input devices are switches, sensors, and peripheral devices whose operation is controlled by the main CPU 222. The door PCB 230 is connected with a control panel 70, a coin counter 232, a reverter 234, and a cold-cathode tube 236.

The control panel 70 includes a reserve switch 71S, a collect switch 72S, a game rule switch 73S, a 1-BET switch 74S, a 2-BET switch 75S, a 3-BET switch 76S, a 5-BET switch 77S, a 10-BET switch 78S, and a start switch 79S, which are respectively associated with the buttons 71 to 79. The switches 71S to 79S detect that the buttons 71 to 79 are pressed by the player and output signals to the main CPU 222.

The coin counter 232 and the reverter 234 are installed in the coin entry 80. The coin counter 232 determines whether the coin put in the coin entry 80 is genuine from the characteristics of the coin, such as the material and the shape of the coin. If it detects a genuine coin, the coin counter outputs a signal. A coin determined to be fake is ejected to the coin tray 92. The reverter 234 operates in accordance with a control signal from the main CPU 222. The reverter 234 supplies the coin determined to be genuine by the coin counter 232 to the hopper 242 or a cache box (not shown). If the hopper 242 is not filled with coins, the coin is guided to the hopper 242. Contrarily, if the hopper 242 is filled with coins, the coin is guided to the cache box.

The cold-cathode tube 236 is installed behind the video display unit 110. The cold-cathode tube 236 functions as a backlight and illuminates in accordance with a control signal from the main CPU 222.

The body PCB 240 is connected with the speakers 112, the lamp 114, the hopper 242, the coin detector 244, the touch panel 59, the bill validator 246, the reel assembly 50, the IC card reader 60, the graphic board 250, the ticket printer 120, the key switch 122S, and the data display 124.

The lamp 114 comes on and off in accordance with a control signal from the main CPU 222. The speakers 112 output sound such as BGM in accordance with a control signal from the main CPU 222.

The hopper 242 operates in accordance with a control signal from the main CPU 222 to pay out the specified amount of payout to the coin tray 92 via a coin payout exit (not shown) provided between the bottom glass 90 and the coin tray 92. The coin detector 244 detects coins paid out from the hopper 242 to output a detection signal to the main CPU 222.

The touch panel 59 detects a position touched by the player and supplies a positional detection signal corresponding to the detected point to the main CPU 222. The bill validator 246 provided at the bill entry 82 supplies a bill detection signal corresponding to the amount of bill to the main CPU 222 upon detection of a genuine bill.

The graphic board 250 controls the video display unit 110 and the display panel 58 of the symbol display unit 40 in accordance with control signals from the main CPU 222. The graphic board 250 includes a video display processor (VDP) for creating video data and a video RAM for transitorily storing video data. The video data is created based on a game program stored in the RAM 226.

The IC card reader 60 retrieves data held in an IC card inserted in the IC socket 208 and supplies the retrieved data to the main CPU 222. The IC card reader 60 also writes data supplied to the main CPU 222 to the ID card.

The ticket printer 120 prints a barcode including information such as the amount of credit stored in the RAM 226, time and date, and the identification number of the slot machine 10 on a ticket in accordance with a control signal from the main CPU 222 to output a barcode ticket.

The key switch 122S is provided under the keypad 122 and outputs a key detection signal to the main CPU 222 when the keypad 122 is pressed by the player.

The data display 124 shows information related to information entered via the keypad 122 in accordance with a control signal from the main CPU 222.

<<Electric Circuit of Reel Assembly>>

Figure 6:
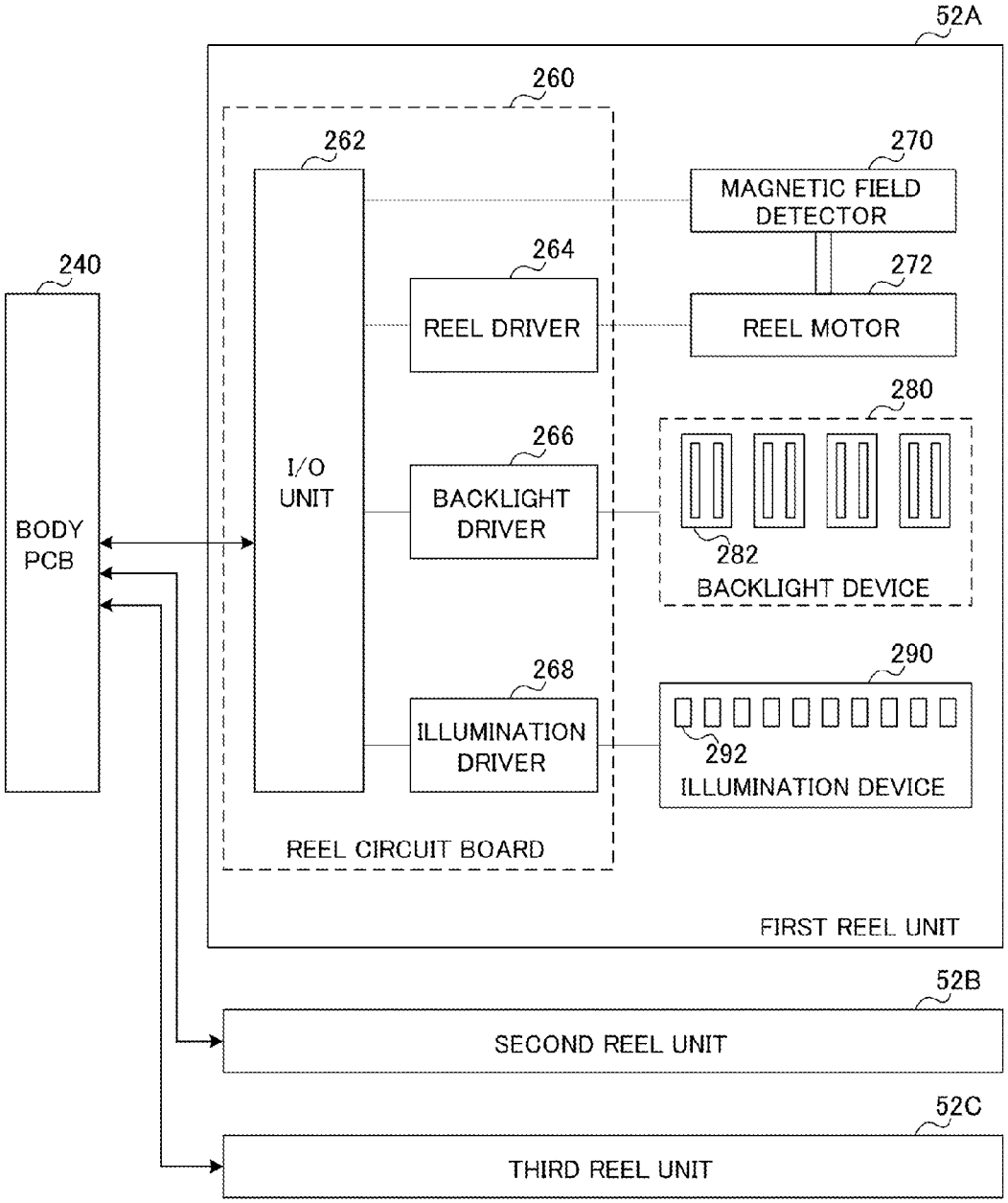
FIG. 6 is a block diagram illustrating an electric circuit of a reel assembly.

FIG. 6 is a block diagram illustrating electric circuitry of the reel assembly.

As shown in FIG. 6, the body PCB 240 is electrically connected to the reel assembly 50. As mentioned above, the reel assembly 50 includes the first to the third reels 52A to 52C. Each of the reels 52A to 52C is provided on a reel circuit board 260. The reel circuit board 260 includes an input/output (I/O) unit 262 which is communicable with the body PCB 240. The reel circuit board 260 also includes a reel driver 264, a backlight driver 266, and an illumination driver 268 which are connected with the I/O unit 262.

The I/O unit 262 is connected with a magnetic field detector 270. The magnetic field detector 270 includes a magnetic sensor for sensing the intensity of magnetic field and outputting a magnetism detection signal proportional to the intensity of the magnetic field and a sensor fixer for fixing the magnetic sensor to a predetermined position. The magnetic sensor senses the intensity of magnetic field generated by a magnet. The magnet is attached to a rotary shaft of a reel motor 272 and rotates with the reel 52A.

The reel driver 264 supplies electric power to a reel motor 272. The backlight driver 266 supplies electric power to lights 282 of a backlight device 280 separately. The illumination driver 268 supplies electric power to lights 292 of an illumination device 290 separately.

The second and the third reels 52B and 52C have the same configuration as the first reel 52A; the detailed explanation thereof is omitted.

<<Processing of Game Program>>

Figure 7:
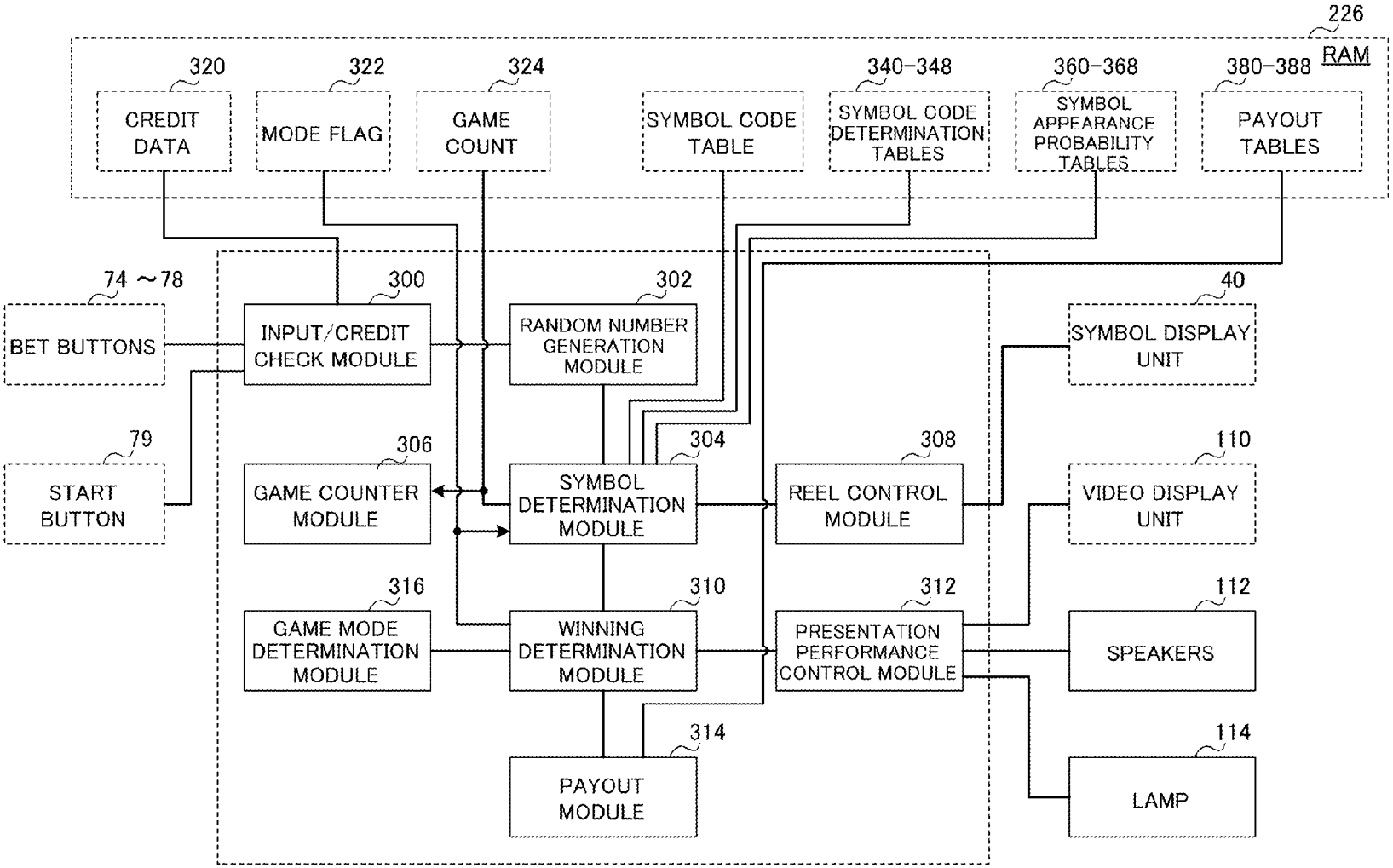
FIG. 7 is a block diagram illustrating processing of a game program executed by the main CPU on the mother board.

FIG. 7 is a block diagram illustrating processing of a game program executed by the main CPU 222 of the mother board 220. When the power is supplied to the slot machine 10, the main CPU 222 retrieves the authenticated game program and game system program from the memory card 210 via the game board 200 and writes them to the RAM 226. The game program is executed in such a loaded state in the RAM 226.

In a preferred embodiment, the game program is executed by an input/credit check module 300, a random number generation module 302, a symbol determination module 304, a game counter module 306, a reel control module 308, a winning determination module 310, a presentation performance control module 312, a payout module 314, and a game mode determination module 316.

It should be noted that, the input/credit check module 300 may be an independent input/credit check device 300'; the random number generation module 302 may be an independent random number generation device 302'; the symbol determination module 304 may be an independent symbol determination device 304'; the game counter module 306 may be an independent game counter device 306'; the reel control module 308 may be an independent reel control device 308'; the winning determination module 310 may be an independent winning determination device 310'; the presentation performance control module 312 may be an independent presentation performance control device 312'; the payout module 314 may be an independent payout device 314'; and the game mode determination module 316 may be an independent game mode determination device 316'. In this way, these modules can be an aggregate of independent devices. Alternatively, some of these devices may be integrated into a device. In any case, it is sufficient as far as the processing modules may be software or hardware such as components, devices, or units that can execute the game program.

<Input/Credit Check Module 300>

The input/credit check module 300 continuously checks whether any of the BET buttons 74 to 78 or the START button 79 is pressed in an idle state where the reels 52A to 52C are still. Upon detection of pressing one of the BET buttons 74 to 78 or the START button 79, the input/credit check module 300 checks whether any credit remains for the player with reference to the credit data 320 held in the RAM 226. If the player has at least one credit, the input/credit check module 300 invokes the random number generation module 302.

The random number generation module 302 generates random numbers to be used by the symbol determination module 304. In this embodiment, the random number generation module 302 generates three random numbers. The three random numbers are used for the first to the third reels 52A to 52C.

After extracting all the three random numbers, the symbol determination module 304 determines symbols to be stopped for the reels 52A to 52C separately with reference to a symbol code determination table held in the RAM 226. The symbol determination module 304 determines three symbols to be stopped for the reels 52A to 52C and shows the symbols to be stopped for the reels 52A to 52C in the display window 56 of the symbol display unit 40. This determination of symbols to be stopped by the symbol determination module 304 determines stop position information for the reels 52A to 52C.

In particular, the symbol determination module 304 refers to the mode flag 322 held in the RAM 226 to find the current game mode. The processing of determining the symbols in the normal mode is different from the processing in the chance mode. In the normal mode, the symbol determination module 304 determines the symbols in accordance with a certain procedure using a single symbol code determination table and random numbers. In the chance mode, the symbol determination module 304 changes the processing of symbol determination for each unit game by successively changing the symbol code determination table. The successive change of symbol code determination table increases winning combinations including at least one specific symbol as the chance mode game continues. The number of chance mode games executable per chance mode is predetermined, for example, to be eight. To limit the number of chance mode games, the game counter module 306 counts the chance mode games executed in the present chance mode or the chance mode games remaining in the present chance mode. The value of the game count 324 is stored in the RAM 226. The game counter module 306 may belong to the symbol determination module 304.

The reel control module 308 controls the reel assembly 50 by supplying the stop position information for the determined symbols. Consequently, the spinning reels 52A to 52C stop at the positions specified by the stop position information. That is to say, the symbols are scrolled with the spin of the reels 52A to 52C. Then, the reel control module 308 stops the reels 52A to 52C so that the determined symbols will be rearranged at the vertically middle of the display window 56 of the symbol display unit 40.

When all the three reels 52A to 52C has stopped, the winning determination module 310 first identifies all the symbols (symbol codes) rearranged in the display window 56 with reference to a symbol code table (FIG. 8) with the symbols to be stopped determined by the symbol determination module 304. The winning determination module 310 determines whether the rearranged symbols make a specific winning combination. If the rearranged symbols make a winning combination, the presentation performance control module 312 controls the symbol display unit 40 and other devices, such as the speakers 112, the lamp 114, and the video display unit 110. The presentation performances include performances by video and audio and performances by backlight change and illumination. The payout module 314 determines the amount of payout depending on the completed winning combination and provides the amount of payout to the player.

Each time a unit game ends, the game mode determination module 316 determines the game mode of the next unit game. If the rearranged symbols generate a trigger event in the normal mode, the game mode determination module 316 switches the game mode from the normal mode to the chance mode. If an exit requirement is satisfied in the chance mode, the game mode determination module 316 switches the game mode from the chance mode to the normal mode. In the other cases, the game mode determination module 316 maintains the current game mode. The game mode determination module 316 may belong to the winning determination module 310.

<<Symbols, Winning Combinations, and Paylines>>

FIG. 8 is an example of a symbol code table defining the symbols on the outer circumferential surfaces of the reels 52A to 52C. In FIG. 8, the reel 52A is represented by Reel 1; the reel 52B is represented by Reel 2; and the reel 52C is represented by Reel 3. In this description, the reel 52A is the same as Reel 1; the reel 52B is the same as Reel 2; and the reel 52C is the same as Reel 3.

The symbols on each of the reels 52A to 52C form a symbol sequence consisting of 22 symbols including BLANKs. As will be described later, the lines of the symbols on the reels 52A to 52C are called the first to the third symbol sequences. In this embodiment, a symbol sequence includes seven kinds of symbols: RED7, BLUE7, 1BAR, 2BAR, 3BAR, F_ROSE, and ROSE, excluding BLANK.

The BLANK forms a space between the adjacent symbols above and below the BLANK. The RED7 is a symbol of a red "7". The BLUE7 is a symbol of a blue "7". The 1BAR is a symbol including one character string of "BAR". The 2BAR is a symbol including two character strings of "BAR". The 3BAR is a symbol including three character strings of "BAR". The ROSE is a symbol of an image designed to resemble a flower of rose and also referred to as "normal ROSE". The F_ROSE is a symbol of an image designed to resemble a flower of rose, which opens wider than the ROSE (refer to FIG. 9). The F_ROSE functions as a special ROSE symbol.

As shown in FIG. 8, in each symbol sequence, the symbols are assigned codes from 0 to 21. For example, the first symbol 2BAR in the first symbol sequence is assigned a code 0. The second symbol BLANK in the first symbol sequence is assigned a code 1. The eleventh symbol RED7 in the first symbol sequence is assigned a code 10.

Figure 9:
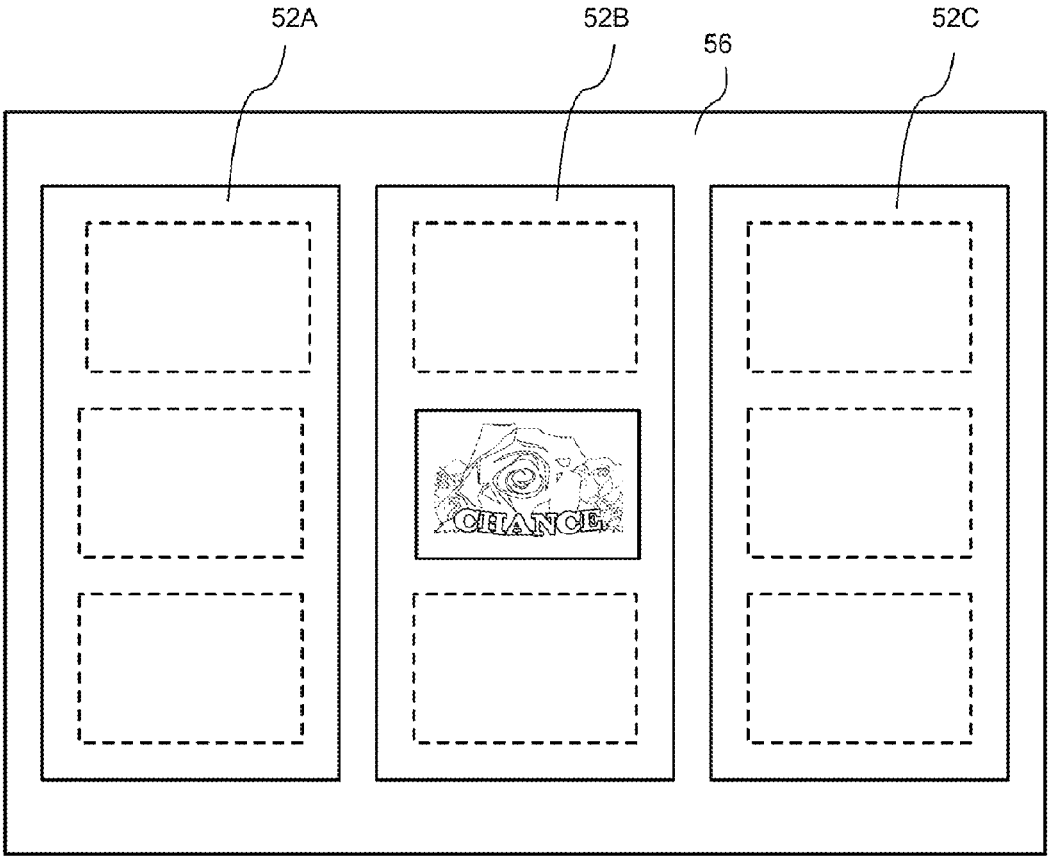
FIG. 9 is a diagram showing a state in which three consecutive symbols on each of the reels 52A to 52C are shown in a display window 56 of a symbol display unit 40.

As shown in FIG. 9, three consecutive symbols in each of the three symbol sequences appearing in the display window 56 of the symbol display unit 40 form a symbol matrix of three rows and three columns in the display window 56. The example of FIG. 9 shows a case where the symbol F_ROSE appears at the position of the second row and the second column, while the other symbols are omitted and not shown.

Each time one of the BET buttons 74 to 78 or the START button 79 is pressed, the random number generation module 302 generates random numbers and the symbol determination module 304 determines three symbols to be stopped and stop position information for the reels 52A to 52C. Then, the reels 52A to 52C with symbols start spinning to show the symbols in the display window 56 in such a manner the symbols are vertically scrolled in the display window 56. After a predetermined period, the reels 52A to 52C stop the scrolling of the symbols and rearrange the symbols to form a symbol matrix in the display window 56. When all the three reels 52A to 52C has stopped, the winning determination module 310 determines the symbol codes of all the symbols rearranged in the display window 56 based on the symbols to be stopped. In this embodiment, all the three reels stop without stop operation by the player. Accordingly, when the symbol determination module 304 determines three symbols to be stopped, the symbol codes of all the symbols to be rearranged can be determined. In this way, the symbol codes of all the symbols to be rearranged can be determined before all the reels 52A to 52C stop. Therefore, reel actions from the start of spinning until the stop of the three reels 52A to 52C can be determined when the symbol determination module 304 has determined three symbols to be stopped. Hence, reel actions can be determined with the symbols to be finally rearranged.

<<Payline>>

Figure 10:
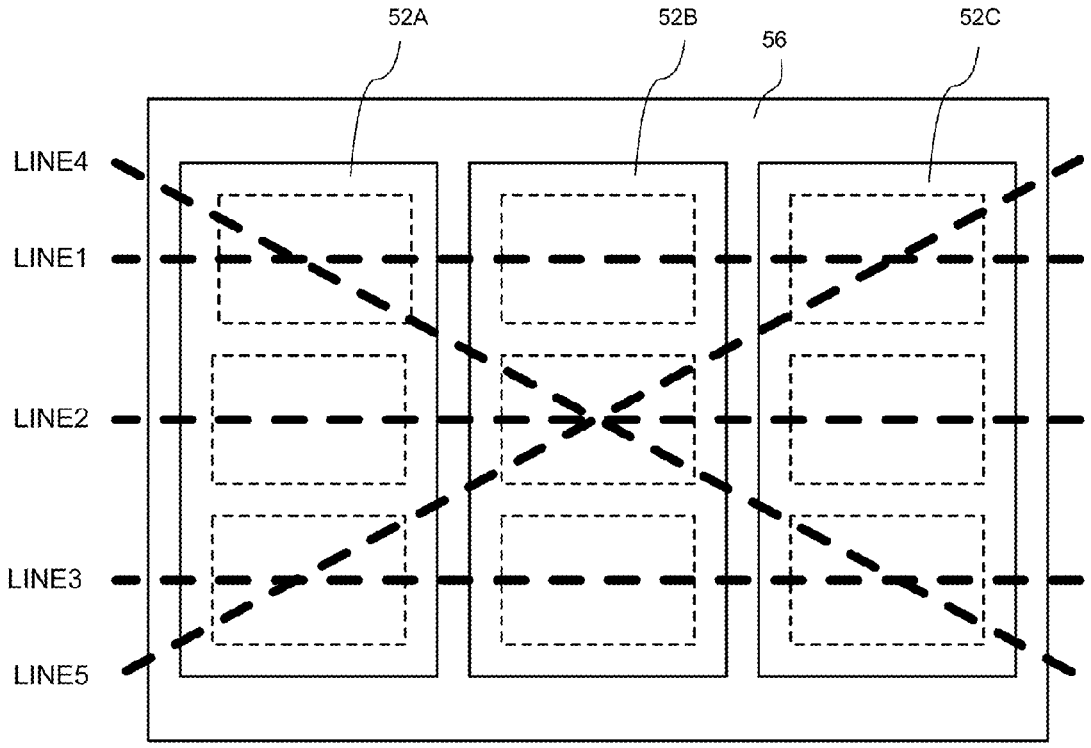
FIG. 10 is a diagram illustrating paylines defined in an embodiment.

FIG. 10 illustrates paylines defined in a preferred embodiment of the present invention. In this embodiment, five paylines are defined for a symbol matrix. The first payline LINE1 to the third payline LINE3 extend horizontally and lie on the symbol stop positions of the first to the third rows of the symbol matrix. The fourth payline LINE4 extends diagonally and connects the symbol stop position on the first row and first column, the symbol stop position on the second row and second column, and the symbol stop position on the third row and third column. The fifth payline LINE5 extends diagonally and connects the symbol stop position on the third row and first column, the symbol stop position on the second row and second column, and the symbol stop position on the first row and third column.

The paylines can be separately selected to be active depending on the player's bet operation. They may be selected to be active independent from the amount of bet or the player's selection. The total number of paylines can be changed depending on the size of the symbol matrix; other paylines can be defined as necessary.

<<State Transition in Game>>

Figure 11:
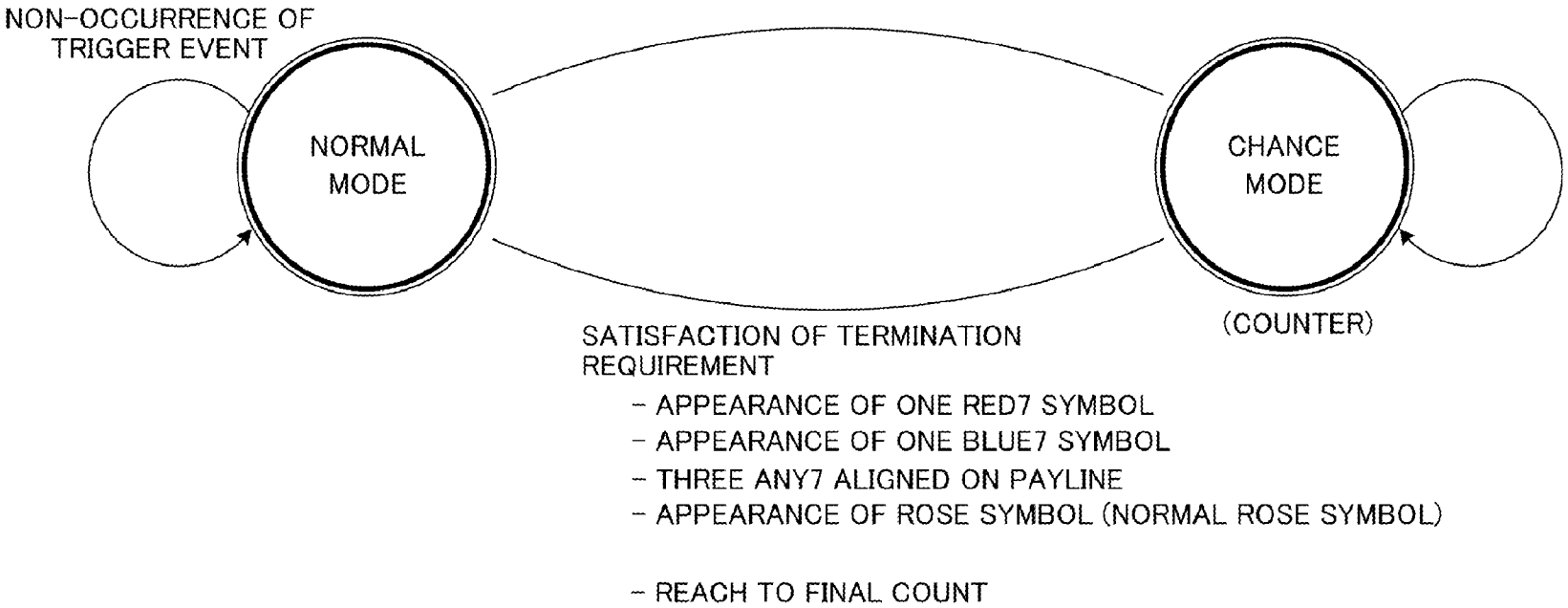
FIG. 11 is a diagram illustrating state transitions of the slot machine 10.

FIG. 11 is a state transition diagram of the slot machine 10.

The slot machine 10 is usually in a normal mode and maintains the state unless a trigger event occurs. When the trigger event occurs during the normal mode, a state transition occurs where the game mode switches to a chance mode. In a preferred embodiment, the trigger event is that an F_ROSE symbol appears on one of the paylines in a symbol matrix (refer to FIG. 9). As shown in the symbol code table of FIG. 8, the F_ROSE symbol exists only on the reel 52B (Reel 2). Accordingly, if the F_ROSE symbol is in the display window 56 when the reel 52B has stopped, the game mode switches from the normal mode to the chance mode.

After the game mode has switched to the chance mode, the slot machine 10 maintains this state unless the exit requirement is satisfied. In this embodiment, one exit requirement is that at least one RED7 symbol appears; at least one BLUE7 symbol appears; or three ANY7s are aligned on a payline. The other exit requirement is that a ROSE symbol (normal ROSE symbol) appears in the display window 56.

In this embodiment, ANY7 means either a RED7 symbol or a BLUE7 symbol.

After the game mode has switched to the chance mode, the slot machine 10 resets the game counter for counting up or down each time a unit game is executed in the chance mode. The maximum number of unit games per chance mode is 8. The term "chance mode" means the period or state from the time the game mode has switched to the chance mode (the chance mode begins) until the time the chance mode terminates. Accordingly, when the game counter counts up and reaches 8, or when the game counter counts down and reaches 0, the slot machine 10 shows at least one RED7 symbol or BLUE7 symbol, aligns three ANY7s on a payline, or shows a ROSE symbol (normal ROSE symbol) in the display window 56 so as to satisfy the exit requirement. A lottery to determine the combination of symbols is repeatedly drawn until hitting a combination of symbols satisfying the exit requirement. When the exit requirement is satisfied, the slot machine 10 returns the game mode to the normal mode and resumes unit games in the normal mode.

<<Symbol Code Determination Table, Symbol Appearance Probability Table, and Payout Table>>

Regardless of the game mode, combinations of symbols (including the combination of symbols to be stopped) are determined based on a plurality of tables held in the RAM 226 of the mother board 220. As described above, the RAM 226 stores at least one symbol code determination table and/or at least one symbol appearance probability table. The RAM 226 further stores payout table.

<Symbol Code Determination Table>

The zeroth symbol code determination table 340 to the eighth symbol code determination table 348 each store mapping information between random numbers generated by the random number generation module 302 and the symbol codes representing the symbols shown in FIG. 8. Each time a random number is generated by the random number generation module 302, the symbol determination module 304 determines a symbol code corresponding to a symbol with reference to the zeroth symbol code determination table 340 to the eighth symbol code determination table 348. If the range associated with a random number is wide, the probability of determination of the symbol associated with the range is high. Meanwhile, if the range for selecting a random number is wide, the probability of determination of a symbol code can be controlled precisely.

The zeroth symbol code determination table 340 is used to determine a symbol in the normal mode. The first symbol code determination table 341 to the eighth symbol code determination table 348 are used to determine a symbol in the first to the eighth chance mode games.

The first symbol code determination table 341 is a table that never leads to appearance of a ROSE symbol or an F_ROSE symbol. The second symbol code determination table 342 to the seventh symbol code determination table 347 are tables that never lead to appearance of an F_ROSE symbol. The eighth symbol code determination table 348 is table that surely leads to appearance of a ROSE symbol or a winning combination including a RED7 symbol or BLUE7 symbol.

The eighth symbol code determination table 348 surely leads to a winning combination including at least one RED7 symbol or BLUE7 symbol, or a winning combination consisting of RED7 and BLUE7 symbols. Alternatively, the table 348 surely leads to appearance of a ROSE symbol on any one of the paylines. This configuration enables the chance mode to definitely return to the normal mode after the unit game in the chance mode is repeated eight times.

Each symbol code determination table may be configured to be an integrated table for the first to the third symbol sequences or separate tables for the individual first to third symbol sequences.

The symbol determination module 304 determines three symbols for a given row in a symbol matrix (for example, the second row, namely, LINE2 in FIG. 10). Specifically, the symbol determination module 304 determines a symbol to appear at the second row and first column, a symbol to appear at the second row and second column, and a symbol to appear at the second row and third column. This way, the symbol determination module 304 determines three symbols for a given row and refers to the symbol code table of FIG. 8 with them to determine all symbols to constitute a symbol matrix. The nine symbols to constitute a symbol matrix in this embodiment are thus determined When all the symbols to constitute a symbol matrix are determined, the winning determination module 310 determines whether any one of the winning combinations is complete and the game mode determination module 316 determines the game mode for the subsequent unit games.

<Symbol Appearance Probability Table>

As mentioned above, the RAM 226 stores at least one symbol appearance probability table. The zeroth symbol appearance probability table 360 to the eighth symbol appearance probability table 368 each define probabilities that individual symbols appear on a payline. The zeroth symbol appearance probability table 360 is used in the normal mode. The first symbol appearance probability table 361 to the eighth symbol appearance probability table 368 are used in the first to the eighth chance mode games.

The probability that a symbol appears on a payline affects a probability that a winning combination is completed. Accordingly, the symbol appearance probability tables 360 to 368 are created based on the probabilities of winning combinations.

Each of the zeroth symbol appearance probability table 360 to the eighth symbol appearance probability table 368 may also be configured to be an integrated table for the first to the third symbol sequences or separate tables for the individual first to third symbol sequences.

<Payout Table>

As mentioned above, the RAM 226 also stores at least one payout table. The zeroth payout table 380 to the eighth payout table 388 each define relations of winning combinations, payouts, and winning probabilities. The zeroth payout table 380 is used in the normal mode. The first payout table 381 to the eighth payout table 388 are used in the first to the eighth chance mode games. It is preferable to define separate payout tables to be used in eight unit games in the chance mode.

Each time a unit game is executed, the winning determination module 310 included in the game program and executed by the main CPU 222 determines whether a winning combination is completed on a payline. If one of the winning combinations defined by the zeroth payout table 380 to the eighth payout table 388 is completed on one of the paylines, the winning determination module 310 identifies the winning combination and determines the amount of payout with reference to the zeroth payout table 380 to the eighth payout table 388. The payout module 314 pays out the determined amount of payout. However, if no winning combination is completed with the symbols on the paylines, the winning determination module 310 determines to be so-called losing.

For example, if three RED7 symbols in three different symbol sequences appear along one of the paylines LINE1 to LINE 5, it is determined that the winning combination of three RED7 symbols is completed so that the corresponding amount of payout is paid out. The benefit of payout is to be supplied to the player by actually discharging coins to the coin tray 92 or adding the credit by the amount.

<<Winning Probability in Chance Mode>>

As described above, the first symbol code determination table 341 to the eighth symbol code determination table 348 are respectively used to determine a symbol in the first to eighth chance mode games.

With the first symbol code determination table 341, neither a ROSE symbol nor an F_ROSE symbol will appear. Accordingly, the first symbol code determination table 341 is a table defining the probabilities of ROSE symbol and F_ROSE symbol as zero.

With the second symbol code determination table 342 to the seventh symbol code determination table 347, an F_ROSE symbol will never appear. Accordingly, the second symbol code determination table 342 to the seventh symbol code determination table 347 are tables defining the probability of F_ROSE symbol as zero.

With the eighth symbol code determination table 348, a ROSE symbol or a winning combination including RED7 and/or BLUE7 symbols will surely appear. Accordingly, the eighth symbol code determination table 348 is a table defining the probabilities of symbols other than the RED7, BLUE7, and ROSE symbols as zero.

<<Operation of Slot Machine>>

Operation of the slot machine 10 will be described with reference to FIGS. 12 to 21, and FIG. 37.

<Processing at Power-On>

Figure 12:
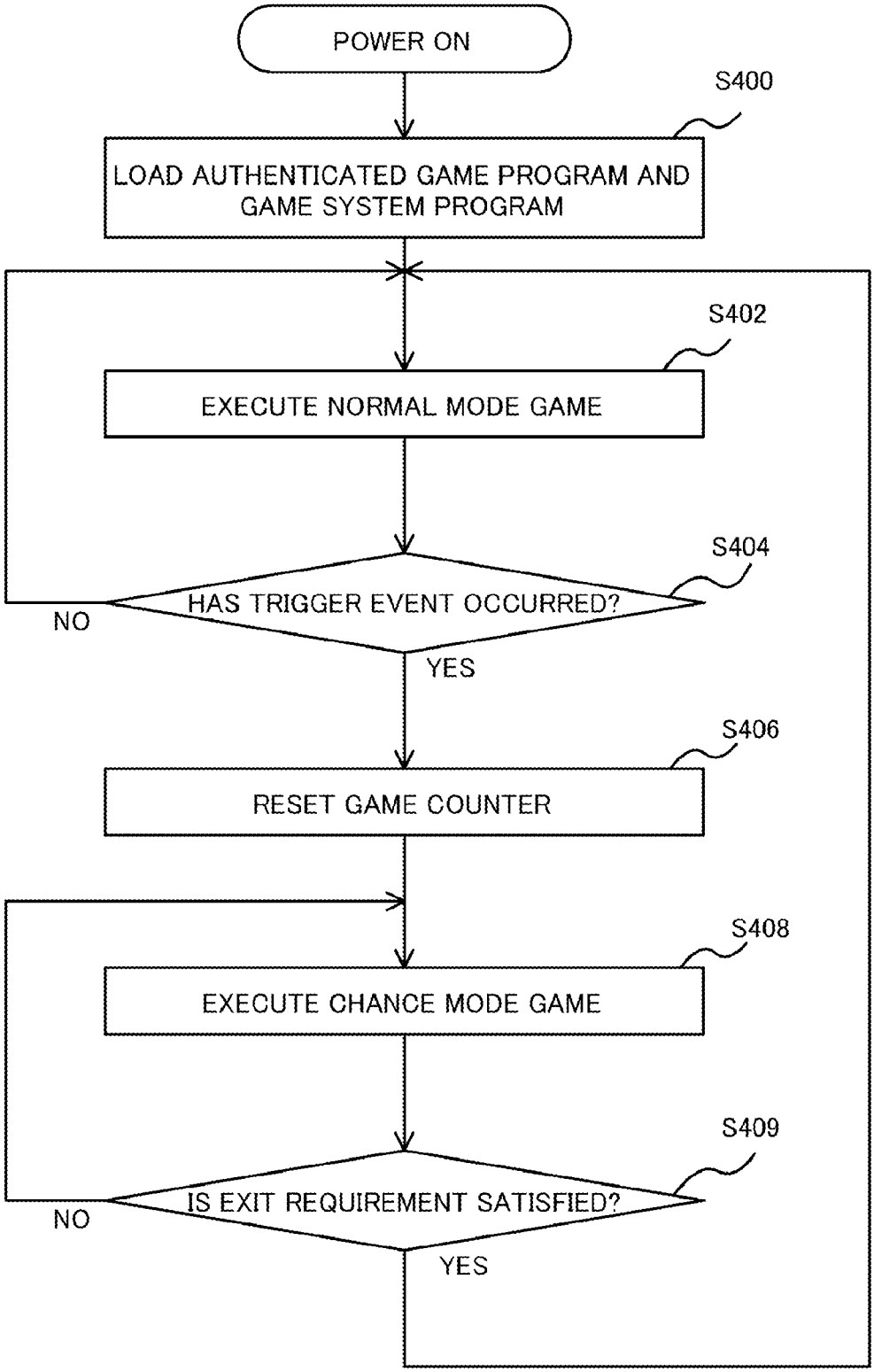
FIG. 12 is a flowchart of a subroutine of processing at power-on of the slot machine 10.

FIG. 12 is a flowchart illustrating a subroutine of processing at power-on of the slot machine 10.

If electric power is supplied to the slot machine 10, the main CPU 222 loads the authenticated game program and game system program by retrieving the programs from the memory card 210 via the game board 200 and writing them to the RAM 226 (Step S400). Next, the main CPU 222 executes the game program and the game system program.

When a player tries to start a unit game by inserting an IC card to the IC card reader 60 or dropping coins in the coin entry 80, the unit game can be started based on the dropped-in coins or stored bets. For the first unit game after the activation of the slot machine 10, the game mode is a normal mode. The main CPU 222 thus executes a normal mode game for the first unit game (Step S402).

Each time a normal mode game ends, the game mode determination module 316 executed by the main CPU 222 determines whether a trigger event has occurred (Step S404).

In this embodiment, the trigger event is that the F_ROSE symbol appears on one of the paylines in the symbol matrix. Unless the trigger event occurs, the game mode of the subsequent unit game is maintained in the normal mode. Accordingly, the main CPU 222 returns the processing to Step S402 to execute the normal mode game for the subsequent unit game.

If the determination at Step S404 is that the trigger event has occurred, the main CPU 222 changes the game mode for the subsequent unit game to the chance mode.

As described above, the number of unit games that can be executed per chance mode is eight in a preferred embodiment. Each of the first symbol code determination table 341 to the eighth symbol code determination table 348 can be used in a unit game in the chance mode. Each time a unit game in the chance mode is executed, the game counter increments the number of unit games executed in the chance mode or decrements the number of unit games remaining in the chance mode. The following description is based on the assumption that the game counter increments the number of executed unit games. Accordingly, at Step S406, the main CPU 222 resets the game counter to 0. Thereafter, the main CPU 222 executes a chance mode game for the subsequent game (Step S408).

Each time a unit game in the chance mode ends, the game mode determination module 316 determines whether the exit requirement is satisfied (Step S409). In this embodiment, the exit requirement is that at least one RED7 symbol appears; at least one BLUE7 symbol appears; three ANY7 symbols are aligned on a payline; or a ROSE symbol (normal ROSE symbol) appears in the display window 56.

Unless the exit requirement is satisfied, the game mode determination module 316 maintains the game mode for the subsequent unit game in the chance mode. Accordingly, the main CPU 222 returns to Step S408 to execute a chance mode game for the subsequent unit game.

If the determination at Step S409 is that the exit requirement is satisfied, the main CPU 222 returns to the game mode for the subsequent unit game to the normal mode. Accordingly, the main CPU 222 returns to Step S402 to execute a normal mode game for the subsequent unit game.

<Normal Mode Game Execution>

Figure 13:
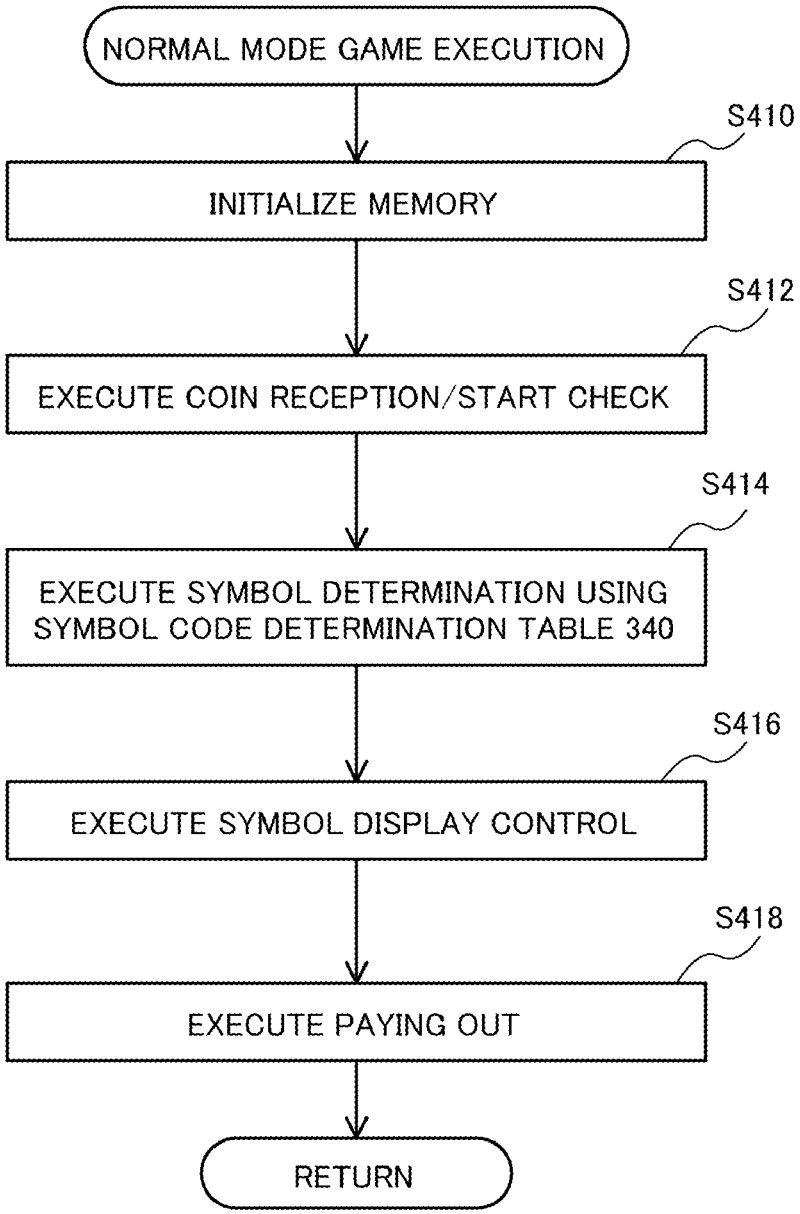
FIG. 13 is a flowchart of a subroutine of normal mode game execution.

FIG. 13 is a flowchart illustrating a subroutine of normal mode game execution to illustrate Step S402 in FIG. 12 in detail.

Each time a unit game ends, the main CPU 222 initializes the memory (Step S410). In this initialization, the main CPU 222 clears unnecessary data and information from the temporary working space of the RAM 226. The unnecessary data and information are, for example, payout data, information indicating winning or losing, and information on symbols to be stopped determined in the previous unit game.

Next, the main CPU 222 executes coin reception/start check (Step S412). At this step, the main CPU 222 checks whether any coins or bills have been put in and scans the BET buttons 74 to 78 and the START button 79 for an input from any one of them.

Upon press of the START button 79 by the player, the main CPU 222 executes symbol determination (Step S414). At this step, the main CPU 222 generates three random numbers and refers to the symbol code determination table 340 to determine three symbol codes for three symbols to be stopped based on the random numbers. The main CPU 222 determines whether a winning combination is completed in the symbol matrix formed of rearranged symbols.

At Step S416, the main CPU 222 executes symbol display control. At this step, the main CPU 222 controls the reel assembly to spin the reels 52A to 52C. Subsequently, it stops the reels 52A to 52C so as to rearrange the symbols in accordance with the result of symbol determination and form a symbol matrix in the display window 56.

Next, at Step S418, the main CPU 222 determines the amount of payout and executes payout to give the determined amount of payout to the player.

<Coin Reception/Start Check>

Figure 14:
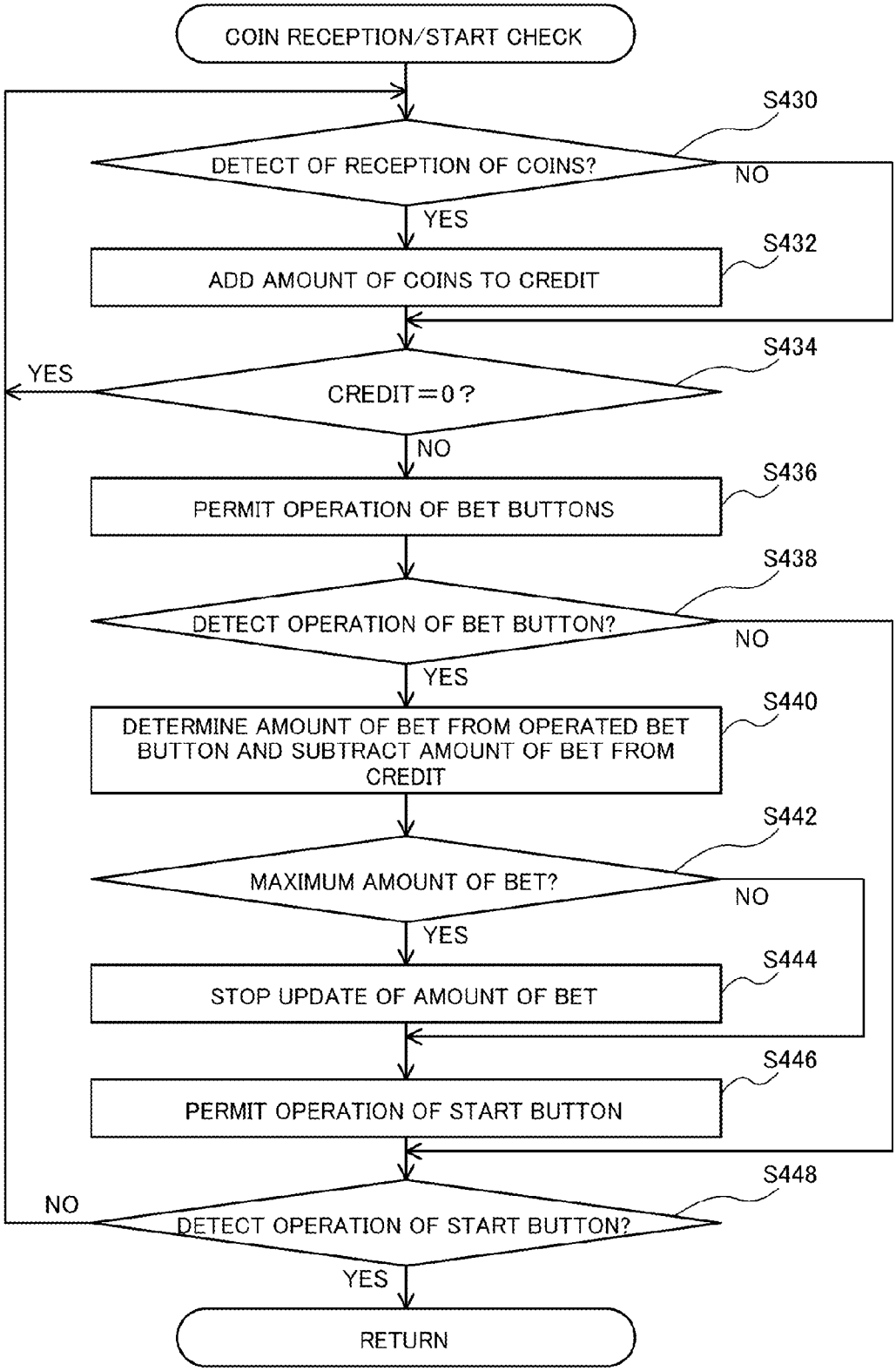
FIG. 14 is a flowchart of a subroutine of coin reception/start check.

FIG. 14 is a flowchart illustrating a subroutine of coin reception/start check to illustrate Step 412 in FIG. 13 in detail.

First, the main CPU 222 determines whether the coin counter 232 has detected reception of coins through the input/credit check module 300 executed by the main CPU 222 (Step S430). If the determination at Step S430 is that reception of coins has been detected, the main CPU 222 adds the amount of the received coins to the credit stored in the RAM 226 (Step S432). At this step, the main CPU 222 may further determine whether the bill validator 246 has detected reception of a bill. If the determination is that reception of a bill has been detected, the main CPU 222 adds the amount of the received bill to the credit.

When Step S432 is done or if the determination at Step S430 is that reception of coins is not detected, the main CPU 222 determines whether the amount of credit is zero (Step S434). If the determination at Step S434 is that some credit remains, the main CPU 222 permits entry for placing bets from the BET buttons 34 to 38 within the limit of the remaining credit (Step S436). If the determination at Step S434 is that no credit remains, the main CPU 222 returns to Step S430.

Next, the main CPU 222 monitors the BET buttons 74 to 78 for an entry placing a bet based on a bet entry signal output from any of the BET switches 74S to 78S (Step S438). Upon determination that one of the BET buttons 74 to 78 has been pressed by the player, the main CPU 222 updates the amount of bet held in the RAM 226 in accordance with the pressed BET button and subtracts the amount of bet from the credit held in the RAM 226 (Step S440). If the determination at Step S434 is no entry from the BET buttons within a predetermined time period, the main CPU 222 proceeds to Step S448.

The main CPU 222 determines whether the amount of bet reaches a predetermined maximum value while the amount of bet is increasing (Step S442). If the amount of bet has reached the predetermined maximum value, the main CPU 222 prohibits further increase in the amount of bet (Step S444).

When Step S444 is done or if the determination at Step S442 is that the amount of bet has not reached the maximum value and the amount of bet has been updated, the main CPU 222 permits an input by operation of the START button 79 (Step S446). At this stage, the main CPU 222 can show the defined paylines in the symbol display unit.

At Step S448, the main CPU 222 determines whether an input from the START button 79 has been detected (Step S448). If no input from the START button 79 has been detected for a predetermined standby time, the main CPU 222 returns to Step S430. If the determination at Step S448 is that an input from the START button 79 has been detected, the main CPU 222 terminates this coin reception/start check.

<<Symbol Determination>>

Figure 15:
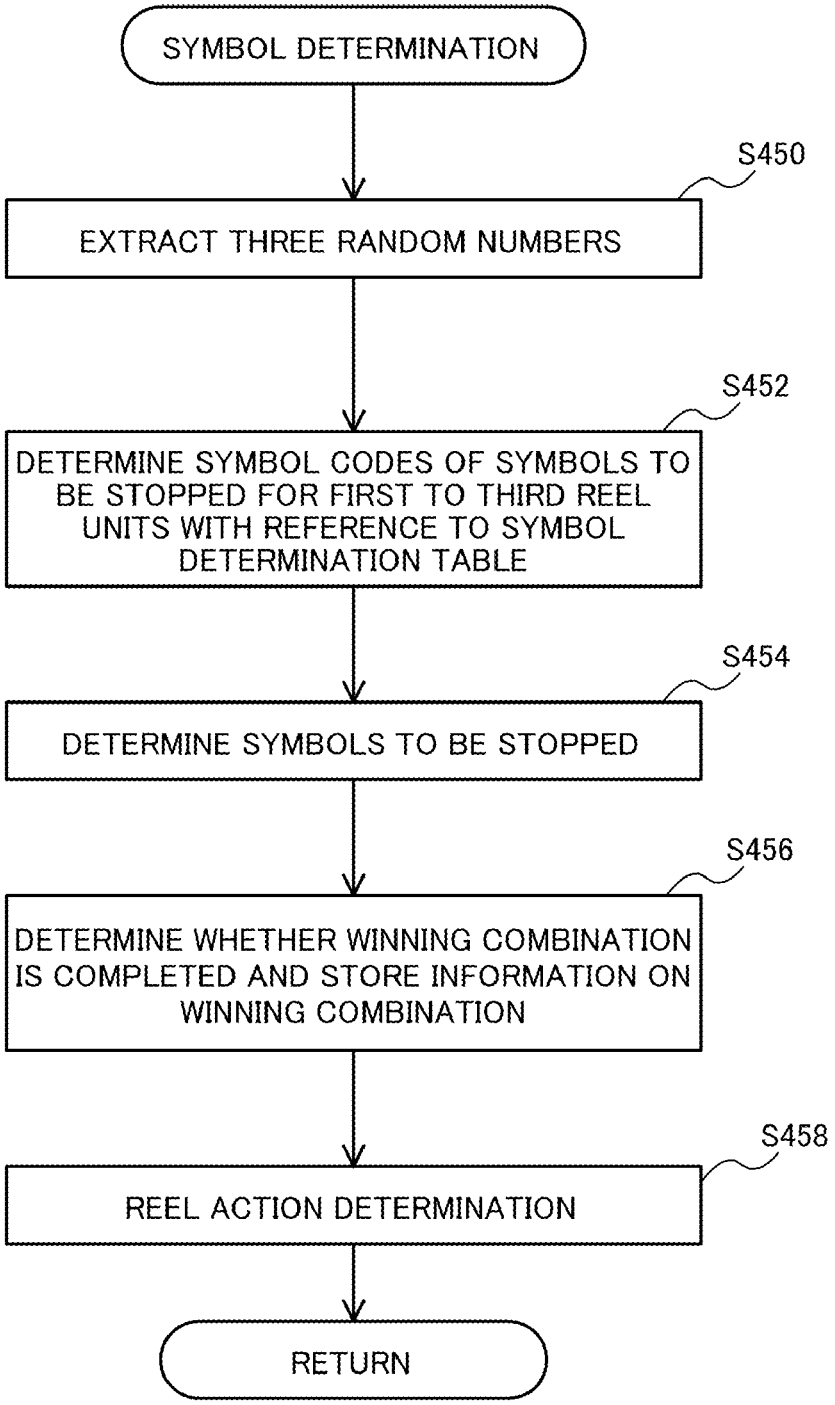
FIG. 15 is a flowchart of a subroutine of symbol determination.
Figure 16A:
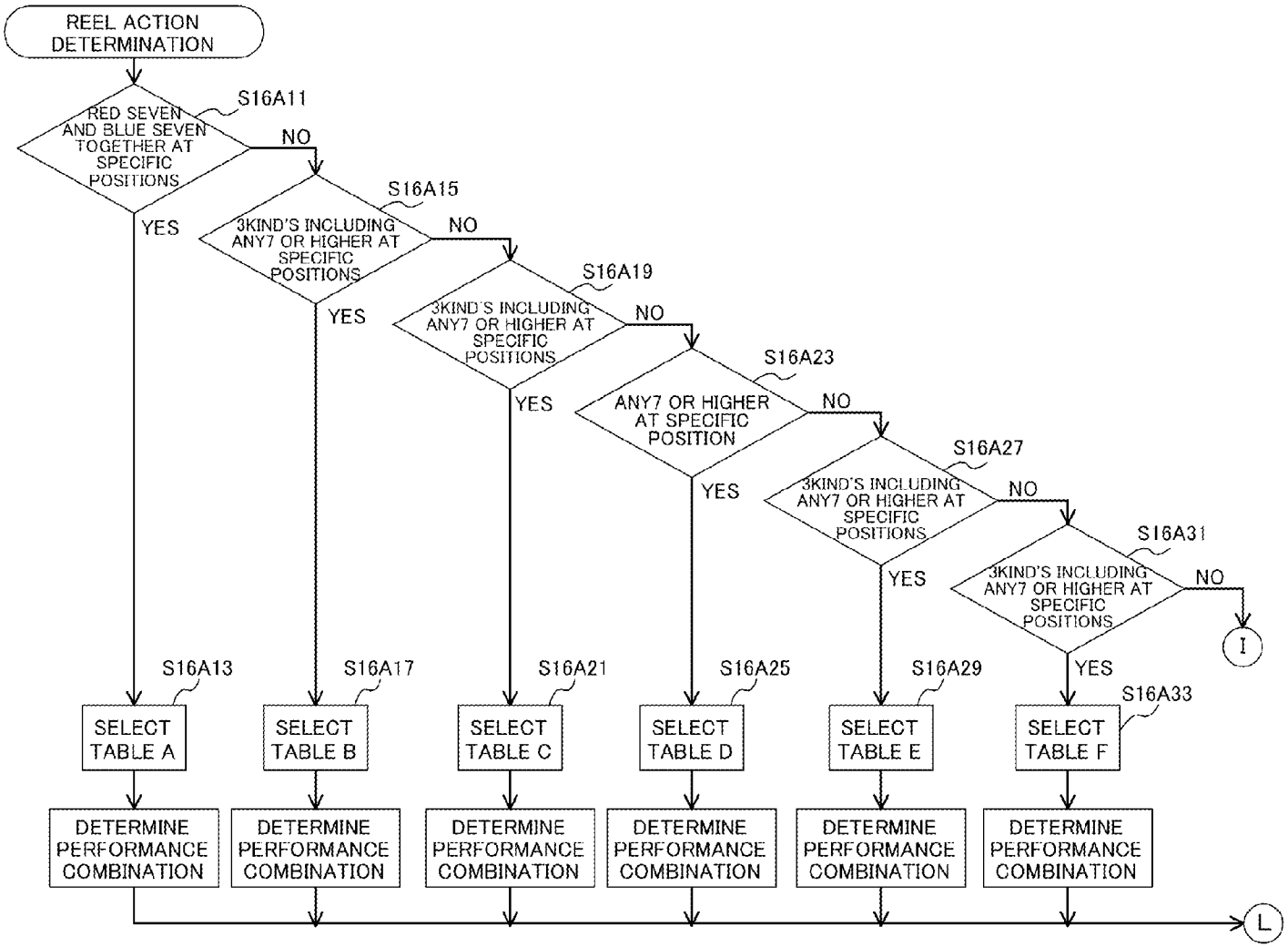
FIG. 16A is a flowchart of a subroutine of reel action determination invoked and executed at Step S458 in FIG. 15.
Figure 16B:
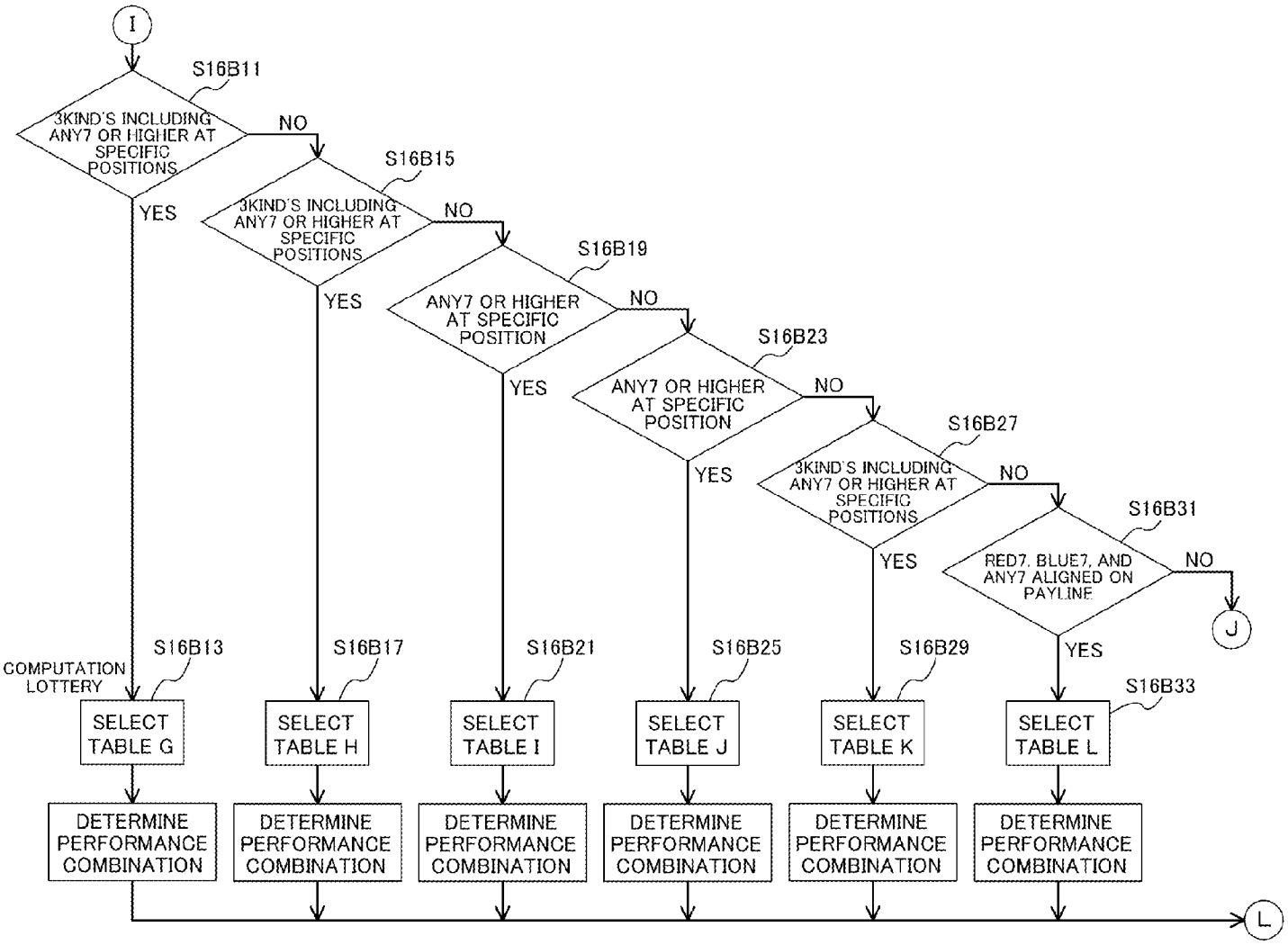
FIG. 16B is a flowchart of a subroutine of reel action determination invoked and executed at Step S458 in FIG. 15.
Figure 16C:
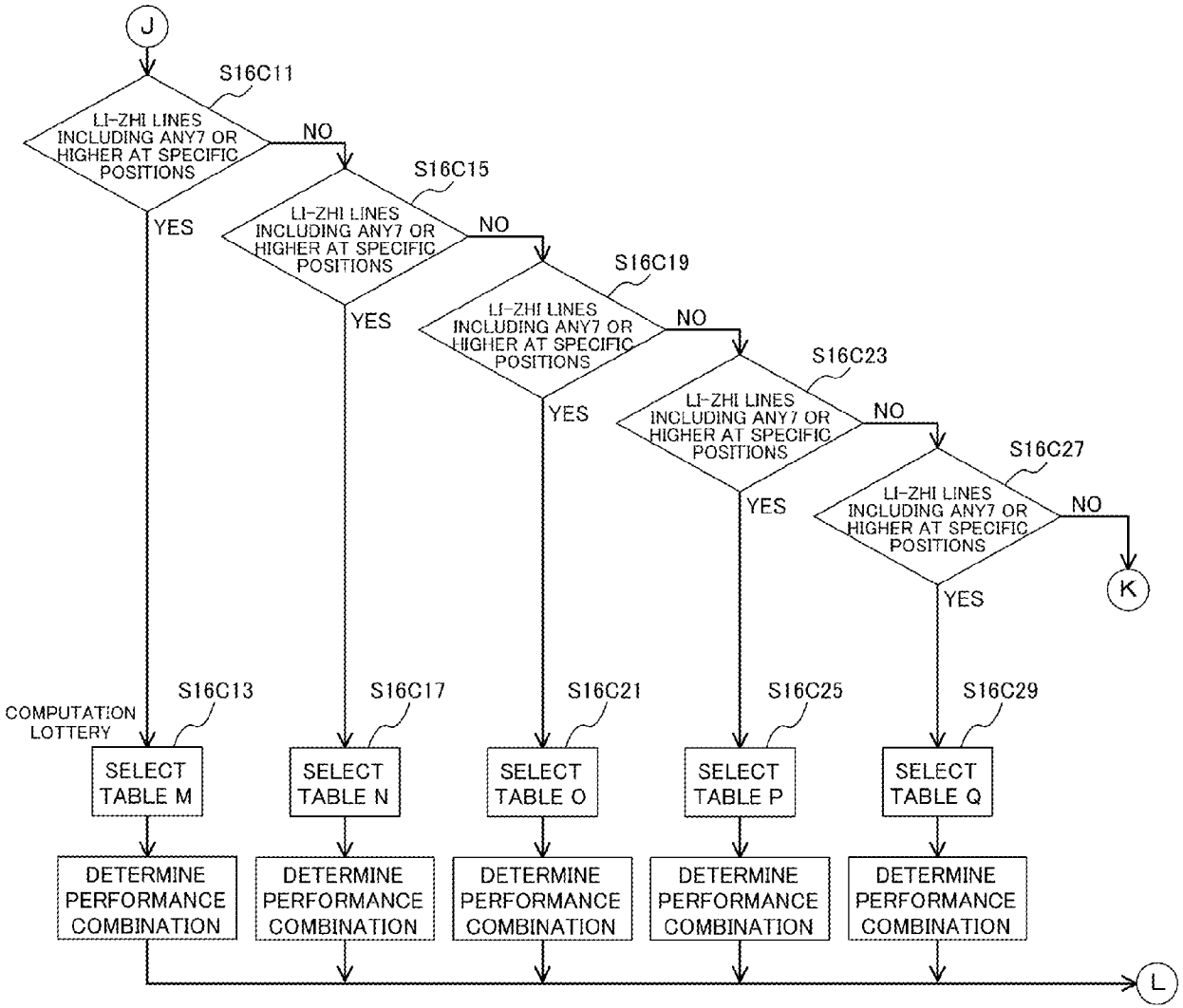
FIG. 16C is a flowchart of a subroutine of reel action determination invoked and executed at Step S458 in FIG. 15.
Figure 16D:
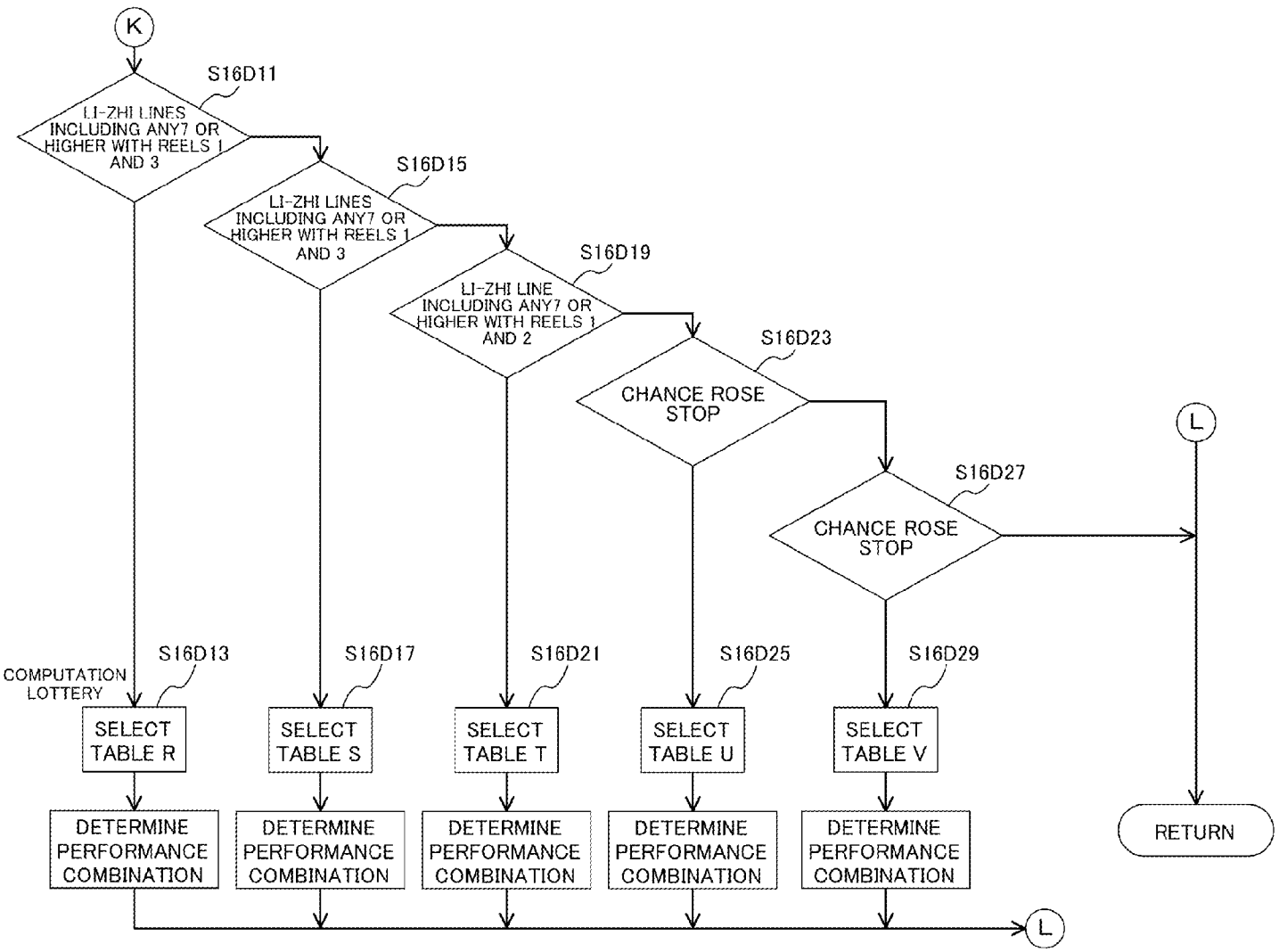
FIG. 16D is a flowchart of a subroutine of reel action determination invoked and executed at Step S458 in FIG. 15.

FIG. 15 is a flowchart illustrating a subroutine of symbol determination to illustrate Step S414 in FIG. 13 in detail.

First, the random number generation module 302 executed by the main CPU 222 extracts three random numbers (Step S450).

Next, the symbol determination module 304 executed by the main CPU 222 refers to the symbol code determination table 340 with the first to the third random numbers to determine the first to third symbol codes (Step S452). Next, the main CPU 222 refers to the symbol code table with the first to third symbol codes to determine the first to third symbols to be stopped (Step S454). Thus, the three symbols to be stopped are determined by using three random numbers. Upon determination of the first to third symbols to be stopped, the main CPU 222 stores the symbols or symbol codes in the RAM 226.

The three symbols to be stopped are the symbols to stop on the second row of all columns (LINE2) of the symbol matrix shown in FIG. 10. Since the arrangement of symbols constituting each of the first to third symbol sequences is fixed to each of the reels 52A to 52C, the determination of the symbol to be stopped for each reel determines all the symbols to constitute a symbol matrix. The main CPU 222 determines all the symbols to constitute a symbol matrix based on the symbols to be stopped based on the symbol code table of FIG. 8.

Next, the winning determination module 310 executed by the main CPU 222 determines whether the symbols constituting the symbol matrix determined at Step S456 make a winning combination (Step S456). If the symbols constituting the symbol matrix make a winning combination, the winning determination module 310 stores the winning combination in the RAM 226 (Step S456). The main CPU 222 may determine whether a winning combination is completed from the symbol codes of the symbols to be stopped instead of using the symbol matrix.

Next, the main CPU 222 invokes and executes the subroutine of reel action determination illustrated in FIGS. 16A to 16D (Step S458).

Finally, the symbol determination is terminated.

<Reel Action Determination>

FIGS. 16A to 16D are flowcharts illustrating a subroutine of reel action determination invoked and executed at Step S458 in FIG. 15.

First, the main CPU 222 determines whether Red Seven and Blue Seven are completed together at specific positions (Step S16A11). Specifically, Step S16A11 is to determine whether, as the symbols to be stopped determined at Step S454 of FIG. 15, a winning combination of RED7 (2)-RED7 (2)-RED7 (2) aligned on LINE1 and a combination of BLUE7 (4)-BLUE7 (4)-BLUE7 (4) aligned on LINE3 complete Red Seven and Blue Seven together at specific positions (refer to the block enclosed with a thick line in FIG. 23 (A-1) and the table of FIG. 23 (A-2)). Here, the numerical values in the parenthesis following the symbol names are the symbol codes listed in FIG. 8 (the same applies to the followings). If this requirement is satisfied (YES), the main CPU 222 selects Table A (Step S16A13) and exits this subroutine.

If the requirement is not satisfied in the determination at Step S16A11 (NO), the main CPU 222 determines whether 3Kind's including ANY7 or higher combinations are made at specific positions (Step S16A15). Specifically, Step S16A15 is to determine whether, as the symbols to be stopped determined at Step S454 of FIG. 15, a RED7 (2) is positioned at the top row of the reel 52A (Reel 1); a RED7 (2) is positioned at the top row of the reel 52C (Reel 3); a BLUE7 (4) is positioned at the bottom row of the reel 52A (Reel 1); and a BLUE7 (4) is positioned at the bottom row of the reel 52C (Reel 3) to make 3Kind's including ANY7 or higher combinations at specific positions (refer to the blocks enclosed with thick lines in FIG. 23 (B-1) and the table of FIG. 23 (B-2)).

As previously explained, ANY7 means either RED7 symbol or BLUE7 symbol in this embodiment.

If the requirement for Step S16A15 is satisfied, the main CPU 222 selects Table B (Step S16A17) and exits this subroutine.

If the requirement is not satisfied in the determination at Step S16A15 (NO), the main CPU 222 determines whether 3Kind's including ANY7 or higher combinations are made at specific positions (Step S16A19). Specifically, Step S16A19 is to determine whether a RED7 (2) is positioned at the top row of the reel 52A (Reel 1); a RED7 (2) is positioned at the top row of the reel 52B (Reel 2); a BLUE7 (4) is positioned at the bottom row of the reel 52A (Reel 1); and a BLUE7 (4) is positioned at the bottom row of the reel 52B (Reel 2) to make 3Kind's including ANY7 or higher combinations at specific positions (refer to the block enclosed with a thick line in FIG. 23 (C-1) and FIG. 23 (C-2)). If this requirement is satisfied, the main CPU 222 selects Table C (Step S16A21) and exits this subroutine.

If the requirement is not satisfied in the determination at Step S16A19 (NO), the main CPU 222 determines whether ANY7 or higher is made at a specific position (Step S16A23). Specifically, Step S16A23 is to determine whether a RED7 (2) is positioned at the top row of the reel 52B (Reel 2) and a BLUE7 (4) is positioned at the bottom row of the reel 52B (Reel 2) to make ANY7 or higher at a specific position (refer to the block enclosed with a thick line in FIG. 24 (A-1) and FIG. 24 (A-2)). If this requirement is satisfied, the main CPU 222 selects Table D (Step S16A25) and exits this subroutine.

If the requirement is not satisfied in the determination at Step S16A23 (NO), the main CPU 222 determines whether 3Kind's including ANY7 or higher combinations are made at specific positions (Step S16A27). Specifically, Step S16A27 is to determine whether a RED7 (2) is positioned at the top row of the reel 52A (Reel 1); a RED7 (2) is positioned at the bottom row of the reel 52C (Reel 3); and a BLUE7 (4) is positioned at the bottom row of the reel 52A (Reel 1) to make 3Kind's including ANY7 or higher combinations at specific positions (refer to the blocks enclosed with thick lines in FIG. 24 (B-1) and FIG. 24 (B-2)). If this requirement is satisfied, the main CPU 222 selects Table E (Step S16A29) and exits this subroutine.

If the requirement is not satisfied in the determination at Step S16A27 (NO), the main CPU 222 determines whether 3Kind's including ANY7 or higher combinations are made at specific positions (Step S16A31). Specifically, Step S16A31 is to determine whether a RED7 (2) is positioned at the top row of the reel 52A (Reel 1); a BLUE7 (4) is positioned at the bottom row of the reel 52A (Reel 1); and a BLUE7 (4) is positioned at the top row of the reel 52C (Reel 3) to make 3Kind's including ANY7 or higher combinations at specific positions (refer to the blocks enclosed with thick lines in FIG. 24 (C-1) and FIG. 24 (C-2)). If this requirement is satisfied, the main CPU 222 selects Table F (Step S16A33) and exits this subroutine.

If the requirement is not satisfied in the determination at Step S16A31 (NO), the main CPU 222 determines whether 3Kind's including ANY7 or higher combinations are made at specific positions (Step S16B11). Specifically, Step S16B11 is to determine whether a RED7 (2) is positioned at the bottom row of the reel 52A (Reel 1); a RED7 (2) is positioned at the top row of the reel 52C (Reel 3); and a BLUE7 (4) is positioned at the bottom row of the reel 52C (Reel 3) to make 3Kind's including ANY7 or higher combinations at specific positions (refer to the blocks enclosed with thick lines in FIG. 25 (A-1) and FIG. 25 (A-2)). If this requirement is satisfied, the main CPU 222 selects Table G (Step S16B13) to exit this subroutine.

If the requirement is not satisfied in the determination at Step S16B11 (NO), the main CPU 222 determines whether 3Kind's including ANY7 or higher combinations are made at specific positions (Step S16B15). Specifically, Step S16B15 is to determine whether a BLUE7 (4) is positioned at the top row of the reel 52A (Reel 1); a RED7 (2) is positioned at the top row of the reel 52C (Reel 3); and a BLUE7 (4) is positioned at the bottom row of the reel 52C (Reel 3) to make 3Kind's including ANY7 or higher combinations at specific positions (refer to the blocks enclosed with thick lines in FIG. 25 (B-1) and FIG. 25 (B-2)). If this requirement is satisfied, the main CPU 222 selects Table H (Step S16B17) and exits this subroutine.

If the requirement is not satisfied in the determination at Step S16B15 (NO), the main CPU 222 determines whether ANY7 or higher is made at a specific position (Step S16B19). Specifically, Step S16B19 is to determine whether a RED7 (2) is positioned at the top row of the reel 52A (Reel 1) and a BLUE7 (4) is positioned at the bottom row of the reel 52A (Reel 1) to make ANY7 or higher at a specific position (refer to the block enclosed with a thick line in FIG. 25 (C-1) and FIG. 25 (C-2)). If this requirement is satisfied, the main CPU 222 selects Table I (Step S16B21) and exits this subroutine.

If the requirement is not satisfied in the determination at Step S16B19 (NO), the main CPU 222 determines whether ANY7 or higher is made at a specific position (Step S16B23). Specifically, Step S16B23 is to determine whether a RED7 (2) is positioned at the top row of the reel 52C (Reel 3) and a BLUE7 (4) is positioned at the bottom row of the reel 52C (Reel 3) to make ANY7 or higher at a specific position (refer to the block enclosed with a thick line in FIG. 26 (A-1) and FIG. 26 (A-2)). If this requirement is satisfied, the main CPU 222 selects Table J (Step S16B25) and exits this subroutine.

If the requirement is not satisfied in the determination at Step S16B23 (NO), the main CPU 222 determines whether 3Kind's including ANY7 or higher combinations are made at specific positions (Step S16B27). Specifically, Step S16B27 is to determine whether a RED7 (2) is positioned at the bottom row of the reel 52A (Reel 1); a RED7 (2) is positioned at the middle row of the reel 52B (Reel 2); and a RED7 (2) is positioned at the top row of the reel 52C (Reel 3) to make 3Kind's including ANY7 or higher combinations at specific positions (refer to the blocks enclosed with thick lines in FIG. 26 (B-1) and FIG. 26 (B-2)). If this requirement is satisfied, the main CPU 222 selects Table K (Step S16B29) and exits this subroutine.

If the requirement is not satisfied in the determination at Step S16B27 (NO), the main CPU 222 determines whether ANY7 or higher is made (Step S16B31). Specifically, Step S16B31 is to determine whether a RED7 symbol, a BLUE7 symbol, and an ANY7 are aligned on a payline (refer to FIG. 26 (C-1) and FIG. 26 (C-2)). If this requirement is satisfied, the main CPU 222 selects Table L (Step S16B33) to exit this subroutine.

If the requirement is not satisfied in the determination at Step S16B31 (NO), the main CPU 222 determines whether li-zhi lines including ANY7 or higher are made at specific positions (Step S16C11). Specifically, Step S16C11 is to determine whether a RED7 (2) is positioned at the top row of the reel 52A (Reel 1); a BLUE7 (4) is positioned at the bottom row of the reel 52A (Reel 1); a RED7 (2) is positioned at the top row of the reel 52C (Reel 3); and a BLUE7 (4) is positioned at the bottom row of the reel 52C (Reel 3) to determine that li-zhi lines including ANY7 or higher are made at specific positions (refer to the blocks enclosed with thick lines in FIG. 27 (A-1) and FIG. 27 (A-2)). If this requirement is satisfied, the main CPU 222 selects Table M (Step S16C13) and exits this subroutine.

The determination at Step S16C11 is to determine whether the LINE1 and the LINE3 are li-zhi lines when the reel 52A (Reel 1) and the reel 52C (Reel 3) are stopped.

If the requirement is not satisfied in the determination at Step S16C11 (NO), the main CPU 222 determines whether li-zhi lines including ANY7 or higher are made at specific positions (Step S16C15). Specifically, Step S16C15 is to determine whether a RED7 (2) is positioned at the top row of the reel 52A (Reel 1); a BLUE7 (4) is positioned at the bottom row of the reel 52A (Reel 1); a RED7 (2) is positioned at the top row of the reel 52B (Reel 2); and a BLUE7 (4) is positioned at the bottom row of the reel 52B (Reel 2) to determine that li-zhi lines including ANY7 or higher are made at specific positions (refer to the block enclosed with a thick line in FIG. 27 (B-1) and FIG. 27 (B-2)). If this requirement is satisfied, the main CPU 222 selects Table N (Step S16C17) and exits this subroutine.

The determination at Step S16C15 is to determine whether the LINE1 and the LINE3 are li-zhi lines when the reel 52A (Reel 1) and the reel 52B (Reel 2) are stopped.

If the requirement is not satisfied in the determination at Step S16C15 (NO), the main CPU 222 determines whether li-zhi lines including ANY7 or higher are made at specific positions (Step S16C19). Specifically, Step S16C19 is to determine whether a RED7 (2) is positioned at the top row of the reel 52A (Reel 1); a BLUE7 (4) is positioned at the bottom row of the reel 52A (Reel 1); and a RED7 (2) is positioned at the bottom row of the reel 52C (Reel 3) to determine that li-zhi lines including ANY7 or higher are made at specific positions (refer to the blocks enclosed with thick lines in FIG. 27 (C-1) and FIG. 27 (C-2)). If this requirement is satisfied, the main CPU 222 selects Table O (Step S16C21) and exits this subroutine.

The determination at Step S16C19 is to determine whether the LINE3 and the LINE4 are li-zhi lines when the reel 52A (Reel 1) and the reel 52C (Reel 3) are stopped.

If the requirement is not satisfied in the determination at Step S16C19 (NO), the main CPU 222 determines whether li-zhi lines including ANY7 or higher are made at specific positions (Step S16C23). Specifically, Step S16C23 is to determine whether a RED7 (2) is positioned at the top row of the reel 52A (Reel 1); a BLUE7 (4) is positioned at the bottom row of the reel 52A (Reel 1); and a BLUE7 (4) is positioned at the top row of the reel 52C (Reel 3) to determine that li-zhi lines including ANY7 or higher are made at specific positions (refer to the blocks enclosed with thick lines in FIG. 28 (A-1) and FIG. 28 (A-2)). If this requirement is satisfied, the main CPU 222 selects Table P (Step S16C25) and exits this subroutine.

The determination at Step S16C23 is to determine whether the LINE1 and the LINE 5 are li-zhi lines when the reel 52A (Reel 1) and the reel 52C (Reel 3) are stopped.

If the requirement is not satisfied in the determination at Step S16C23 (NO), the main CPU 222 determines whether li-zhi lines including ANY7 or higher are made at specific positions (Step S16C27). Specifically, Step S16C27 is to determine whether a RED7 (2) is positioned at the bottom row of the reel 52A (Reel 1); a RED7 (2) is positioned at the top row of the reel 52C (Reel 3); and a BLUE7 (4) is positioned at the bottom row of the reel 52C (Reel 3) to determine that li-zhi lines including ANY7 or higher are made at specific positions (refer to the blocks enclosed with thick lines in FIG. 28 (B-1) and FIG. 28 (B-2)). If this requirement is satisfied, the main CPU 222 selects Table Q (Step S16C29) and exits this subroutine.

The determination at Step S16C27 is to determine whether the LINE3 and the LINE 5 are li-zhi lines when the reel 52A (Reel 1) and the reel 52C (Reel 3) are stopped.

If the requirement is not satisfied in the determination at Step S16C27 (NO), the main CPU 222 determines whether li-zhi lines including ANY7 or higher are made with Reels 1 and 3 (Step S16D11). Specifically, Step S16D11 is to determine whether a BLUE7 (4) is positioned at the top row of the reel 52A (Reel 1); a RED7 (2) is positioned at the top row of the reel 52C (Reel 3); and a BLUE7 (4) is positioned at the bottom row of the reel 52C (Reel 3) to determine that li-zhi lines including ANY7 or higher are made with reels 1 and 3 (refer to the blocks enclosed with thick lines in FIG. 28 (C-1) and FIG. 28 (C-2)). If this requirement is satisfied, the main CPU 222 selects Table R (Step S16D13) and exits this subroutine.

The determination at Step S16D11 is to determine whether the LINE1 and the LINE4 are li-zhi lines when the reel 52A (Reel 1) and the reel 52C (Reel 3) are stopped.

If the requirement is not satisfied in the determination at Step S16D11 (NO), the main CPU 222 determines whether li-zhi lines including ANY7 or higher are made with Reels 1 and 3 (Step S16D15). Specifically, Step S16D15 is to determine whether a RED7 (10) is positioned at the top row of the reel 52A (Reel 1); a RED7 (2) is positioned at the top row of the reel 52C (Reel 3); and a BLUE7 (4) is positioned at the bottom row of the reel 52C (Reel 3) to determine that li-zhi lines including ANY7 or higher are made with Reels 1 and 3 (refer to the blocks enclosed with thick lines in FIG. 29 (A-1) and FIG. 29 (A-2)). If this requirement is satisfied, the main CPU 222 selects Table S (Step S16D17) and exits this subroutine.

The determination at Step S16D15 is to determine whether the LINE1 and the LINE4 are li-zhi lines when the reel 52A (Reel 1) and the reel 52C (Reel 3) are stopped.

If the requirement is not satisfied in the determination at Step S16D15 (NO), the main CPU 222 determines whether a li-zhi line including ANY7 or higher is made with Reels 1 and 2 (Step S16D19). Specifically, Step S16D19 is to determine whether a RED7 (2) is positioned at the top row of the reel 52A (Reel 1) and a RED7 (2) is positioned at the middle row of the reel 52B (Reel 2) to determine that a li-zhi line including ANY7 or higher is made with Reels 1 and 2 (refer to the blocks enclosed with thick lines in FIG. 29 (B-1) and FIG. 29 (B-2)). If this requirement is satisfied, the main CPU 222 selects Table T (Step S16D21) and exits this subroutine.

The determination at Step S16D19 is to determine whether the LINE4 is a li-zhi line when the reel 52A (Reel 1) and the reel 52B (Reel 2) are stopped.

If the requirement is not satisfied in the determination at Step S16D19 (NO), the main CPU 222 determines whether a chance rose is stopped (Step S16D23). Specifically, Step S16D23 is to determine whether the F_ROSE is positioned at the middle row of the reel 52B (Reel 2) (refer to the block enclosed with a thick line in FIG. 29 (C-1) and FIG. 29 (C-2)). If this requirement is satisfied, the main CPU 222 selects Table U (Step S16D25) and exits this subroutine. It should be noted that Step S16D19 is performed when a li-zhi state is not made with Reels 1 and 3 and the later-described Step S16D23 is performed when a li-zhi state is made.

If the requirement is not satisfied in the determination at Step S16D23 (NO), the main CPU 222 determines whether a chance rose is stopped (Step S16D27). Specifically, Step S16D27 is to determine whether the F_ROSE is positioned at the middle row of the reel 52B (Reel 2) (refer to the block enclosed with a thick line in FIG. 30 (A-1) and FIG. 30 (A-2)). If this requirement is satisfied, the main CPU 222 selects Table V (Step S16D29) and exits this subroutine.

If the requirement is not satisfied in the determination at Step S16D27, the main CPU 222 exits this subroutine.

<<Symbol Display Control>>

Figure 17:
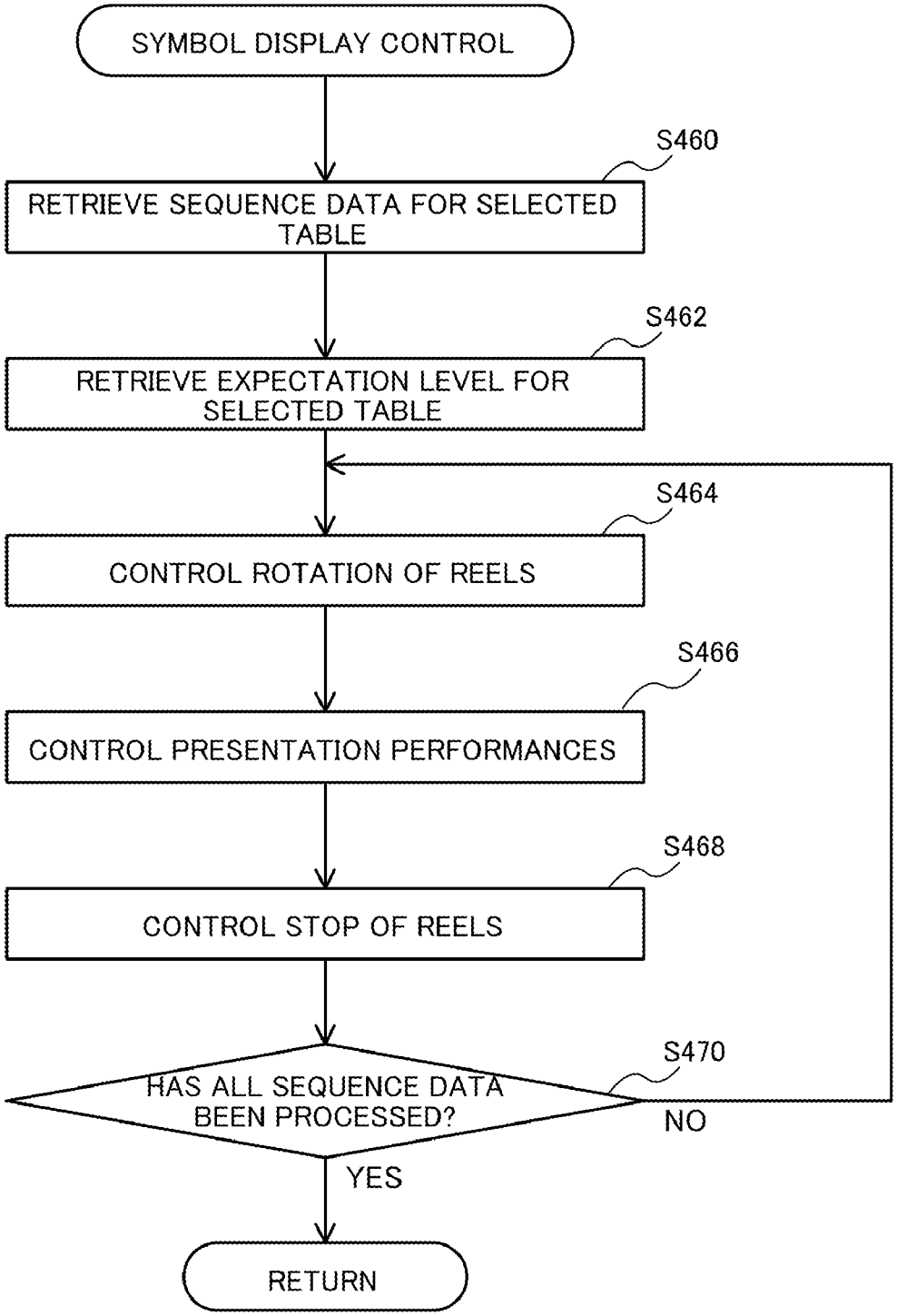
FIG. 17 is a flowchart of a subroutine of symbol display control.

FIG. 17 is a flowchart illustrating a subroutine of symbol display control, which is Step S416 in FIG. 13.

First, the main CPU 222 retrieves sequence data for the reel action defined by the table selected by reel action determination illustrated in FIGS. 16A to 16D from the ROM 224 (Step S460). This sequence data defines the directions of rotation, the speeds of rotation, the times of rotation, the symbols to be stopped temporarily, and the times to stop for the reels 52A (Reel 1), 52B (Reel 2), and 52C (Reel 3).

Next, the main CPU 222 retrieves an expectation level for the table selected by the reel action determination illustrated in FIGS. 16A to 16D (Step S462). The reel action table shown in FIG. 22 defines expectation levels for Table A to Table V. Step S462 is to retrieve the expectation level defined for the selected table in FIG. 22. The retrieved expectation level is used in backlighting in a li-zhi state illustrated in later-described FIG. 21 or in selection of other reel action in a li-zhi state.

Next, the reel control module 308 executed by the main CPU 222 sends a rotation control signal to the reel assembly 50 in accordance with the sequence data retrieved at Step S460; the reel drivers 264 for the first to third reels 52A to 52C supplies power to the reel motors 272 to rotate the first to third reels 52A to 52C. The first to third reels 52A to 52C rotate in the direction of rotation at the speed of rotation for the time of rotation in accordance with the sequence data so that the symbol sequences on the first to third reels 52A to 52C scroll in the display window 56 of the symbol display unit 40 (Step S464).

While the first to third reels 52A to 52C are rotating, the backlight driver 266 supplies power to the lights 282 of the backlight device 280 and the illumination driver 268 supplies power to the lights 292 of the illumination device 290 to produce presentation performances from the behind of the outer surfaces of the reels (Step S466).

Figure 21:
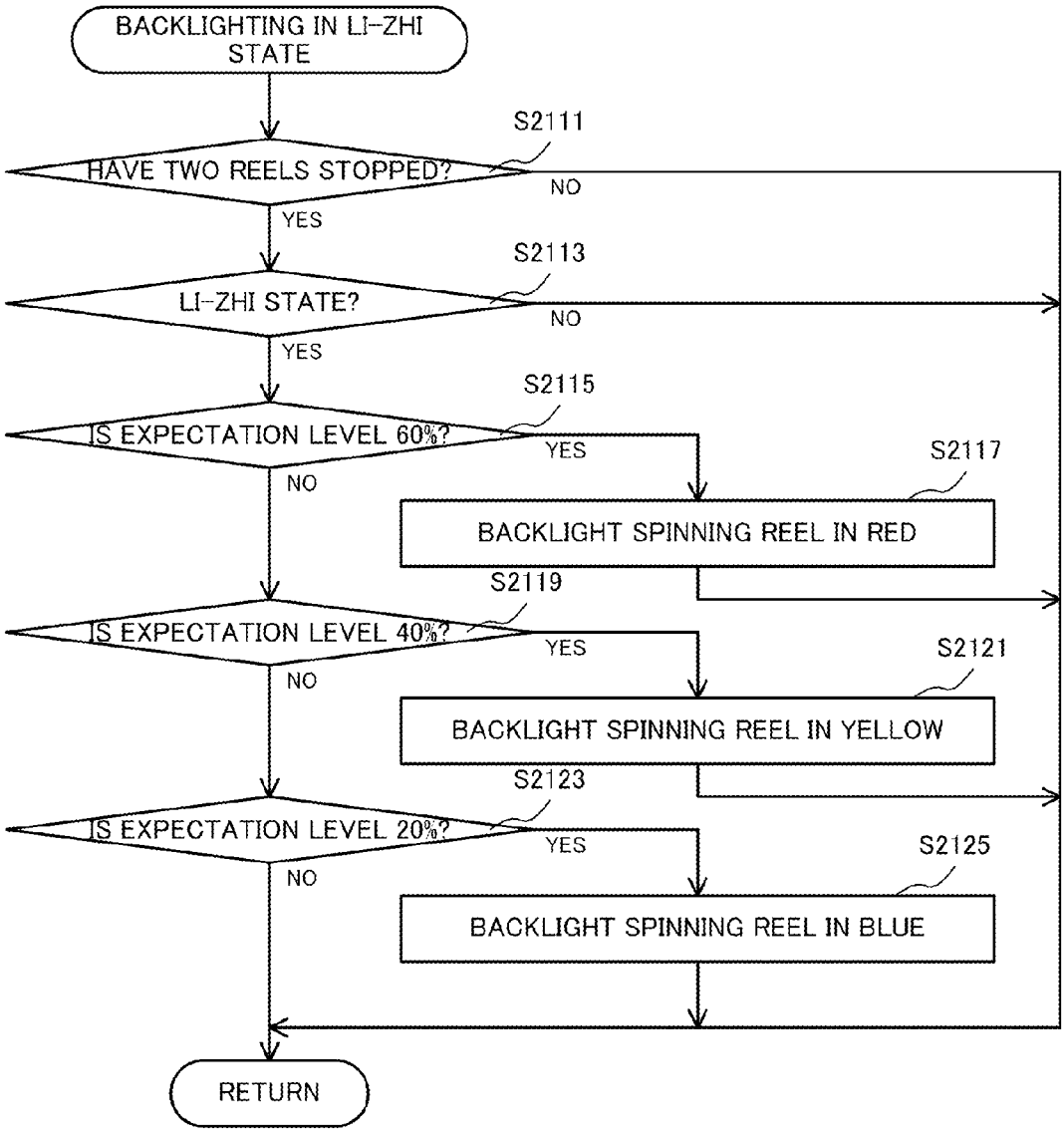
FIG. 21 is a flowchart of a subroutine of backlighting in a li-zhi state.

At Step S466, if in a li-zhi state, the main CPU 222 invokes and executes a subroutine of backlighting in li-zhi state shown in FIG. 21.

The rotation control signal includes information on stop positions for the reels 52A to 52C. The reel drivers 264 for the reels 52A to 52C controls the reel motors 272 so as to stop the reels 52A to 52C at the positions specified by the rotation control signal. The main CPU 222 thus stops the reel motors 272 made of stepping motors at desired positions in the times to stop according to the sequence data (Step S468).

If the operation at Step S468 is for a temporal stop, the main CPU 222 stops scrolling the symbol sequence so that the symbol to be stopped temporarily is positioned at the second row of the symbol matrix formed in the display window 56.

If the operation at Step S468 is for a final stop, the main CPU 222 stops scrolling the symbol sequence so that the symbol to be stopped is positioned at the second row of the symbol matrix formed in the display window 56.

Next, the main CPU 222 determines whether all the sequence data retrieved at Step S460 has been processed (Step S470). If the determination is that all the sequence data has not been processed yet (NO), the main CPU 222 returns to Step S464. This returning to Step S464 allows the main CPU 222 to execute rotation control for rotating the reels 52A to 52C in specified directions at specified speeds for specified times and stop control for stopping the reels 52A to 52C in specified times at least one time each before finally rearranging the symbols to be stopped.

If the determination at Step S470 is that all the sequence data has been processed (YES), the main CPU 222 exits this subroutine.

<<Paying Out>>

Figure 18:
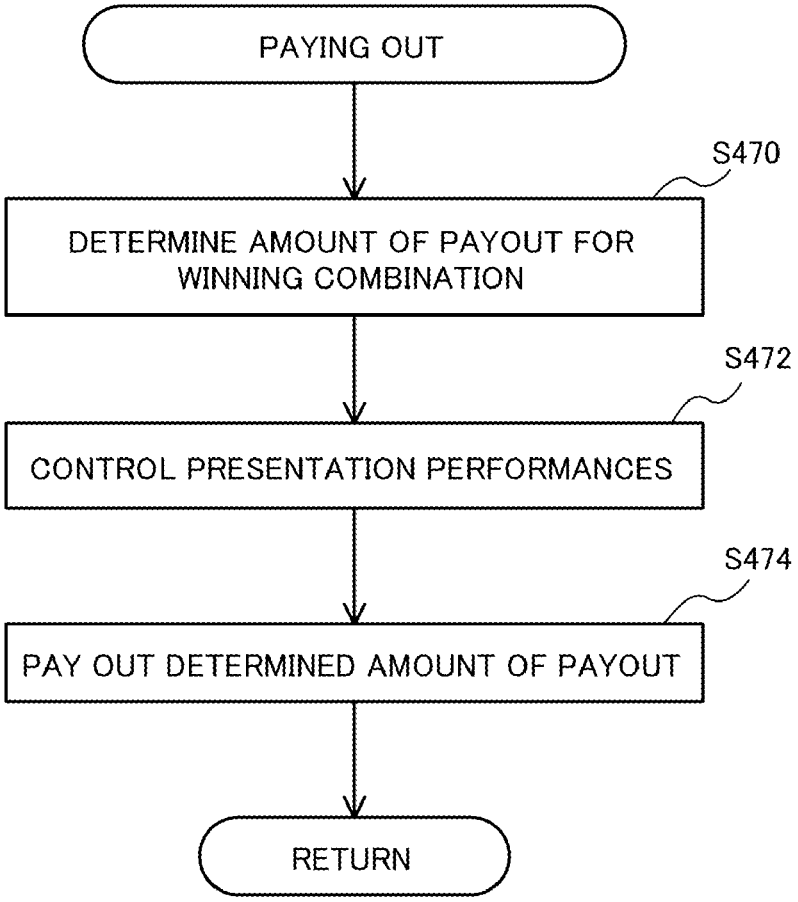
FIG. 18 is a flowchart of a subroutine of paying out.

FIG. 18 is a flowchart illustrating a subroutine of paying out at Step S418 in FIG. 13 in detail.

When a winning combination is completed or when a combination of symbols to win an award are aligned on a payline, the winning determination module 310 or the payout module 314 executed by the main CPU 222 determines the amount of payout in accordance with the winning combination and stores the amount in the RAM 226 (Step S470).

Figure 37:
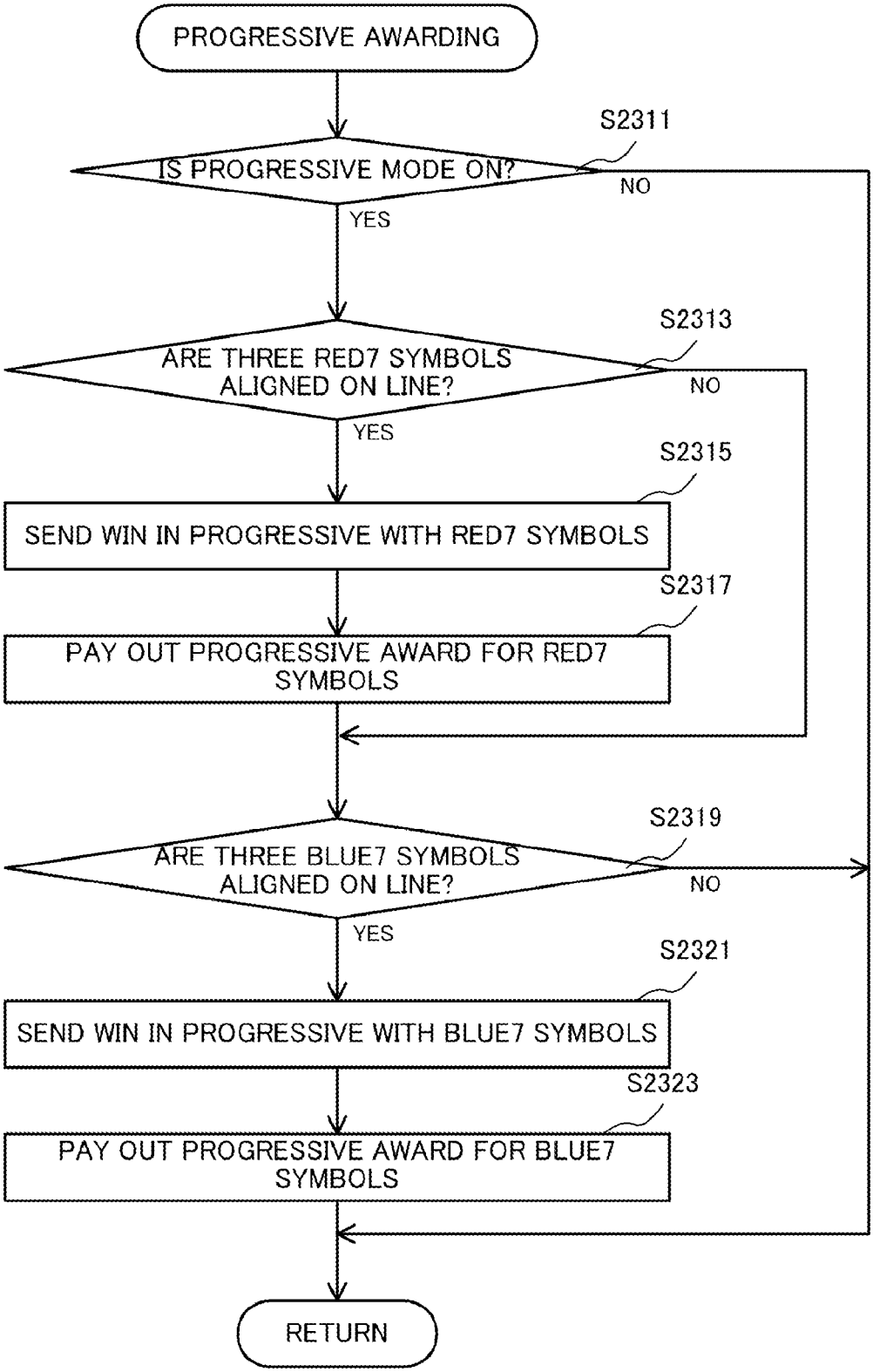
FIG. 37 is a flowchart illustrating a subroutine of progressive awarding.

At this Step S470, the main CPU 222 executes progressive awarding shown in FIG. 37, too. The progressive awarding will be described later.

As soon as the reels 52A to 52C stop, the presentation performance control module 312 executed by the main CPU 222 controls the symbol display unit 40 and other devices, such as the speakers 112, the lamp 114, and the video display unit 110 to produce presentation performances (Step S472). The presentation performances include performances by video, audio, change in backlight, and illumination.

Thereafter, the payout module 314 pays out the determined amount by increasing the credit or ejecting coins to the coin tray 92 (Step S474).

<Chance Mode Game Execution>

Figure 19:
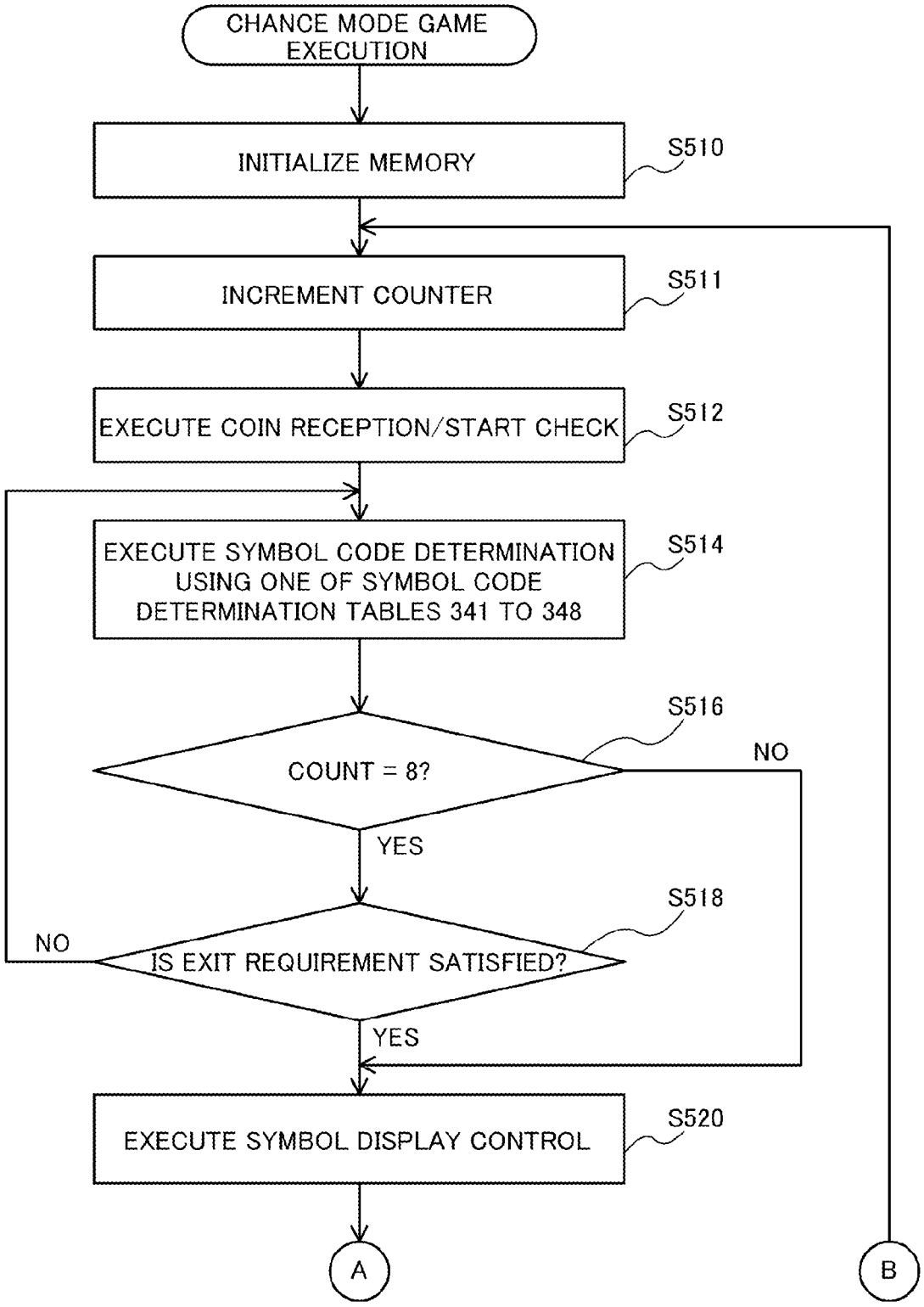
FIG. 19 is a flowchart of a subroutine of chance mode game execution.
Figure 20:
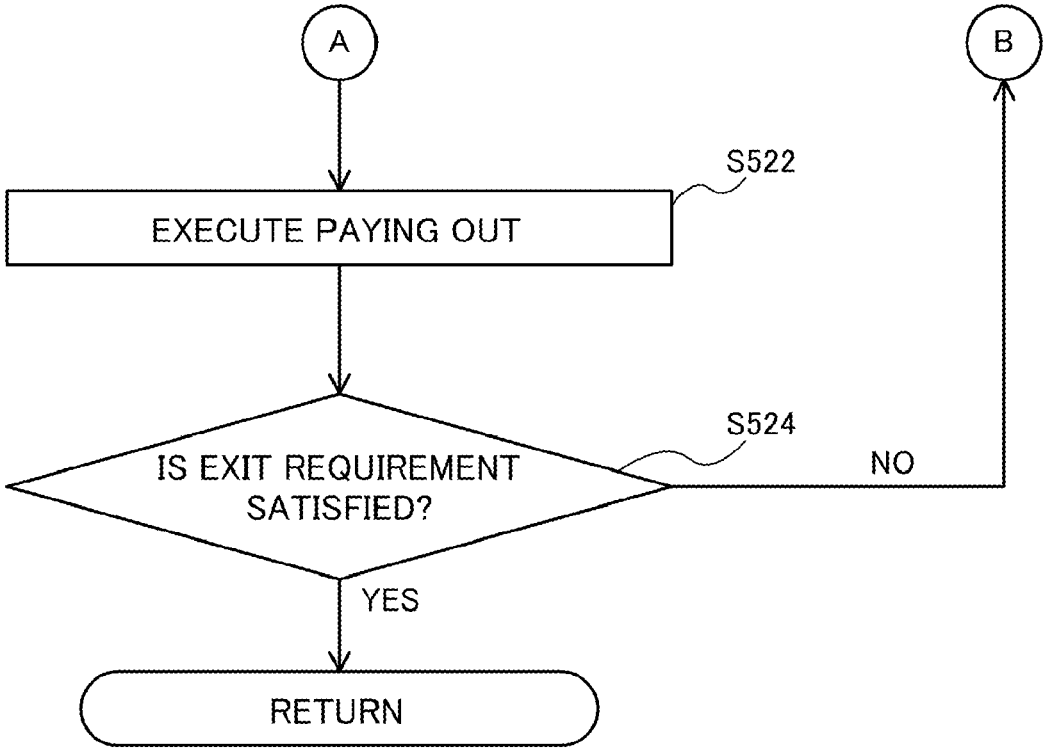
FIG. 20 is a flowchart of a subroutine of chance mode game execution.

FIGS. 19 and 20 illustrate chance mode game execution (Step S408) together with exit requirement determination (Step S409) in FIG. 12 in detail.

As soon as switched to a chance mode, the main CPU 222 first initializes the memory (Step S510). The main CPU 222 clears unnecessary data and information from the temporal working space of the RAM 226. The unnecessary data and information are, for example, payout data, information indicating winning or losing, and information on symbols to be stopped determined in the previous unit game.

Next at Step S511, the main CPU 222 increments the game counter indicating the serial number of the chance mode game to be executed. Since the game counter has been reset to 0, the game counter is set at 1 in the initial (first) chance mode game.

Next, the main CPU 222 executes coin reception/start check (Step S512). At this step, the main CPU 222 checks whether any coin or bill has been received and detects an input signal from one of the BET buttons 74 to 78 or the START button 79.

When the START button 79 is pressed by the player, the main CPU 222 executes symbol determination (Step S514). At this step, the main CPU 222 first generates three random numbers. Next, the symbol determination module 304 executed by the main CPU 222 refers to one of the first to eighth symbol code determination tables 341 to 348 with the first to third random numbers to determine the first to third symbol codes. When the initial (first) chance mode game is being executed, the symbol code determination table 341 is used to determine the symbol codes. When the second chance mode game is being executed, the symbol code determination table 342 is used to determine the symbol codes. In similar, when another chance mode game is being executed, one of the symbol code determination tables 343 to 348 selected in accordance with the order of games is used to determine the symbol codes.

Next, the main CPU 222 determines the first to third symbols to be stopped corresponding to the first to third symbol codes with reference to the symbol code table shown in FIG. 8. As a result, three symbols to be stopped are determined by using three random numbers. In determining the first to third symbols to be stopped, the main CPU 222 stores the symbols or symbol codes in the RAM 226.

Next, the winning determination module 310 executed by the main CPU 222 determines whether a specific winning combination is completed with the rearranged symbols. If a winning combination is completed with the rearranged symbols, the winning determination module 310 stores the winning combination in the RAM 226.

The main CPU 222 checks whether the game count 324 has reached 8 (step S516). This value of the game count 324 indicates that the last (eighth) chance mode game is being executed. If the determination is that the game count has reached 8, the main CPU 222 determines whether the exit requirement is satisfied (Step S518). One exit requirement is that at least one RED7 symbol appears; at least one BLUE7 symbol appears; or three ANY7's are aligned on a payline. The other exit requirement is that a ROSE symbol (normal ROSE symbol) appears in the display window 56.

If the exit requirement is not satisfied when the game count 324 has reached 8, the main CPU 222 returns to Step S514 to execute Step S514 again. As a result, Step S518 leads at least one RED7 symbol to appear, at least one BLUE7 symbol to appear, or three ANY7's to be aligned on one of the paylines. Alternatively, it leads the F_ROSE symbol to appear on one of the paylines.

If the determination at Step S516 is that the value of the game count 324 has not reached 8 yet or if the determination at Step S518 is that the exit requirement is satisfied, the main CPU 222 proceeds to Step S520.

The main CPU 222 controls the reel assembly 50 to stop the spinning of the reels 52A to 52C by executing symbol display control (Step S520). The main CPU 222 stops the scrolling of the symbols in accordance with the result of the symbol determination and rearranges the symbols to form a symbol matrix in the display window 56. The main CPU 222 executes paying out to determine the amount of payout and provides the determined amount of payout to the player (Step S522).

The main CPU 222 determines again whether the exit requirement is satisfied (Step S524). If the exit requirement is satisfied, the main CPU 222 terminates the execution of chance mode game. If the determination at Step S524 is that the exit requirement is not satisfied, the main CPU 222 return to Step S511, increments the game count 324, maintains the chance mode to execute the next unit game in the chance mode.

As described above, the chance mode game is repeated until at least one RED7 symbol appears, at least one BLUE7 symbol appears, three ANY7's are aligned on a payline, or a ROSE symbol appears on a payline. If chance mode games have been executed for the predetermined maximum times, the main CPU 222 can lead the exit requirement to be definitely satisfied.

When the game mode is a chance mode, the player can be notified of it through presentation performances by image and/or sound. Presentation performances can be produced by, for example, showing a word CHANCE by the video display unit 110, the display panel 58 of the symbol display unit 40, or other device, tuning the backlight brighter or darker than in the normal mode, tuning the operation sound of the START button 79 louder, and adjusting sound intervals in stopping reels shorter.

<Backlighting in Li-Zhi State>

FIG. 21 is a flowchart illustrating a subroutine of backlighting in a li-zhi state invoked at Step S466 in FIG. 17.

First, the main CPU 222 determines whether two of the first to third reels 52A to 52C have stopped (Step S2111). If the determination is that two reels have not stopped yet (NO) (refer to FIGS. 32A and 32B or FIGS. 35A and 35B), the main CPU 222 terminates this subroutine.

If the determination is that two of the reels have stopped (YES) (refer to FIG. 32C or FIG. 35C), the main CPU 222 further determines whether a li-zhi state has been made with the symbols on the stopped two reels (Step S2113). If the determination is that a li-zhi state is not made (NO), the main CPU 222 terminates this subroutine.

Figure 32D:
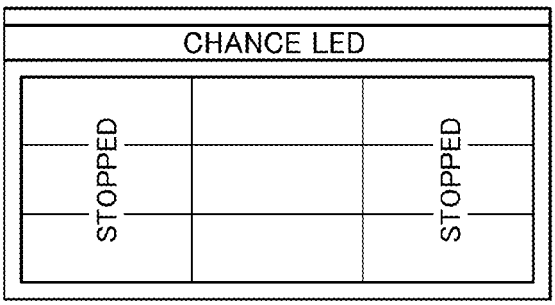
Figure 33:
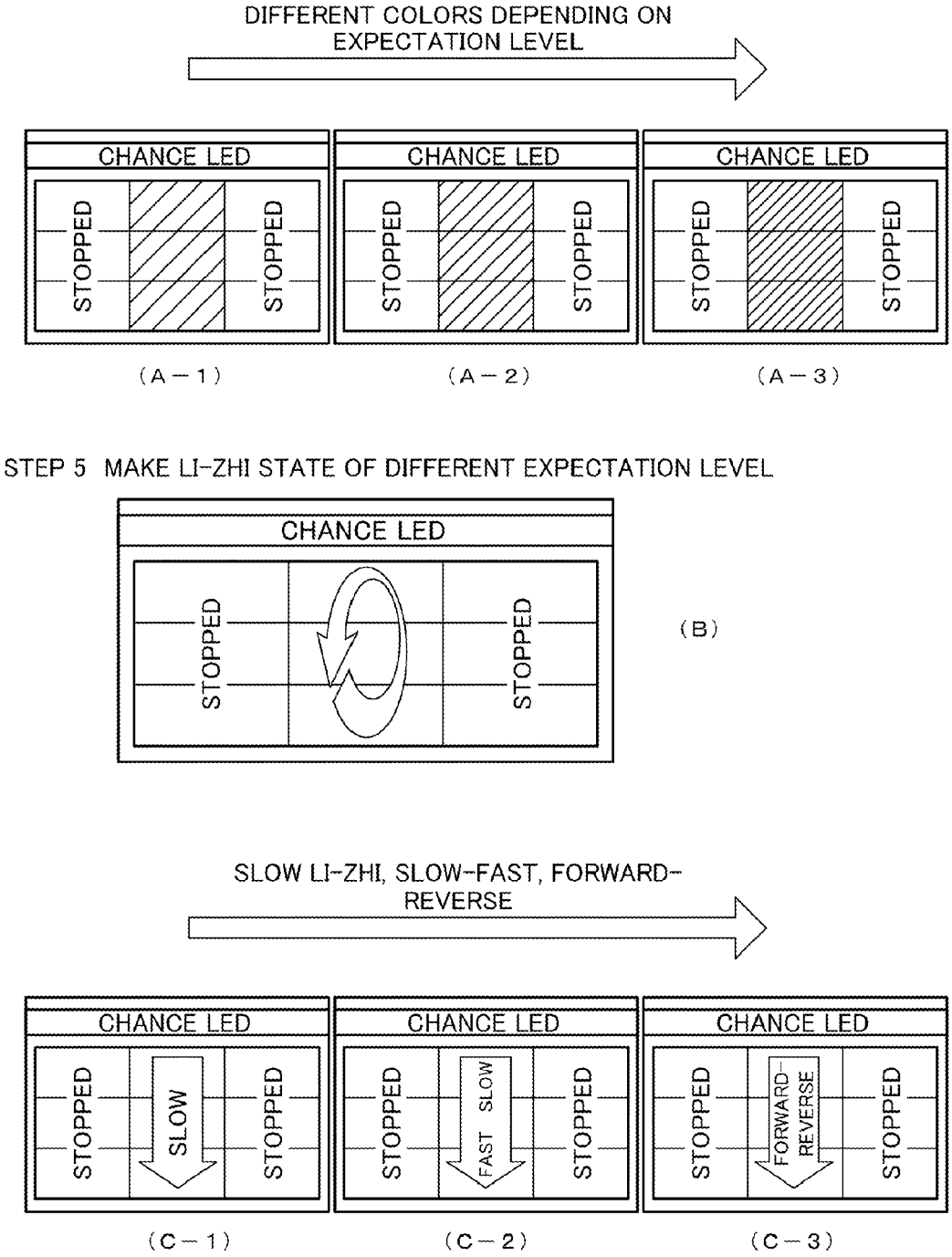
FIG. 33 is a diagram illustrating various ways of notification when making a li-zhi state.
Figure 35D:
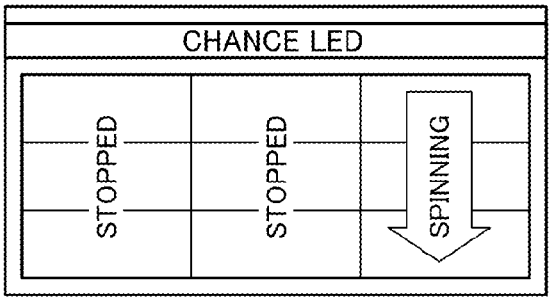
Figure 36:
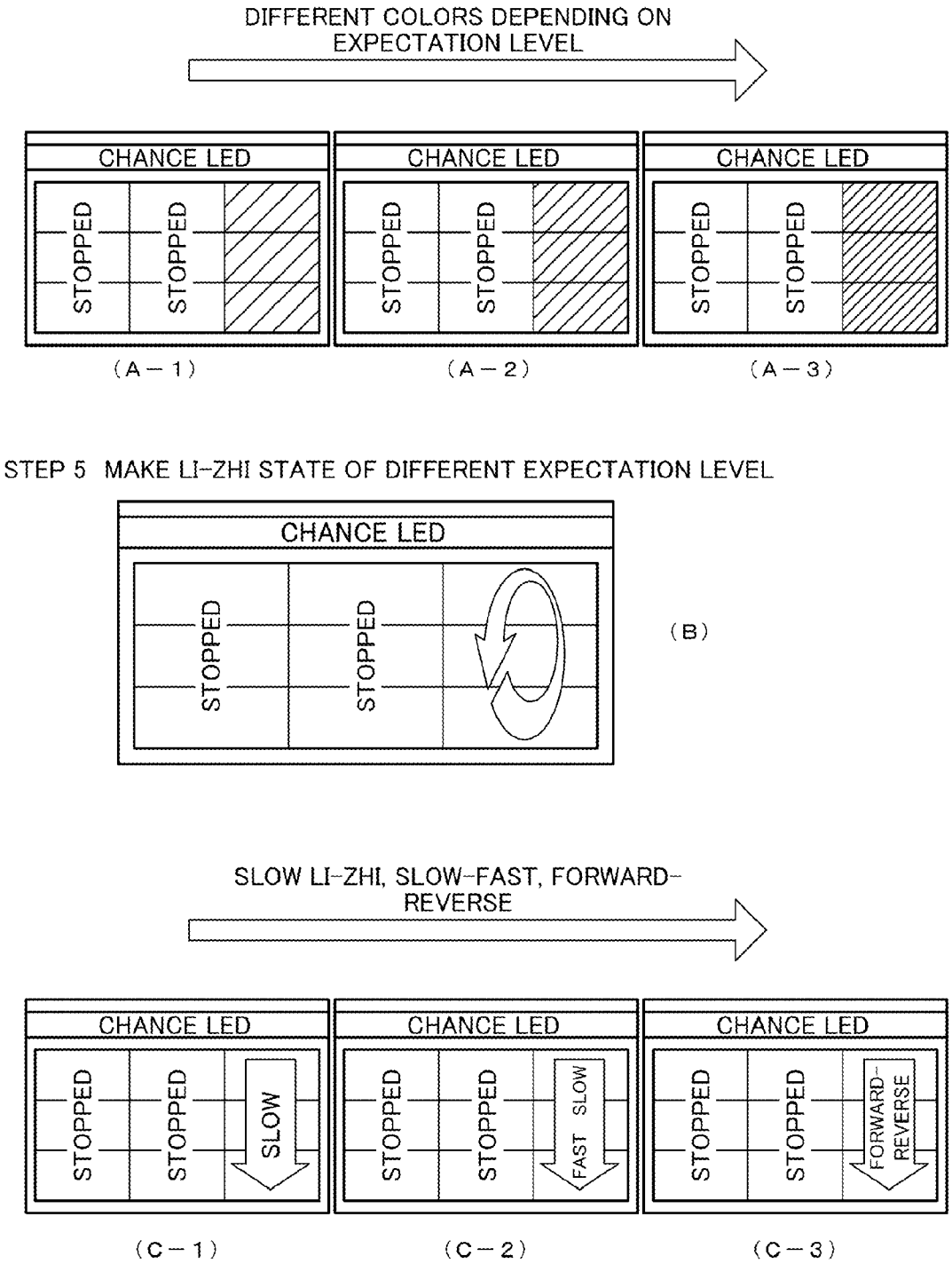
FIG. 36 is a diagram illustrating various ways of notification when making a li-zhi state.

If the determination is that the li-zhi state has been made (YES), the main CPU 222 further determines whether the expectation level for a winning combination at the final rearrangement of the symbols is 60% or more (Step S2115). The expectation level is a value retrieved at Step S462 in FIG. 17 of the processing of symbol display control. If the determination is that the expectation level is 60% or more (YES), the main CPU 222 backlights the spinning reel in red (Step S2117) (refer to FIG. 32D, FIG. 33 (A-3), FIG. 35D, or FIG. 36 (A-3)) and terminates this subroutine.

If the determination at Step S2115 is that the expectation level is lower than 60% (NO), the main CPU 222 further determines whether the expectation level for a winning combination at the final rearrangement of the symbols is 40% or more (Step S2119). If the determination is that the expectation level is 40% or more (YES), the main CPU 222 backlights the spinning reel in yellow (Step S2121) (refer to FIG. 32D, FIG. 33 (A-2), FIG. 35D, or FIG. 36 (A-2)) and terminates this subroutine.

If the determination at Step S2121 is that the expectation level is lower than 40% (NO), the main CPU 222 further determines whether the expectation level for a winning combination at the final rearrangement of the symbols is 20% or more (Step S2123). If the determination is that the expectation level is 20% or more (YES), the main CPU 222 backlights the spinning reel in blue (Step S2125) (refer to FIG. 32D, FIG. 33 (A-1), FIG. 35D, or FIG. 36 (A-1)) and terminates this subroutine.

If the determination at Step S2123 is that the expectation level is lower than 20% (NO), the main CPU 222 terminates this subroutine, which maintains the backlight off In this way, when a li-zhi state is made, the player can be informed of expectation level by the color of backlight. The expectation level is a degree indicating the possibility of completion of a winning combination with the symbols finally rearranged in the display window 56.

<Reel Action Table>

FIG. 22 illustrates a reel action table. In this embodiment, the reel action table consists of Table A to Table V.

Table A to Table V shown in FIG. 22 each define performance combinations 0 to 48 and probability information for these performance combinations 0 to 48. Probability information defines difficulties for selecting performance combinations 0 to 48 in each of Table A to Table V. Through the reel action determination in FIGS. 16A to 16D, one of Table A to Table V is selected depending on the symbol to be stopped determined at Step S454 in FIG. 15. Then, one of the performance combinations 0 to 48 is selected using the probability information in the determined table. Thus, reel actions for the three reels 52A to 52C in the unit game are determined For each of the performance combinations 0 to 48 in FIG. 22, sequence data is defined (not shown). The sequence data defines information on motion of reels, such as the direction of rotation, the time of rotation, the speed of rotation, the symbol to be stopped temporarily, and the time of temporary stop, for three reels 52A to 52C. The symbol display control illustrated in FIG. 17 using this sequence data enables the three reels 52A to 52C to perform various reel actions.

As shown in FIG. 22, Tables A to V each define probabilities for selecting one of the performance combinations 0 to 48. One of the Tables A to V is selected through the reel action determination in FIGS. 16A to 16D and one of the performance combinations 0 to 48 is selected using the determined table to determine the reel action.

The performance combinations shown in FIG. 22 include Normal Spin, 3REEL_Slow Li-zhiLevel1, 3REEL_Slow-Fast_Level1_step1, 3REEL_Forward-Reverse_Level1_step1, 2REEL_Slow Li-zhi_Level1, 2REEL_Slow-Fast_Level1_step1, 2REEL_Forward-Reverse_Level1_step1, 2REEL_Slow Li-zhiNudge_1, 2REEL_Slow-Fast_Nudge_1, 2REEL_Forward-Reverse_Nudge_1, 1_3REEL_premium_1, 1_3REEL_premium_2, All Slow Spin, Fast Stop Together, Premium 1, and Premium 2.

The Normal Spin is a reel action to rotate three reels at a normal rotation speed. The 3REEL_Slow Li-zhi_Level1 is a reel action in a li-zhi state to rotate the spinning reel at a low speed and stop it after a predetermined time. The 3REEL_Slow-Fast_Level1_step1 is a reel action in a li-zhi state to rotate the spinning reel at a high speed for a predetermined time, rotate it at a low speed, and then stop it. The 3REEL_Forward-Reverse_Level1_step1 is a reel action in a li-zhi state to reversely rotate the spinning reel by a predetermined number of symbol frames, rotate it forward at a predetermined speed for a predetermined time, and then stop it.

The 2REEL_Slow Li-zhi_Level1 is a reel action in a li-zhi state to rotate the spinning reel at a low speed and stop it after a predetermined time. The 2REEL_Slow-FastLevel1_step1 is a reel action in a li-zhi state to rotate the spinning reel at a high speed for a predetermined time, rotate it at a low speed, and then stop it. The 2REEL_Forward-Reverse_Level1_step1 is a reel action in a li-zhi state to reversely rotate the spinning reel by a predetermined number of symbol frames, rotate it forward at a predetermined speed for a predetermined time, and then stop it.

The 2REEL_Slow Li-zhi_Nudge_1 is a reel action in a li-zhi state to nudge the stopped reels to make a double li-zhi state, rotate the spinning reel at a low speed for a predetermined time, and then stop it. The 2REEL_Slow-Fast_Nudge_1 is a reel action in a li-zhi state to nudge the stopped reels to make a double li-zhi state, rotate the spinning reel at a high speed for a predetermined time, rotate it at a low speed, and then stop it. The 2REEL_Forward-Reverse_Nudge_1 is a reel action in a li-zhi state to nudge the stopped reels to make a double li-zhi state, reversely rotate the spinning reel for a predetermined time, and then stop it.

The 1_3REEL_premium_1 is a reel action to rotate the reels in a special manner. The 1_3REEL_premium_2 is a reel action to rotate the reels in another special manner. The All Slow Spin is a reel action to rotate the three reels at a low speed. The Fast Stop Together is a reel action to rotate the three reels at a high speed for a predetermined time and stop the three reels all together. The Premium 1 is a reel action to rotate the reels in a special manner. The Premium 2 is a reel action to rotate the reels in another special manner.

<Double Li-Zhi State>

The 2REEL_Slow Li-zhi_Nudge_1 shown as No. 31 in the performance combinations in FIG. 22 is a reel action in a li-zhi state to nudge the stopped two reels to make a double li-zhi state, rotate the spinning reel at a low speed for a predetermined time, and then stop it. The 2REEL_Slow-Fast_Nudge_1 shown as No. 35 in the performance combinations in FIG. 22 is a reel action in a li-zhi state to nudge the stopped two reels to make a double li-zhi state, rotate the spinning reel at a high speed for a predetermined time, rotate it at a low speed, and then stop it. The 2REEL_Forward-Reverse_Nudge_1 shown as No. 39 in the performance combinations in FIG. 22 is a reel action in a li-zhi state to nudge the stopped reels to make a double li-zhi state, reversely rotate the spinning reel for a predetermined time, and then stop it.

The aforementioned 2REEL_Slow Li-zhi_Nudge_1, 2REEL_Slow-Fast_Nudge_1, and 2REEL_Forward-Reverse_Nudge_1 are reel actions to make a double li-zhi state. Hereinafter, these reel actions to make a double li-zhi state are described.

As shown in FIG. 31A, after start of a unit game, all the three reels 52A to 52C are spinning. After a predetermined time period, the left reel 52A and the right reel 52C stop and the symbols "7" to be stopped temporarily appear along LINE2 to make a li-zhi state (FIG. 31B). Specifically, a RED7 of the symbol code 2 or a BLUE7 of the symbol code 4 on the reel 52A (Reel 1) appears on the middle row as a symbol to be stopped temporarily and a RED7 of the symbol code 2 or a BLUE7 of the symbol code 4 on the reel 52C (Reel 3) appears on the middle row as a symbol to be stopped temporarily to make a li-zhi state along LINE2.

More specifically, on the middle row of the reel 52A (Reel 1) and the middle row of the reel 52C (Reel 3), RED7 (2)-RED7 (2), RED7 (2)-BLUE7 (4), BLUE7 (4)-RED (2), or BLUE7 (4)-BLUE7 (4) appears to make a li-zhi state. Here, the numerical values in the parenthesis are symbol codes. One of these combinations forms a li-zhi line. Under this li-zhi state, the center reel 52B is spinning at a predetermined rotation speed.

After a predetermined time period, the main CPU 222 nudges the reels 52A (Reel 1) and 52C (Reel 3) before stopping them again to make a double li-zhi state (FIG. 31C). That is to say, a li-zhi state is made along LINE1 and another li-zhi state is made along LINE3.

For example, if a li-zhi state with RED7 (2)-RED7 (2) is made along LINE2, the main CPU 222 nudges both of the reels 52A (Reel 1) and 52C (Reel 3) upward by one symbol frame (reel nudge combination No. 3 in FIG. 31D). This action makes a li-zhi state with RED7 (2)-RED7 (2) along LINE1 and another li-zhi state with BLUE7 (4)-BLUE7 (4) along LINE3.

If a li-zhi state with RED7 (2)-BLUE7 (4) is made along LINE2, the main CPU 222 nudges the reel 52A (Reel 1) upward by one symbol frame and nudges the reel 52C (Reel 3) downward by one symbol frame (reel nudge combination No. 1 in FIG. 31D). This action makes a li-zhi state with RED7 (2)-RED7 (2) along LINE1 and another li-zhi state with BLUE7 (4)-BLUE7 (4) along LINE3.

If a li-zhi state with BLUE7 (4)-RED7 (2) is made along LINE2, the main CPU 222 nudges the reel 52A (Reel 1) downward by one symbol frame and nudges the reel 52C (Reel 3) upward by one symbol frame (reel nudge combination No. 2 in FIG. 31D). This action makes a li-zhi state with RED7 (2)-RED7 (2) along LINE1 and another li-zhi state with BLUE7 (4)-BLUE7 (4) along LINE3.

If a li-zhi state with BLUE7 (4)-BLUE7 (4) is made along LINE2, the main CPU 222 nudges both of the reels 52A (Reel 1) and 52C (Reel 3) downward by one symbol frame (reel nudge combination No. 4 in FIG. 31D). This action makes a li-zhi state with RED7 (2)-RED7 (2) along LINE1 and another li-zhi state with BLUE7 (4)-BLUE7 (4) along LINE3.

As described above, in the case of 2REEL_Slow Li-zhi_Nudge_1, after making a double li-zhi state, the main CPU 222 rotates the spinning reel (reel 52B (Reel 2) at a low speed for a predetermined period and stops it. Thus, the main CPU 222 shows the symbols to be stopped in the symbol matrix of three rows and three columns in the display window 56 to complete rearranging of the symbols.

In the case of 2REEL_Slow-Fast_Nudge_1, after making a double li-zhi state, the main CPU 222 rotates the spinning reel (reel 52B (Reel 2) at a high speed for a predetermined time, rotates it at a low speed, and then stops it. Thus, the main CPU 222 shows the symbols to be stopped in the symbol matrix of three rows and three columns in the display window 56 to complete rearranging of the symbols.

In the case of 2REEL_Forward-Reverse_Nudge_1, after making a double li-zhi state, the main CPU 222 rotates the spinning reel (Reel 52B (Reel 2) in a reverse direction for a predetermined time, and then stops it. Thus, the main CPU 222 shows the symbols to be stopped in the symbol matrix of three rows and three columns in the display window 56 to complete rearranging of the symbols.

<Reel Action in Li-Zhi State>

The processing illustrated in FIG. 21 produces presentation performances by informing the player of the expectation level by the color of backlight. The expectation level when a li-zhi state is made can be recognized through reel action instead of a component such as a backlight. The following description explains various reel actions in a li-zhi state. These reel actions can inform the player of expectation levels (FIGS. 33(B) and 36(B)).

The aforementioned six performance combinations, 3REEL_Slow Li-zhi_Level1, 3REEL_Slow-FastLevel1_step1, 3REEL_Forward-Reverse_Level1_step1, 2REEL_Slow Li-zhi_Level1, 2REEL_Slow-Fast_Level1_step1, and 2REEL_Forward-Reverse_Level1_step1 define reel actions in a li-zhi state. The explanation is provided as follows.

The 3REEL_Slow Li-zhi_Level1 of performance combination No. 1 in FIG. 22 is a reel action in a li-zhi state to rotate the spinning reel at a low speed for a predetermined period and stop it. When this performance combination is selected through the processing of FIGS. 16A to 16D, the following rotation control and stop control are performed through the processing of FIG. 17 in accordance with the sequence data.

Figure 32A:
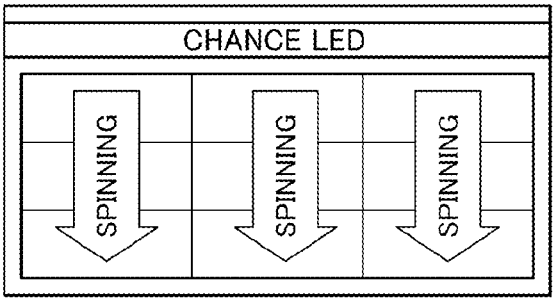
FIGS. 32A to 32D are diagrams illustrating reel actions when making a li-zhi state.
Figure 32B:
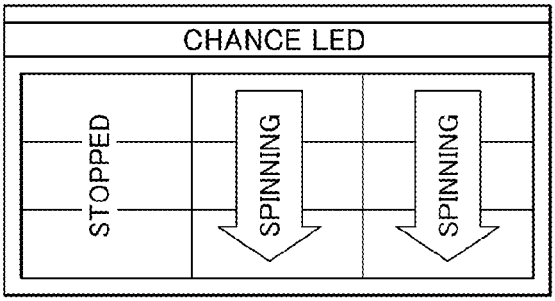
Figure 32C:
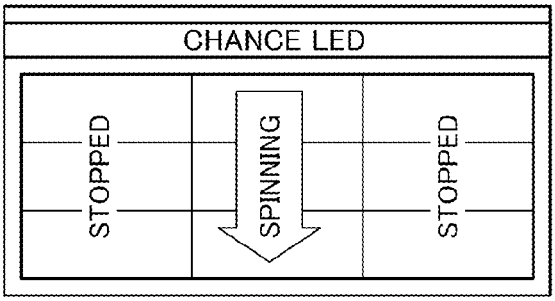

After spinning three reels 52A (Reel 1), 52B (Reel 2), and 52C (Reel 3) at a predetermined speed for a predetermined time (refer to FIG. 32A), the main CPU 222 successively stops the reels 52A and 52C (refer to FIGS. 32B and 32C). If a li-zhi state is made when the reels 52A and 52C are stopped (refer to FIG. 32C), the main CPU 222 changes the rotation speed of the spinning reel 52B to a low speed (refer to FIG. 33 (C-1)), rotates the reel 52B for a predetermined time at the low speed, and then stops the reel 52B.

The 3REEL_Slow-Fast_Level1_step1 of performance combination No. 4 in FIG. 22 is a reel action in a li-zhi state to rotate the spinning reel at a high speed for a predetermined time, rotate it at a low speed, and then stop it. When this performance combination is selected through the processing of FIGS. 16A to 16D, the following rotation control and stop control are performed through the processing of FIG. 17 in accordance with the sequence data.

After spinning three reels 52A (Reel 1), 52B (Reel 2), and 52C (Reel 3) at a predetermined speed for a predetermined time period (refer to FIG. 32A), the main CPU 222 successively stops the reels 52A and 52C (refer to FIGS. 32B and 32C). If a li-zhi state is made when the reels 52A and 52C stop (refer to FIG. 32C), it changes the rotation speed of the spinning reel 52B to a high speed (refer to FIG. 33 (C-2)), rotates the reel 52B for a predetermined time at the high speed, changes the rotation speed of the reel 52B to a low speed (refer to FIG. 33 (C-2)), rotates the reel 52B for a predetermined time at the low speed, and then stops the reel 52B.

The 3REEL_Forward-Reverse_Level1_step1 of a performance combination No. 10 in FIG. 22 is a reel action in a li-zhi state to rotate the spinning reel in a reverse direction by a predetermined number of symbol frames, rotate it forward at a predetermined speed for a predetermined time, and then stop it. When this performance combination is selected through the processing of FIGS. 16A to 16D, the following rotation control and stop control are performed through the processing of FIG. 17 in accordance with the sequence data.

After spinning three reels 52A (Reel 1), 52B (Reel 2), and 52C (Reel 3) at a predetermined speed for a predetermined time period (refer to FIG. 32A), the main CPU 222 successively stops the reels 52A and 52C (refer to FIGS. 32B and 32C). If a li-zhi state is made when the reels 52A and 52C are stopped (refer to FIG. 32C), the main CPU 222 stops the spinning reel 52B for a moment and rotates the reel 52B in a reverse direction by a predetermined number of symbol frames. Then, it rotates the reel 52B forward at a predetermined speed for a predetermined time (refer to FIG. 33 (C-3)) and then stops the reel 52B.

The 2REEL_Slow Li-zhi_Level1 of a performance combination No. 16 in FIG. 22 is a reel action in a li-zhi state to rotate the spinning reel at a low speed for a predetermined time and stop it. When this performance combination is selected through the processing of FIGS. 16A to 16D, the following rotation control and stop control are performed through the processing of FIG. 17 in accordance with the sequence data.

Figure 35A:
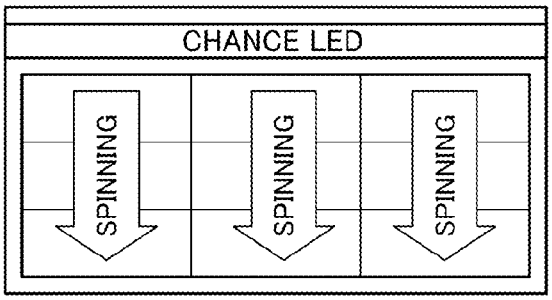
FIGS. 35A to 35D are diagrams illustrating reel actions when making a li-zhi state.
Figure 35B:
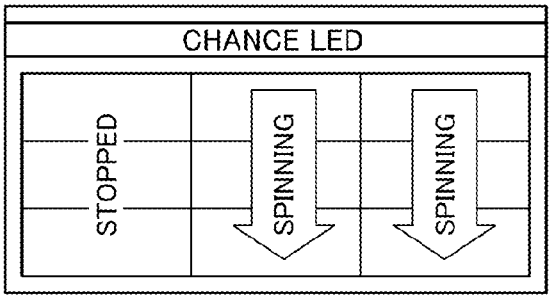
Figure 35C:
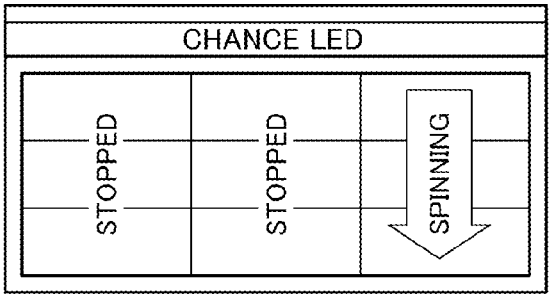

After spinning three reels 52A (Reel 1), 52B (Reel 2), and 52C (Reel 3) at a predetermined speed for a predetermined time period (refer to FIG. 35A), the main CPU 222 successively stops the reels 52A and 52B (refer to FIGS. 35B and 35C). If a li-zhi state is made when the reels 52A and 52B are stopped (refer to FIG. 35C), the main CPU 222 changes the rotation speed of the spinning reel 52C to a low speed (refer to FIG. 36 (C-1)), rotates the reel 52C at the low speed for a predetermined time, and then stops the reel 52C.

The 2REEL_Slow-Fast_Level1_step1 of a performance combination No. 19 in FIG. 22 is a reel action in a li-zhi state to rotate the spinning reel at a high speed for a predetermined time, rotate it at a low speed, and then stop it. When this performance combination is selected through the processing of FIGS. 16A to 16D, the following rotation control and stop control are performed through the processing of FIG. 17 in accordance with the sequence data.

After spinning three reels 52A (Reel 1), 52B (Reel 2), and 52C (Reel 3) at a predetermined speed for a predetermined time period (refer to FIG. 35A), the main CPU 222 successively stops the reels 52A and 52B (refer to FIGS. 35B and 35C). If a li-zhi state is made when the reels 52A and 52B are stopped (refer to FIG. 35C), the main CPU 222 changes the rotation speed of the spinning reel 52C to a high speed (refer to FIG. 36 (C-2)), rotates the reel 52C at the high speed for a predetermined time, changes the rotation speed of the reel 52C to a low speed (refer to FIG. 36 (C-2)), rotates the reel 52C at the low speed for a predetermined period, and then stops the reel 52C.

The 2REEL_Forward-Reverse_Level1_step1 of a performance combination No. 25 in FIG. 22 is a reel action in a li-zhi state to rotate the spinning reel in a reverse direction by a predetermined number of symbol frames, rotate it forward at a predetermined speed for a predetermined time, and then stop it. When this performance combination is selected through the processing of FIGS. 16A to 16D, the following rotation control and stop control are performed through the processing of FIG. 17 in accordance with the sequence data.

After spinning three reels 52A (Reel 1), 52B (Reel 2), and 52C (Reel 3) at a predetermined speed for a predetermined time period (refer to FIG. 35A), the main CPU 222 successively stops the reels 52A and 52B (refer to FIGS. 35B and 35C). If a li-zhi state is made when the reels 52A and 52B are stopped (refer to FIG. 35C), the main CPU 222 stops the spinning reel 52C for a moment and rotates the reel 52C in a reverse direction by a predetermined number of symbol frames. Then, it rotates the reel 52C forward at a predetermined speed for a predetermined time (refer to FIG. 36 (C-3)) and then stops the reel 52C.

As described above, the reel action table shown in FIG. 22 defines probability information for performance combinations 0 to 48 in each of the Table A to Table V. This probability information determines the selectabilities of performance combinations 0 to 48. Accordingly, configuring the probability information in the reel action table so as to be consistent with the expectation levels enables notification of the expectation level to the player based on the selected performance combination.

For example, the 3REEL_Slow-Fast_Level1_step1 can be defined to have a higher expectation level than the 3REEL_Slow li-zhi_Level1, and the 3REEL_Forward-Reverse_Level1_step1 can be defined to have a higher expectation level than the 3REEL_Slow-Fast_Level1_step1. Accordingly, when the reels 52A and 52C are stopped to make a li-zhi state, the reel action that rotates a spinning reel at a high speed for a predetermined time, rotates the reel at a low speed, and then stop it can be defined to have a higher expectation level than the reel action that rotates the spinning reel at a low speed for a predetermined time and stop it (refer to FIG. 33 (C-1) and FIG. 33 (C-2)). Furthermore, the reel action that rotates a spinning reel in the reverse direction by a predetermined number of symbol frames, rotates it forward at a predetermined speed for a predetermined time, and then stop it can be defined to have a higher expectation level than the reel action that rotates a spinning reel at a high speed for a predetermined time, rotates the reel at a low speed, and then stop it (refer to FIG. 33 (C-2) and FIG. 33 (C-3)).

In another example, the 2REEL_Slow-Fast_Level1_step1 can be defined to have a higher expectation level than the 2REEL_Slow li-zhi_Level1 and the 2REEL_Forward-Reverse_Level1_step1 can be defined to have a higher expectation level than the 2REEL_Slow-Fast_Level1_step1. Accordingly, when the reels 52A and 52B are stopped to make a li-zhi state, the reel action that rotates a spinning reel at a high speed for a predetermined time, rotates the reel at a low speed, and then stop it can be defined to have a higher expectation level than the reel action that rotates the spinning reel at a low speed for a predetermined time and stop it (refer to FIG. 36 (C-1) and FIG. 36 (C-2)). Furthermore, the reel action that rotates a spinning reel in the reverse direction by a predetermined number of symbol frames, rotates it at a predetermined speed for a predetermined time, and then stop it can be defined to have a higher expectation level than the reel action that rotates a spinning reel at a high speed for a predetermined time, rotates the reel at a low speed, and then stop it (refer to FIG. 36 (C-2) and FIG. 36 (C-3)).

<Other Reel Actions>

Figure 34A:
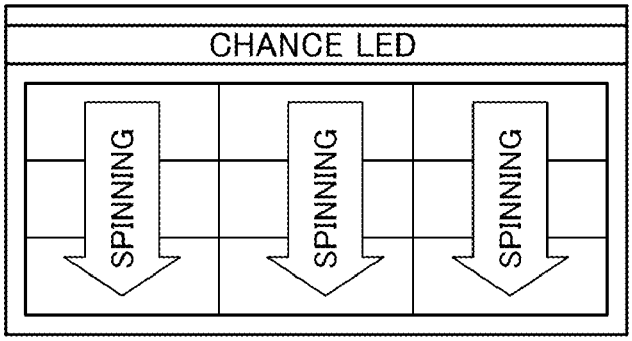
FIGS. 34A to 34C are diagrams illustrating reel actions.
Figure 34B:
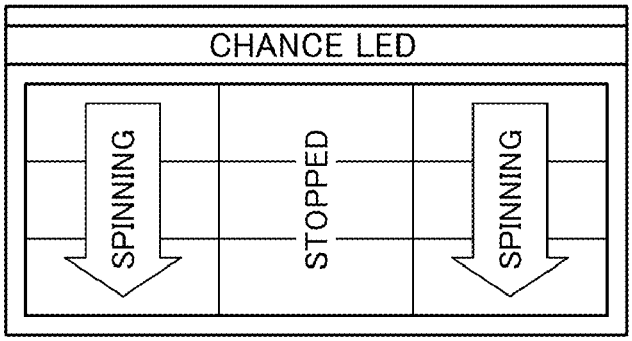
Figure 34C:
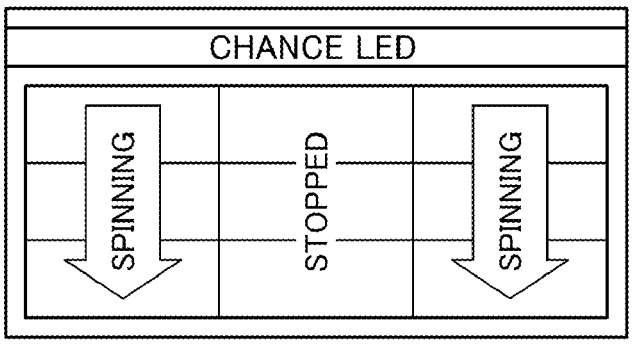

The reel actions described above are those in a li-zhi state after the li-zhi state is made; however, the main CPU 222 may be configured so that the reels perform various reel actions when failed in making a li-zhi state or before making a li-zhi state. For example, when only the reel 52B is stopped (refer to FIG. 34B) after spinning of the three reels 52A, 52B, and 52C (refer to FIG. 34A), the main CPU 222 can be configured so that the reels 52A and 52C perform reel actions different from the normal one (refer to FIG. 34C).

For example, they may be rotated at a lower speed than normal, at a higher speed than normal, in a reverse direction, or in stepwise rotations of a predetermined angle.

<Progressive Awarding>

FIG. 37 is a flowchart illustrating a subroutine of the progressive awarding invoked and executed at Step S470 in FIG. 18.

As mentioned previously, this embodiment provides a common game called Link Progressive participated by a plurality of slot machines 10. Each slot machine 10 calculates an amount to be pooled to a jackpot (accumulation) in each unit game and informs the external control apparatus 14 of it. The external control apparatus 14 pools the amount to be pooled informed by the slot machines 10 in the jackpot. In a Link Progressive, the game system 12 pays out an award from the jackpot when RED7 symbols or BLUE7 symbols are aligned on a payline. Hereinafter, the processing of executing a Link Progressive is described.

First, the main CPU 222 determines whether the progressive mode is ON (Step S2311). The progressive mode is switched ON or OFF by the external control apparatus 14 of the game system 12 (refer to FIG. 2) and the setting information is sent from the external control apparatus 14 to each slot machine 10 and is retained in the RAM 226 of the slot machine 10 (refer to FIG. 5).

If the determination at Step S2311 is that the progressive mode is not ON (NO), the main CPU 222 terminates this subroutine. If the determination is that the progressive mode is ON (YES), the main CPU 222 determines whether three RED7 symbols are aligned on a payline (Step S2313). If the main CPU 222 determines that three RED7 symbols are aligned on a payline (YES), it informs the external control apparatus 14 of a win in the Link Progressive with the three RED7 symbols (Step S2315). Subsequently, the main CPU 222 pays out a progressive award for the three RED7 symbols in accordance with a command from the external control apparatus 14 (Step S2317). It is preferable that Step S2317 pay the progressive award only in a MAX-BET play. Then, the benefit can be provided to a player who has sufficiently invested.

If the determination at Step S2323 is that RED7 symbols are not aligned on a payline (NO) or after execution of Step S2317, the main CPU 222 determines whether three BLUE7 symbols are aligned on a payline (Step S2319). If the main CPU 222 determines that three BLUE7 symbols are aligned on a payline (YES), it informs the external control apparatus 14 of a win in the Link Progressive with three BLUE7 symbols (Step S2321). Subsequently, the main CPU 222 pays out a progressive award for the three BLUE7 symbols in accordance with a command from the external control apparatus 14 (Step S2323). It is preferable that Step S2323 pay the progressive award only in a MAX-BET play. Then, the benefit can be provided to a player who has sufficiently invested.

In this way, if three RED7 symbols are aligned on a payline while the progressive mode is ON, the progressive award for the three RED7 symbols is paid out. In similar, if three BLUE7 symbols are aligned on a payline while the progressive mode is ON, the progressive award for the three BLUE7 symbols is paid out.

Furthermore, if three RED7 symbols are aligned on a payline and three BLUE7 symbols are aligned on another payline, both of the progressive award for the three RED7 symbols and the progressive award for the three BLUE7 symbols are paid out. In this way, if three RED7 symbols are aligned on a payline and three BLUE7 symbols are aligned on another payline, the awards are collectively paid out for the both cases. This approach can provide the player with expectation and motivation to continue to play the game.

The progressive award for three RED7 symbols is higher than the progressive award for three BLUE7 symbols. This difference between a win by three RED7 symbols and a win by three BLUE7 can increase the amusement of the game.

The above-described example has described examples of increasing the li-zhi line or informing the player of the expectation level by means of reel actions of mechanical reels 52A to 52Cs; however, reel actions of video reels may be used to increase the li-zhi line or inform the player the expectation level.

<Reel Assembly 50>

Figure 38:
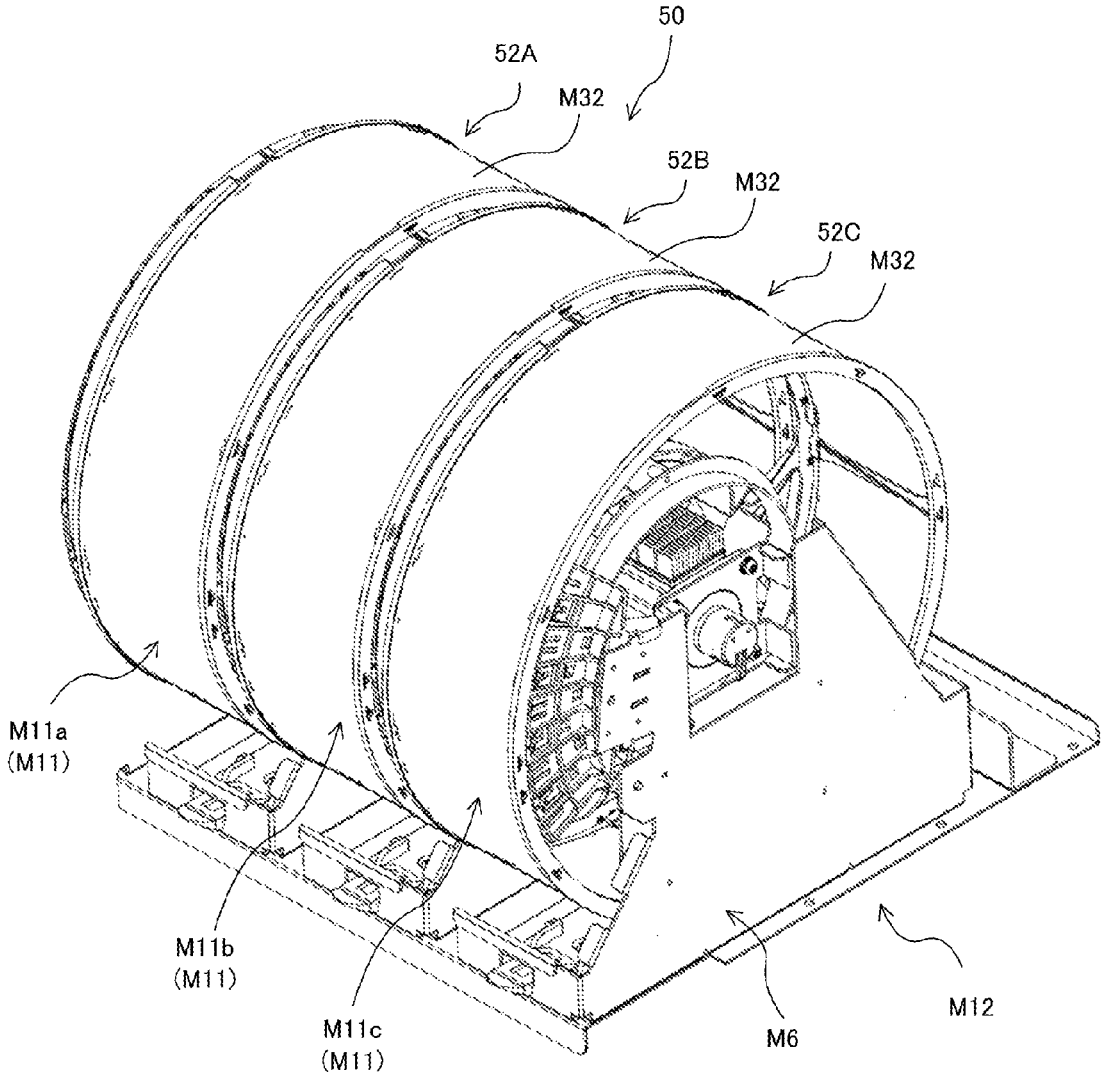
FIG. 38 is a perspective view illustrating a structure of a reel assembly 50.

FIG. 38 is a perspective view illustrating a structure of the reel assembly 50.

The reel assembly 50 included in the slot machine 10 has a structure horizontally supporting three reels 52A to 52C to have their rotational axes on the same line. Rotating the reels 52A to 52C of the reel assembly 50 scrolls the symbols. Stopping the reels 52A to 52C stops the scrolling of the symbols to rearrange the symbols. In the following description, the reels 52A to 52C are merely referred to as reels 52, if they do not need to be distinguished from one another.

The reel assembly 50 includes reel units M11 and a reel unit holding mechanism M12. The reel units M11 are units for rotating the reels 52 to rearrange the symbols. The reel unit holding mechanism M12 holds the reel units M11 detachably. Hereinafter, to specify the places of the reel units M11, they are referred to as the first reel unit M11*a* to the third reel unit M11*c* in order from the left to right when viewed from the front.

A reel unit M11 includes a reel 52 and a reel support mechanism M6. The reel support mechanism M6 supports the reel 52. The reel 52 includes an annular reel strip M32 on which one or more symbols are lined up.

<Reel Strip M32>

Figure 39:
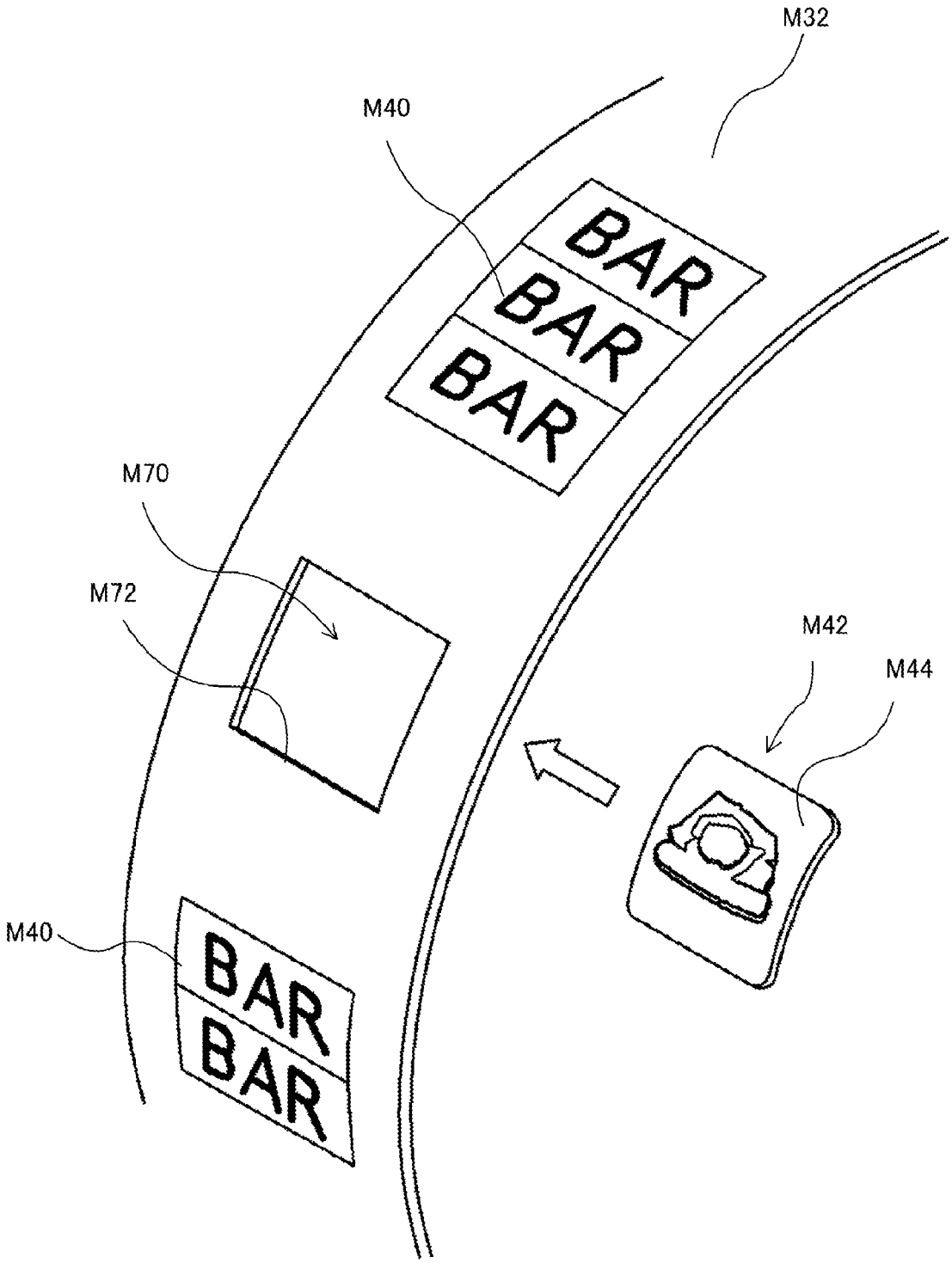
FIG. 39 is a perspective view illustrating a structure of a reel strip M32 and a symbol part.

FIG. 39 is a perspective view illustrating a structure of a reel strip M32 and a symbol part.

On the reel strip M32, various symbols are disposed. Some symbols M40 disposed on the reel strip M32 are symbols printed on a sheet, for example. The sheet is bonded to the reel strip M32 to dispose the symbols M40 on the reel strip M32. Some symbols M42 are disposed on the reel strip M32 by placing separately produced symbol parts M44 on the reel strip M32.

The reel strip M32 has a square opening M70 at a predetermined position. Around the opening M70, a symbol placing part M72 is provided. A symbol part M44 is fixed to the symbol placing part M72 to dispose a symbol M42 on the reel strip M32.

<Symbol Part M44>

Figure 40:
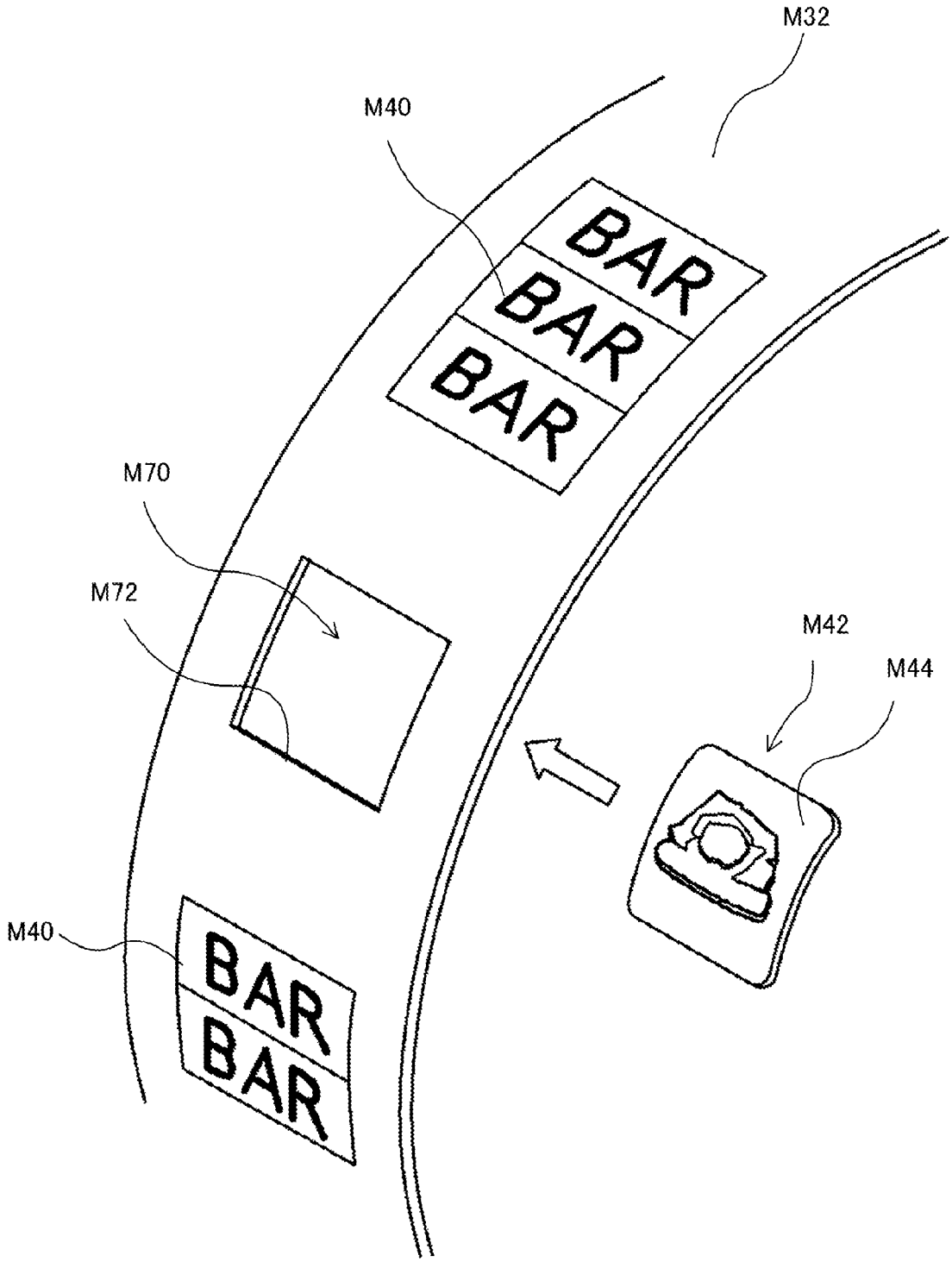
FIG. 40 is a perspective view illustrating a structure of a symbol part.
Figure 41B:
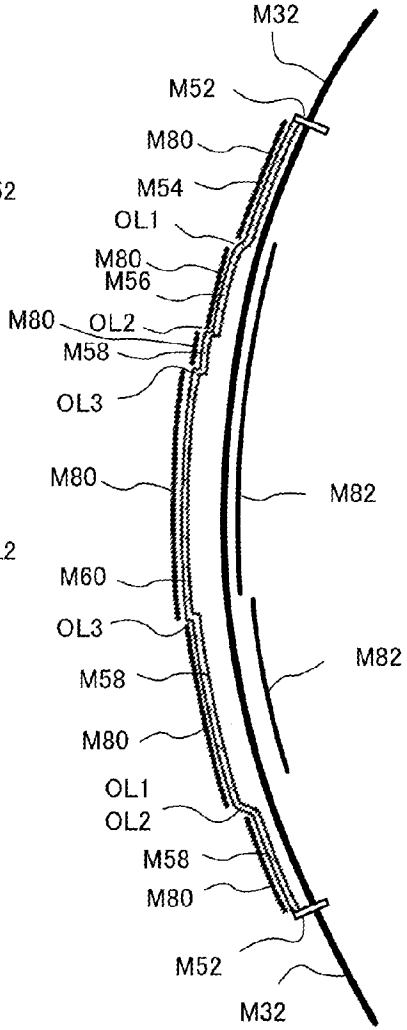
FIG. 41A shows a front view of a symbol part and FIG. 41B shows a cross-sectional view of the symbol part cut along the line A-A.
Figure 41A:
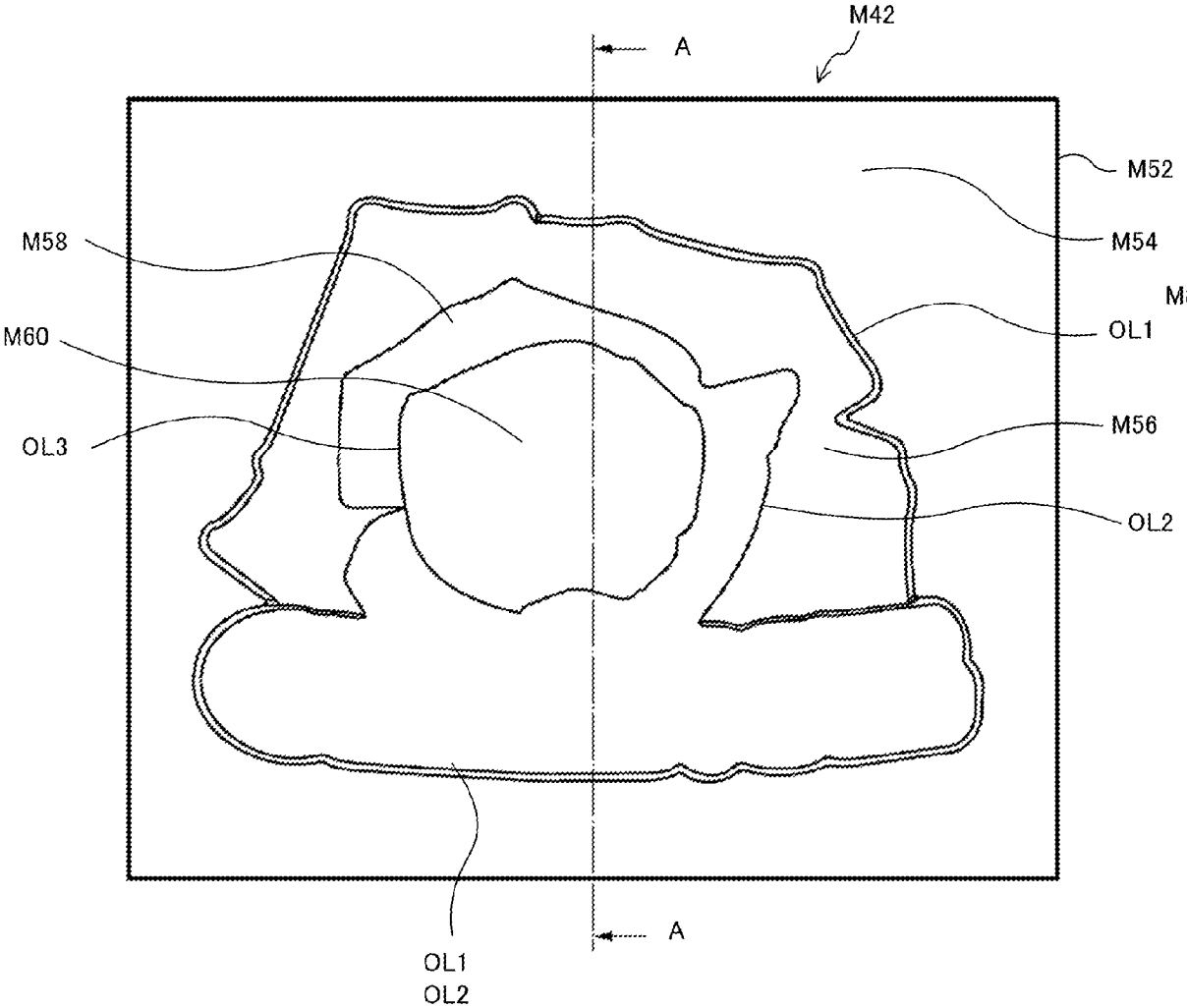

FIG. 40 is a perspective view illustrating the structure of a symbol part M44. FIG. 41(*a*) is a front view of the symbol part M44. FIG. 41(*b*) is a cross-sectional view of the symbol part M44 cut along the line A-A.

The symbol part M44 includes a 3D part M46. The 3D part M46 has a shape resembling a rose in this embodiment. The shape of the 3D part M46 is defined by outlines OL1 to OL3 of the rose. The 3D part M46 is bent and projected along the outlines OL1 to OL3 to form a bulge having a shape of rose.

The outer shape of the symbol part M44 is defined by the symbol defining part M52. The symbol defining part M52 is formed to be angled with respect to a marginal part M54. The marginal part M54 is substantially square. The marginal part M54 has a size and a shape matching the symbol placing part M72. The symbol part M44 can be attached to the reel strip M32 by fitting the symbol part M44 in the opening M70 and fixing the symbol defining part M52 to the symbol placing part M72 (refer to FIG. 39).

In this embodiment, the symbol part M44 includes a first symbol part M56, a second symbol part M58, and a third symbol part M60. The first symbol part M56 is defined by the outlines OL1 and OL2. The second symbol part M58 is defined by the outlines OL2 and OL3. The third symbol part M60 is defined by the outline OL3.

The symbol part M44 is bent along the outlines OL1, OL2 and OL3. The first symbol part M56 is projected from the marginal part M54; the second symbol part M58 is projected from the first symbol part M56; and the third symbol part M60 is projected from the second symbol part M58. This way, a bulging symbol part M44 gradually projecting from the marginal part M54 can be formed.

<Mold 500>

Figure 42:
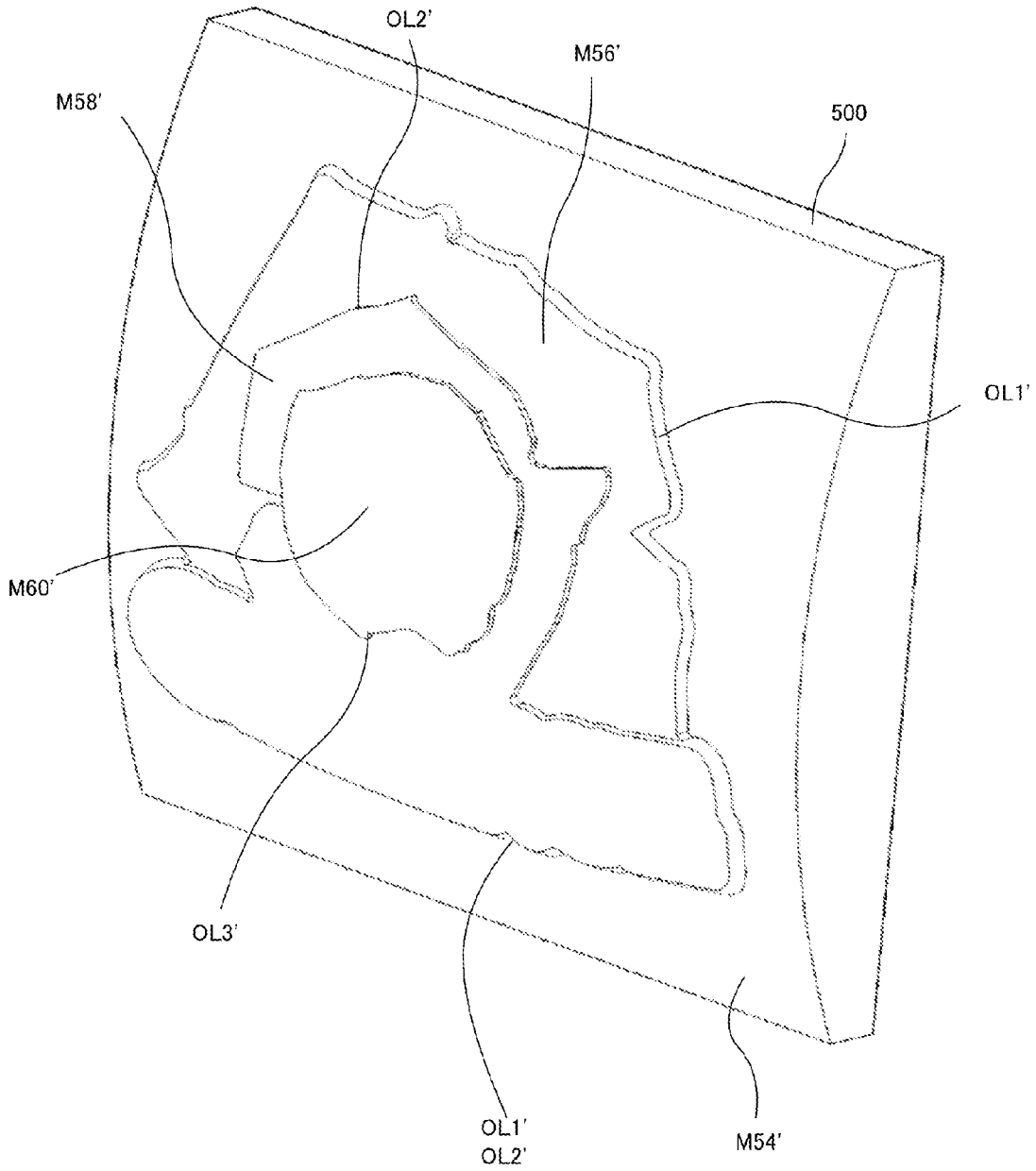
FIG. 42 is a perspective view of a mold to form a symbol part.

FIG. 42 is a perspective view of a mold 500 to form the symbol part M44. The mold 500 is made of metal. The mold 500 has edges OL1' to OL3' to form the outlines OL1 to OL3 of the rose. The mold 500 also has a marginal part M54' to form the marginal part M54, a first symbol part M56' to form the first symbol part M56, a second symbol part M58' to form the second symbol part M58, and a third symbol part M60' to form the third symbol part M60.

In the mold 500, the first symbol part M56' is projected from the marginal part M54' along the edge OL1'; the second symbol part M58' is projected from the first symbol part M56' along the edge OL2'; and the third symbol part M60' is projected from the second symbol part M58' along the edge OL3'.

The symbol part M44 is made of a PET sheet. The PET sheet is pressed against the mold 500 and embossed to form the symbol part M44. This mold 500 enables the symbol part M44 to be formed in such a shape that the first symbol part M56 is projected from the marginal part M54 along the edge OL1; the second symbol part M58 is projected from the first symbol part M56 along the edge OL2; and the third symbol part M60 is projected from the second symbol part M58 along the edge OL3. In this way, a symbol part M44 of a bulged relief gradually projecting from the marginal part M54 can be formed. The symbol part M44 is formed with the mold 500 to have a thickness of approximately 0.2 mm.

Figure 44:
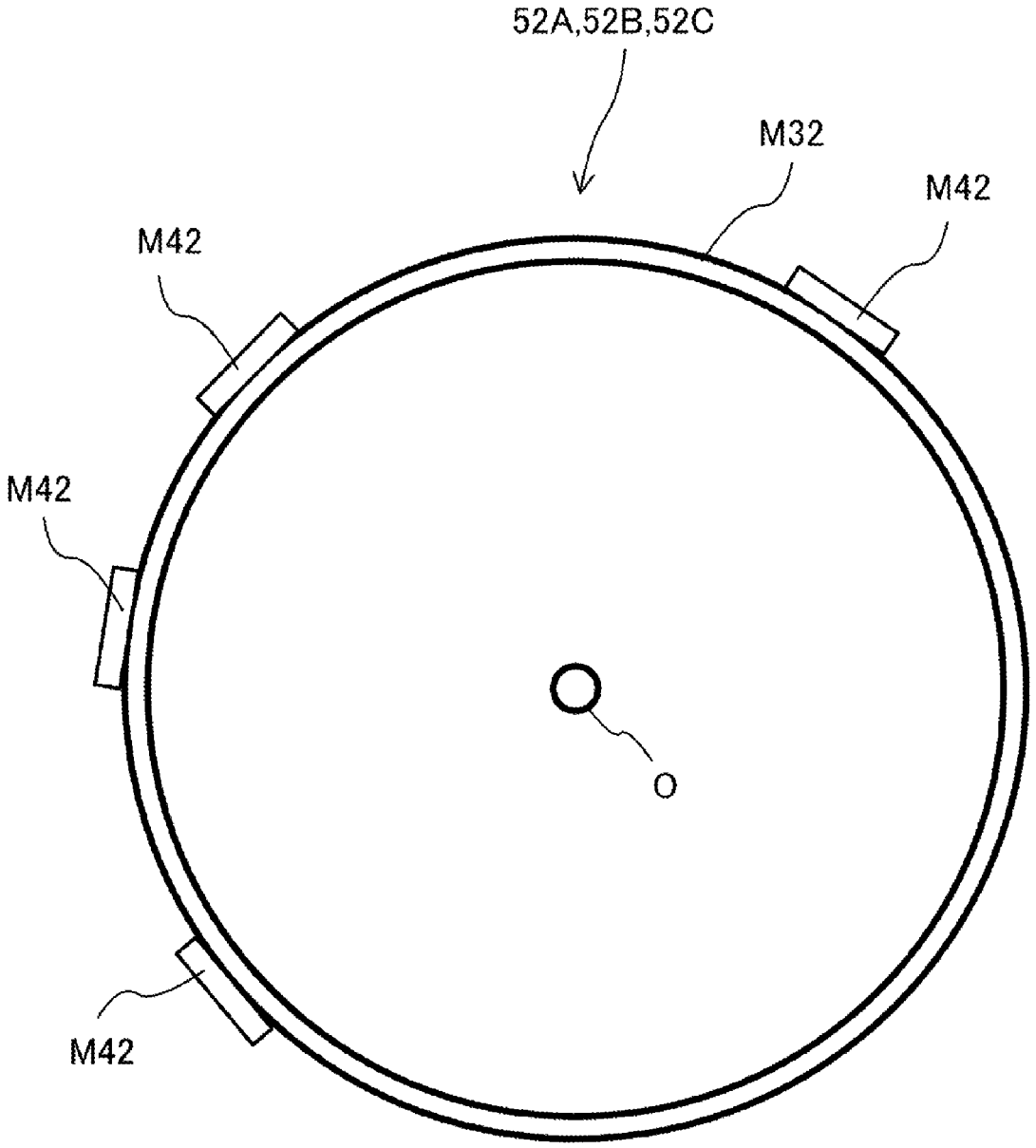
RELATED ART FIG. 44
FIG. 44 is a cross-sectional view illustrating a cross-section of a traditional reel strip.

Since the symbol part M44 is formed by pressing a PET sheet against the mold 500, the symbol part M44 can have a uniform thickness. The uniform thickness prevents the symbol part M44 from being heavier. For example, if the symbol part is formed three-dimensionally by stacking sheets, the symbol part will be heavier than the other part of the reel strip. If symbol parts are disposed asymmetrically about the rotational axis O as shown in FIG. 44, the reel is easily decentered to cause a runout, so that the whole reel wobbles. The player might not be able to recognize the symbols well and feel uncomfortable with playing game.

As described above, the thickness of the symbol part M44 can be uniform in this embodiment so that the symbol part M44 has substantially the same weight as the other part of the reel strip M32. Accordingly, the mass distribution in the reel 52 can be almost uniform in the circumferential direction. For this reason, even if the symbol parts are disposed asymmetrically with respect to the rotational axis O, no runout will be generated to smoothly rotate the reel 52, so that the player can recognize the symbols well. In this embodiment, the reel strip M32 has a thickness of approximately 0.1 to 0.2 mm and the symbol part M44 has a thickness of approximately 0.2 mm. Therefore, even if the symbol part M44 is attached to the reel strip M32, the mass distribution of the reel 52 can be almost uniform in the circumferential direction.

Figure 43:
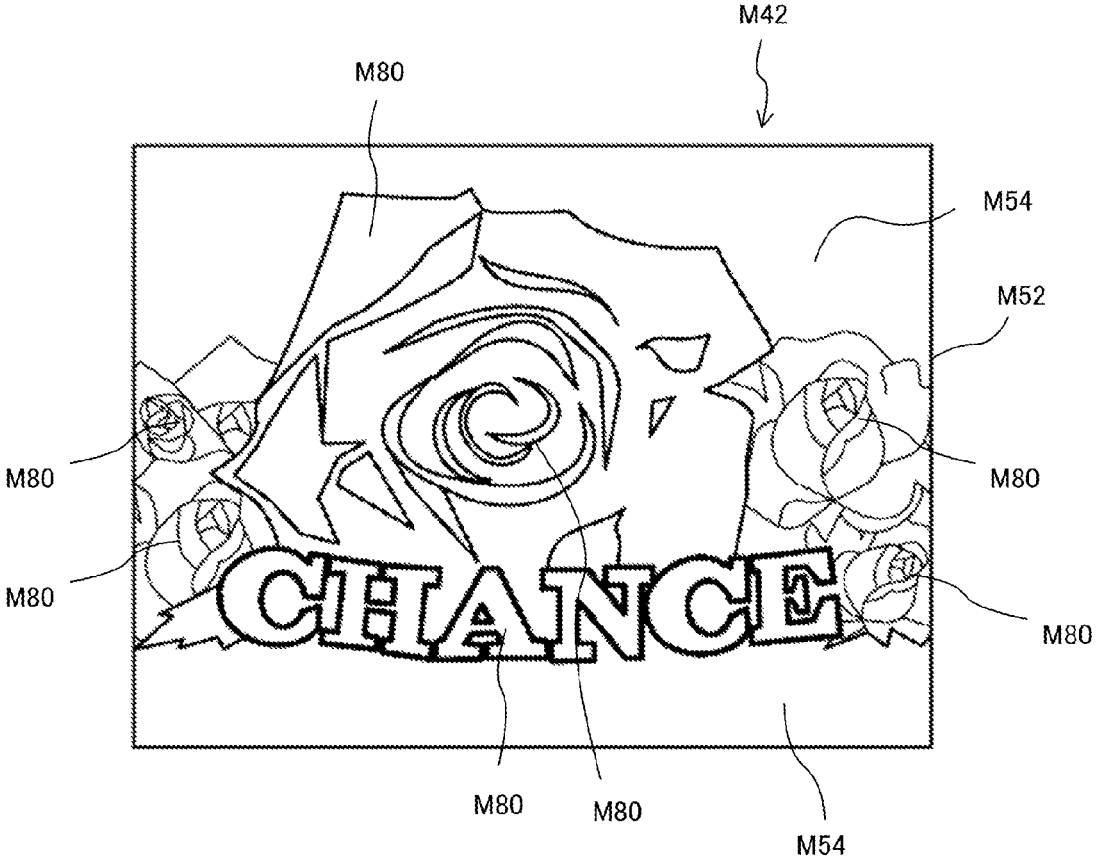
FIG. 43 is a front view illustrating a finished symbol part.

FIG. 43 is a front view illustrating a finished symbol part.

As shown in FIG. 41(*b*), stickers M80 are stuck on the marginal part M54, the first symbol part M56, the second symbol part M58, and the third symbol part M60. On these stickers, pictures of rose petals, neighboring rose buds, and letters are printed. These stickers M80 are bonded to finish the symbol part M44 shown in FIG. 43.

As shown in FIG. 41(*b*), effect producing sheets M82 are provided behind the first symbol part M56, the second symbol part M58, and the third symbol part M60. The effect producing sheets M82 are shaped to match the symbol and control the direction of light by reflecting or diffusing the light. For example, a sheet that diffuses light may be used as the effect producing sheet M82. When the lights 282 of the backlight device 280 illuminate the symbol part M44, this sheet diffuses the light to uniformly illuminate the symbol.

The above-described example explained a case where a square opening M70 is provided and further, a square symbol defining part M52 is provided. The opening M70 may have a shape corresponding to the outline OL1 of the symbol M42 to allow the symbol M42 to fit in the opening. The opening having the size of a symbol can reduce the waste of the material.

What is claimed is:

1. A wagering machine for determining an award to be given based on rearranged symbols, the wagering machine comprising:

a display device including a display area for variably displaying and showing a part of symbols associated with a plurality of scroll lines;

an input device for receiving an instruction related to a game;

a value-addition mechanism for receiving game media;

an award payout mechanism by which game media is paid out to a player or credited to an available-betting-amount account of the player; and a controller for controlling unit games in which the symbols associated with the plurality of scroll lines are scrolled and a part of the symbols are rearranged in the display area, the controller being programmed to execute the following processing as a result of the player having made a bet input of an amount of game media:

(a) determining symbols to be rearranged in the display area at random and causing the symbols to scroll along the scroll lines in a normal scrolling motion;

(b) selecting a revised-scrolling-motion mode from among a plurality of available revised-scrolling-motion modes according to which scrolling motion of symbols along a given scroll line is changed relative to the normal scrolling motion; and changing the scrolling motion of a first scroll line, which is at least one of the plurality of scroll lines, so as to scroll in accordance with the selected revised-scrolling-motion mode under a condition where predetermined symbols are aligned on a predefined payline when the symbols of the first scroll line are being scrolled and symbols on remaining second scroll lines are stopped; and (c) rearranging the symbols to be rearranged in the display area after executing the processing (b);

wherein different ones of the available revised-scrolling-motion modes have different winning-combination expectation levels associated with them and the revised-scrolling-motion mode that is selected from among the plurality of available revised-scrolling-motion modes corresponds to a pre-retrieved winning-combination expectation level, whereby the changed scrolling motion of the first scroll line is indicative of the pre-retrieved winning-combination expectation level.

2. A wagering machine according to claim 1, wherein there is a possibility that no award is given even when the scrolling motion of the first scroll line is changed, wherein the plurality of available revised-scrolling-motion modes include a first revised-scrolling-motion mode and a second revised-scrolling-motion mode, and wherein the possibility that no award is given after the symbols of the first scroll line are being scrolled in the second revised-scrolling-motion mode is higher than the possibility that no award is given after the symbols of the first scroll line are being scrolled in the first revised-scrolling-motion mode.

3. A wagering machine for determining an award to be given based on rearranged symbols, the wagering machine comprising:

a display device including a display area for variably displaying and showing a part of symbols associated with a plurality of scroll lines and providing a predefined payline for determining whether to give the award;

an input device for receiving an instruction related to a game;

a value-addition mechanism for receiving game media;

an award payout mechanism by which game media is paid out to a player or credited to an available-betting-amount account of the player; and a controller for controlling unit games in which the symbols associated with the plurality of scroll lines are scrolled and a part of the symbols are rearranged in the display area, the controller being programmed to execute the following processing as a result of the player having made a bet input of an amount of game media:

(a) determining symbols to be rearranged in the display area at random and causing the symbols to scroll along the scroll lines in a normal scrolling motion;

(b) selecting a revised-scrolling-motion mode from among a plurality of available revised-scrolling-motion modes according to which at least one of direction of scrolling, speed of scrolling, time of scrolling, and time to stop scrolling of symbols along a given scroll line is changed relative to the normal scrolling motion; and changing the scrolling motion of a first scroll line, which is at least one of the plurality of scroll lines, so as to scroll in accordance with the selected revised-scrolling-motion mode under a condition where a winning symbol combination for winning the award is partially completed on a predefined payline when the symbols of the first scroll line are being scrolled and symbols of remaining second scroll lines are stopped;

(c) rearranging the symbols to be rearranged in the display area after executing the processing (b); and (d) giving the award in a case where the winning symbol combination is completed on the predefined payline with the rearranged symbols;

wherein different ones of the available revised-scrolling-motion modes have different winning-combination expectation levels associated with them and the revised-scrolling-motion mode that is selected from among the plurality of available revised-scrolling-motion modes corresponds to a pre-retrieved winning-combination expectation level, whereby the changed scrolling motion of the first scroll line is indicative of the pre-retrieved winning-combination expectation level.

4. A wagering machine according to claim 3, wherein there is a possibility that no award is given even when the scrolling motion of the first scroll line is changed, wherein the plurality of available revised-scrolling-motion modes include a first revised-scrolling-motion mode and a second revised-scrolling-motion mode, and wherein the possibility that no award is given after the symbols of the first scroll line are being scrolled in the second revised-scrolling-motion mode is higher than the possibility that no award is given after the symbols of the first scroll line are being scrolled in the first revised-scrolling-motion mode.

* * * * *